United States Patent [19]

Lathom et al.

[11] Patent Number: 5,010,279

[45] Date of Patent: Apr. 23, 1991

[54] SWITCHED CAPACITIVE BALLASTS FOR DISCHARGE LAMPS

[76] Inventors: Michael S. Lathom, 4314 Forest Lakes Dr., Del Valle, Tex. 78617; Bruce B. Gullixson, 1513 W. Jackson; Bruce P. Sweat, 3015 E. 16th, both of, Spokane, Wash. 99205

[21] Appl. No.: 167,255

[22] Filed: Mar. 11, 1988

Related U.S. Application Data

[63] Continuation-in-part of Ser. No. 769,482, Aug. 26, 1985, Pat. No. 4,808,886.

[51] Int. Cl.[5] ..... H05B 37/00; H05B 39/00/41/14

[52] U.S. Cl. ..... 315/227 R; 315/240; 315/241 R; 315/243; 315/244; 315/307; 315/291; 315/DIG. 7; 363/59; 363/63

[58] Field of Search ..... 315/227 R, 240, 241 R, 315/242, 243, 244, DIG. 4, DIG. 7, 302, 306, 307; 320/1; 363/59, 60, 61, 62, 63

[56] References Cited

U.S. PATENT DOCUMENTS

| | | | |
|---|---|---|---|
| 3,443,154 | 4/1969 | Hoekstra et al. | 315/340 |
| 3,579,026 | 5/1971 | Paget | 315/99 |
| 3,591,830 | 7/1971 | Woolsey | 315/290 |
| 3,643,127 | 2/1972 | Laupman | 315/101 |
| 3,968,400 | 7/1976 | Weinreich | 315/209 R |
| 4,042,856 | 8/1977 | Steigerwald | 315/227 R |
| 4,132,925 | 1/1979 | Schmutzer et al. | 315/208 |
| 4,134,043 | 1/1979 | Nuver | 315/42 |
| 4,167,689 | 9/1979 | Quirke | 315/206 |
| 4,219,872 | 8/1980 | Engelmann | 363/126 |
| 4,230,971 | 10/1980 | Gerhard et al. | 315/307 |
| 4,260,932 | 4/1981 | Johnson | 315/205 |
| 4,289,993 | 9/1981 | Harper et al. | 310/311 |
| 4,337,417 | 6/1982 | Johnson | 315/290 |
| 4,340,843 | 7/1982 | Anderson | 315/205 |
| 4,366,570 | 12/1982 | Bees | 372/70 |
| 4,370,600 | 1/1983 | Zansky | 315/244 |
| 4,398,128 | 8/1983 | Wollank | 315/DIG. 2 |
| 4,406,976 | 9/1983 | Wisbey et al. | 315/307 |
| 4,506,196 | 3/1985 | Bees | 315/241 R |
| 4,555,647 | 11/1985 | Leskovec et al. | 315/179 |
| 4,719,390 | 1/1988 | Sairanen | 315/DIG. 5 |
| 4,808,886 | 2/1989 | Lathom et al. | 315/227 R |

FOREIGN PATENT DOCUMENTS 2147159A 2/1985 United Kingdom .

*Primary Examiner*—Eugene R. LaRoche
*Assistant Examiner*—Michael B. Shingleton
*Attorney, Agent, or Firm*—Wells, St. John & Roberts

[57] ABSTRACT

Ballast and starting circuits for controlling current and voltage applied to an electrical discharge lamp. The ballast circuits use diodes or other suitable means to divide the AC power into positive and negative currents. The ballast circuits use positive and negative capacitors which are charged by the divided AC line current. In some embodiments the positively charged capacitors are charged during positive portions of alternating current and discharged during negative portions of the alternating current. The negatively charged capacitors are charged during negative portions of the alternating current and discharged during positive portions. Transistors or other appropriate switching means are used to controllably conduct current from the positive and negative capacitors to the lamp in an asynchronous manner. Startup circuits are included for boosting the voltage applied to the lamp either manually or automatically upon startup. A startup regular circuit is also shown for controlling current flow during periods of high current demand such as during startup. A further embodiment uses a modulated current control for the positive and negative sides of the ballast circuit to control power flow therethrough and maintain power dissipation across power discharge switching transistors at minimal values.

103 Claims, 16 Drawing Sheets

622
624
623
POSITIVE INTEGRATOR
POSITIVE ERROR SIGNAL GENERATOR
POWER SUPPLY CIRCUITRY
817
A5
A6
A7
A8
R250
R251
R252
R253
R254
R255
R256
R257
R258
R259
R260
R261
R262
R263
R264
R265
R266
R267
R268
R269
R270
R271
R280
R281
R282
R283
R284
C140
C141
C142
C143
C144
C152
801
802
804
805
806
807
808
809
810
811
812
813
814
815
816
818
819
T
CC
Q
GE
GG
FF
P
W
TT

TO POSITIVE MODULATOR SWITCH 621
PULSE WIDTH MODULATOR CHIP
LOGIC
OSCILLATOR
COMP
622
870
860
880

SWITCHED CAPACITIVE BALLASTS FOR DISCHARGE LAMPS

RELATED APPLICATIONS

This is a continuation-in-part of U.S. patent application Ser. No. 769,482, filed Aug. 26, 1985 now U.S. Pat. No. 4,808,886 and titled "Switched Capacitive Ballasts for Discharge Lamps."

TECHNICAL FIELD

The technical field of this invention is ballast circuits for controlling current flow through electrical discharge lamps.

BACKGROUND OF THE INVENTION

Electrical discharge lamps are widely used in various forms, such as fluorescent lights, neon lights, mercury vapor lights and sodium vapor lights. These and many other types of electrical discharge lamps are known and possible using technology which began in the 1800's when many scientists experimented with electrical discharge lamps.

Electrical discharge lamps are characterized by an envelope of glass or other transparent material which encloses a volume of appropriate gas. The enclosed gas can be of a variety of types and combinations which are capable of being ionized to allow electrical current to flow therethrough. Examples of suitable gases employed in electrical discharge lamps include air, neon and argon. These gases are often combined with small quantities of suitable metals and other materials which improve the ionization or light emissive properties of the lamp. Examples of metals commonly used in discharge lamps are sodium and mercury, which vaporize as a result of the heat generated by the lamps. Discharge lamps are also manufactured using combinations of gases such as neon and argon with metal halides such as mercury iodide and sodium iodide.

The variety of gases and added materials used in discharge lamps have widely varying voltage requirements for initiating ionization. The voltage or potential required across the electrodes before ionization will occur depends upon the gas type, internal pressure of the gas, gas temperature, and electrode spacing. After the gas within a discharge lamp becomes ionized, current flows more readily because of the increased number and density of available charge carriers. The increased number of charge carriers greatly reduces the resistance across the electrodes as compared to the starting resistance required when initiating ionization. This decrease in the electrical resistance across the lamp electrodes requires that some form of current limiting device be used in conjunction with the discharge lamp to control the flow of current and prevent the destructive amounts of heat which would be caused thereby. Current control is also desired to reduce power consumption and optimize the illumination output of the lamp. This current limiting function for discharge lamps has typically been performed by an electrical device termed a ballast.

Prior art discharge lamp ballasts have typically used a transformer or other induction coil between the source of electricity and the discharge lamp in order to limit current flow through the lamp. Such transformer ballasts have also often been used to boost the starting voltage to the lamp. Such prior art inductive ballasts suffer from a number of disadvantages. Transformers are relatively costly to manufacture and are also relatively large and heavy. This increases the total cost of the discharge lamp and further requires that relatively strong standards, poles, overhanging arms and other supporting structures be employed. Increased size and strength for foundations and other structural members must also accordingly be provided.

It has also not been practical to remotely mount transformer ballasts at the base of a light pole or otherwise in a remote location because of the relatively high starting or ionization voltage required. Supplying such starting potential has been difficult or impossible to attain when lengths of wire greater than 25–30 feet have been used because of line losses and voltage decreases occurring due to capacitance developed across the supply wiring. Accordingly, it has been standard practice to mount the heavy, bulky transformers immediately adjacent the lamp.

The close mounting of inductive ballasts to discharge lamps typically causes very significant increases in installation and maintenance costs. Installation costs are increased because of the increased size and structural capability which must be provided in any light fixture and supporting structure. Placement of such heavy ballasts in street lighting and other applications also usually entail an overhanging configuration in the added weight of the ballasts which further increase the demands placed upon the supporting poles and other structural elements. Since these poles and other supporting structures are often tall, slender, and free standing, the incremental weight of the inductive ballasts require a disproportionately large amount of the installation costs. Further aggravating these basic structural problems are the effects of wind upon light standards. The large size of the ballasts and associated hoods are more easily displaced by wind forces striking the units atop typically slender light standards, thus displacing the load further off center and intensifying the structural loading problem associated with the weight of the ballasts.

Inductive ballasts must also be shielded from the wind and weather thus requiring additional expense for protective hoods or other coverings. Such protective hoods are relatively large thus increasing the wind loading and weight placed upon the structure which still further increases the costs of manufacturing and installation.

The installation costs of discharge lamp lighting is further increased when transformer ballasts are used because of the relatively high costs of crating, shipping and handling the heavy and bulky transformer. Manufacture of such transformer ballasts also requires relatively large scale heavy industry in order to produce economically. The materials and costs of constructing inductive ballasts are accordingly high.

Maintenance of transformer ballasts has also proven to be costly and difficult. Transformer ballasts produce substantial amounts of heat which tend to deteriorate the coil winding insulation thus leading to short circuiting of the coils and replacement of the ballast. Since the transformer ballasts cannot be conveniently mounted in remote locations from the lamp, this often requires cranes in order to remove and replace deficient ballasts. This accordingly increases maintenance costs.

Vibration produced by transformer ballasts may also cause fluctuating or cyclical loading on the light fixture supporting structures which requires increased strength, or in some cases premature failure, resulting damage and maintenance costs. The expected service life of transformer ballasts is also sufficiently short for the above and other reasons so that maintenance must be performed on a regular basis where numerous units are in service.

Prior art transformer ballasts also suffer from a tendency to vibrate at 60 Hz and several upper harmonies thereof thus producing very noticeable and often irritating noise. This noise has restricted most types of discharge lamps to exterior uses only. Fluorescent type discharge lamps are widely used in interior applications because they do not produce as much noise as other more efficient types of discharge lamps which are noisier. Considering the widespread use of fluorescent lamps, this results in tremendous increased power costs for using fluorescent type lamps versus sodium vapor and other more efficient lamps.

Prior art inductive ballasts are also disadvantageous in providing an inductive power factor component. Power companies typically experience excess inductive as compared to capacitive reactive power factor components, thus requiring installation of power factor correcting equipment such as large banks of capacitors. Such equipment is expensive and accordingly increases the cost of power to the consumer. Thus there is a need for discharge lamp ballasts which produce a capacitive power factor which can be used to offset power consumed by inductive devices such as electric motors.

SUMMARY OF THE INVENTION

A preferred form of the invention includes two capacitors or capacitor banks which are each connected to an incoming alternating current supply using blocking diodes or some other suitable means for dividing the positive and negative portions of the alternating current. One capacitor bank receives the positive portion of the alternating current and the other capacitor receives the negative portion. Switching means such as switching transistors are connected between the capacitors and the discharge lamp being powered in order to control the discharge of positive and negative operating current through the lamp. The switching means are asynchronously and alternately opened and closed, thereby alternately disconnecting and connecting the capacitors in order to discharge the capacitors through the lamp and provide power thereto.

In some embodiments the switching means are controlled by a suitable switching control circuit which places the power discharge switches into an open mode during the associated positive or negative portions used to charge that respective capacitor. The positive and negative power discharge switches are placed into a closed mode out of phase with the positive or negative portions of the AC line cycle which that particular capacitor receives, thus isolating the lamp from direct discharge of line current. Current through the lamp is thus controlled by the capacitance of each capacitor bank and the extent to which they can be discharged during the period its associated switching means is closed.

Embodiments having manual and automatic starting circuits are also provided to boost voltage during startup. Preferred embodiments also include indicator lamps for improved diagnostic maintenance. Still further circuitry can be provided to regulate power flow to the main capacitors and through the power discharge switching transistors to thus prevent excessive current loading during startup. Still further embodiments are provided with multiple voltage and wattage capabilities using alternate jumper connectors.

Further embodiments of the invention utilize two or more capacitors or other electrical energy storage means which are connected to an incoming alternating current supply using diodes or other suitable means for dividing the positive and negative portions of the alternating current. One of the capacitors receives the positive portions of the alternating current and the other capacitor receives the negative portions. Energy stored in the positive and negative capacitors or other energy storage means are controllably conducted to respective positive and negative power discharge switching means using a controllable positive and negative modulation circuitry. The positive and negative modulation circuits each advantageously include modulation transistors which are controlled to conduct current using suitable modulation driver circuitry. In the preferred embodiments the modulation circuitry provides pulsed emissions of operating current thereby minimizing the power dissipation which occurs in the modulation switching device. The pulsed positive and negative currents from the positive and negative modulation circuitry is preferably passed through a suitable filter to eliminate the pulsed nature of the current emitted therefrom. This is advantageously accomplished using an inductive choke and associated capacitance. The outputs from the positive and negative filters are controllably conducted by the positive and negative power discharge switching means. The lamp power discharge switching means which control power flow through the discharge lamp and are operated in an alternating asynchronous manner to conduct positive current through the lamp during positive lamp discharge portions, and negative current through the lamp during negative lamp discharge portions.

Preferred circuits according to this invention can also preferably include arc initiation subcircuits which provide boosted operating voltages for brief portions of the lamp alternating current cycle for both the positive and negative currents passed therethrough. The relatively higher voltage arc initiation discharge allows more efficient operation of the lamp by initiating discharge with a relatively small amount of higher voltage current.

One preferred type of current modulation circuit effectively senses the voltage drop which occurs across the power discharge switching transistors in order to reduce or minimize the power dissipated across these switches during operation.

Benefits of the invention can include lower power loss, physical lightness, reduced noise and interference, compactness, remotely locatable, low heat output, lower cost mounting structures, less expensive to manufacture, lower freight costs, capacitive power factor, and better regulation of current to the needs of the lamp. Some or all of these, and other benefits of the invention which may be recognized below or in the future, may be accomplished using ballast circuits according to this invention. Exemplary preferred forms of the invention will be described below.

BRIEF DESCRIPTION OF THE DRAWINGS

Preferred embodiments of the invention are shown in the accompanying drawings.

DETAILED DESCRIPTION OF THE PREFERRED EMBODIMENT

In compliance with the constitutional purpose of the Patent Laws "to promote the progress of science and useful arts" (Article 1, Section 8), applicant submits the following disclosure of the invention.

Figure 1:
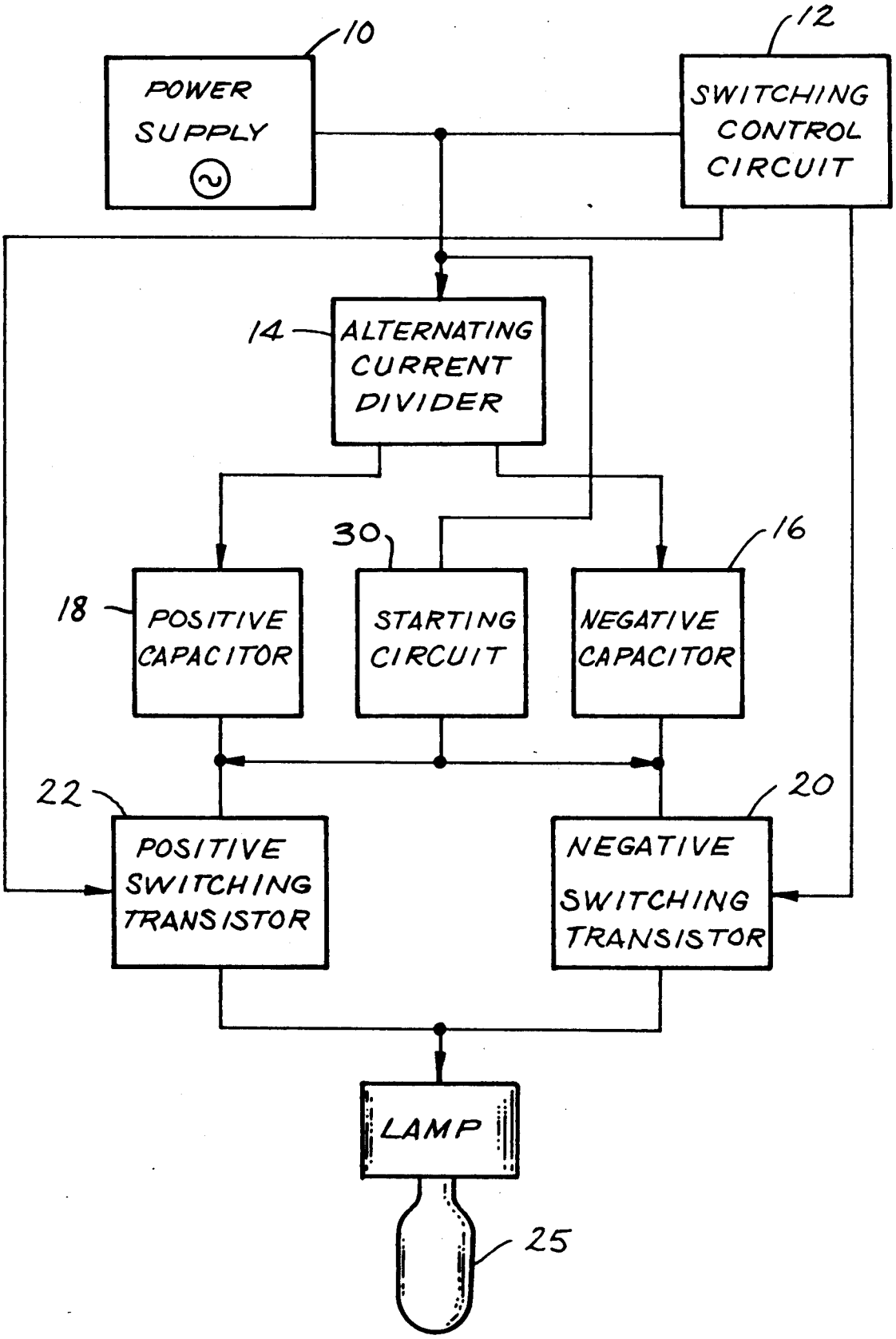
FIG. 1 is a block diagram showing the principal functional elements of basic forms of the invention.

FIG. 1 shows a basic conceptual model of the fundamental functional elements of many of the preferred embodiments of this invention. An alternating current power supply 10 provides power to a switching control circuit 12 and to a suitable circuit 14 for dividing the alternating current into separate positive and negative current flows. The negative and positive current flows are separately supplied to negative and positive capacitors 16 and 18, respectively. Positive capacitor 18 is charged during positive portions of the alternating current. Negative capacitor 16 is charged during negative portions of the alternating current. Each capacitor is charged directly out of phase with the other in an alternating manner.

Negative capacitor 16 is controllably discharged through negative switching transistor 20 to lamp 25 during positive portions of the alternating current, while positive capacitor 18 is charged. Positive capacitor 18 is controllably discharged through positive switching transistor 22 to lamp 25 during negative portions of the alternating current, while negative capacitor 16 is being charged. The capacitors 16 and 18 are thus alternately charged and then discharged through lamp 25 in a substantially complementary and asynchronous manner.

FIG. 1 also shows a starting circuit 30 which is used to boost the voltage applied through either or both positive or negative switching means 22 and 20, respectively. Starting circuit 30 is preferably used for a relatively short period of time during and immediately after initially supplying current from power supply 10 to starting circuit 30 and lamp 25.

Figure 2:
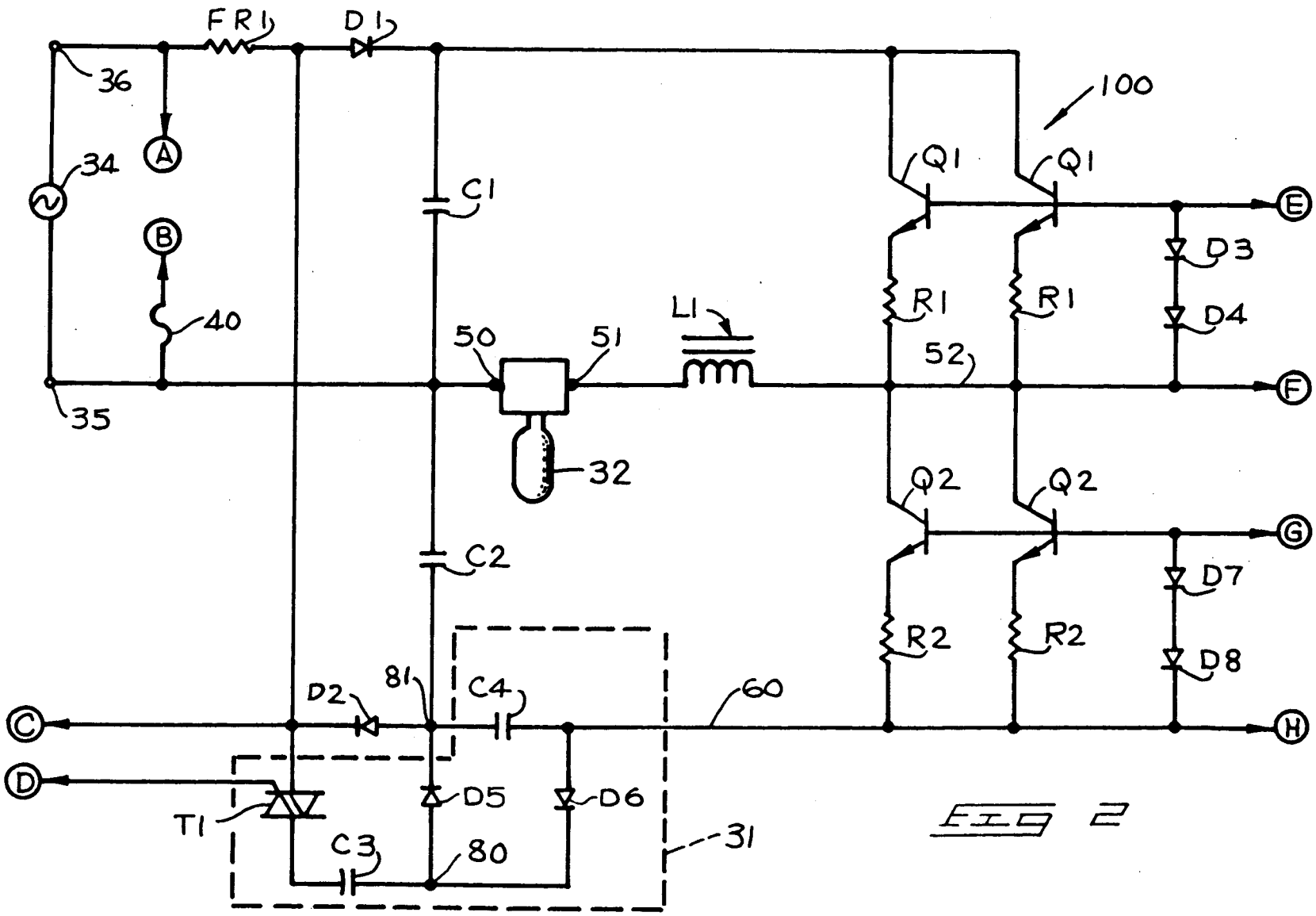
FIG. 2 is a schematic circuit diagram of a portion of a preferred circuit according to this invention.

FIG. 2 shows a portion of a ballast and starting circuit 100 useful in powering a metal halide electrical discharge lamp 32 such as a 400 watt sodium iodide lamp. Power is supplied by an alternating current power supply 34, such as a nominal 120 volt, 60 Hz line current used widely in the U.S. Power supply 34 is advantageously connected with terminal 35 as neutral and terminal 36 as the hot terminal at which voltage swings from approximately −170 volts to +170 volts in a typical 120 volt rms sinusoidal cycle. The period during which the potential of terminal 36 is positive with respect to terminal 35 is termed the positive potential portion. The period during which the potential of terminal 36 is negative with respect to terminal 35 is termed the negative potential portion. Together one positive and one negative potential portions essentially comprise a single alternating current cycle.

Figure 3:
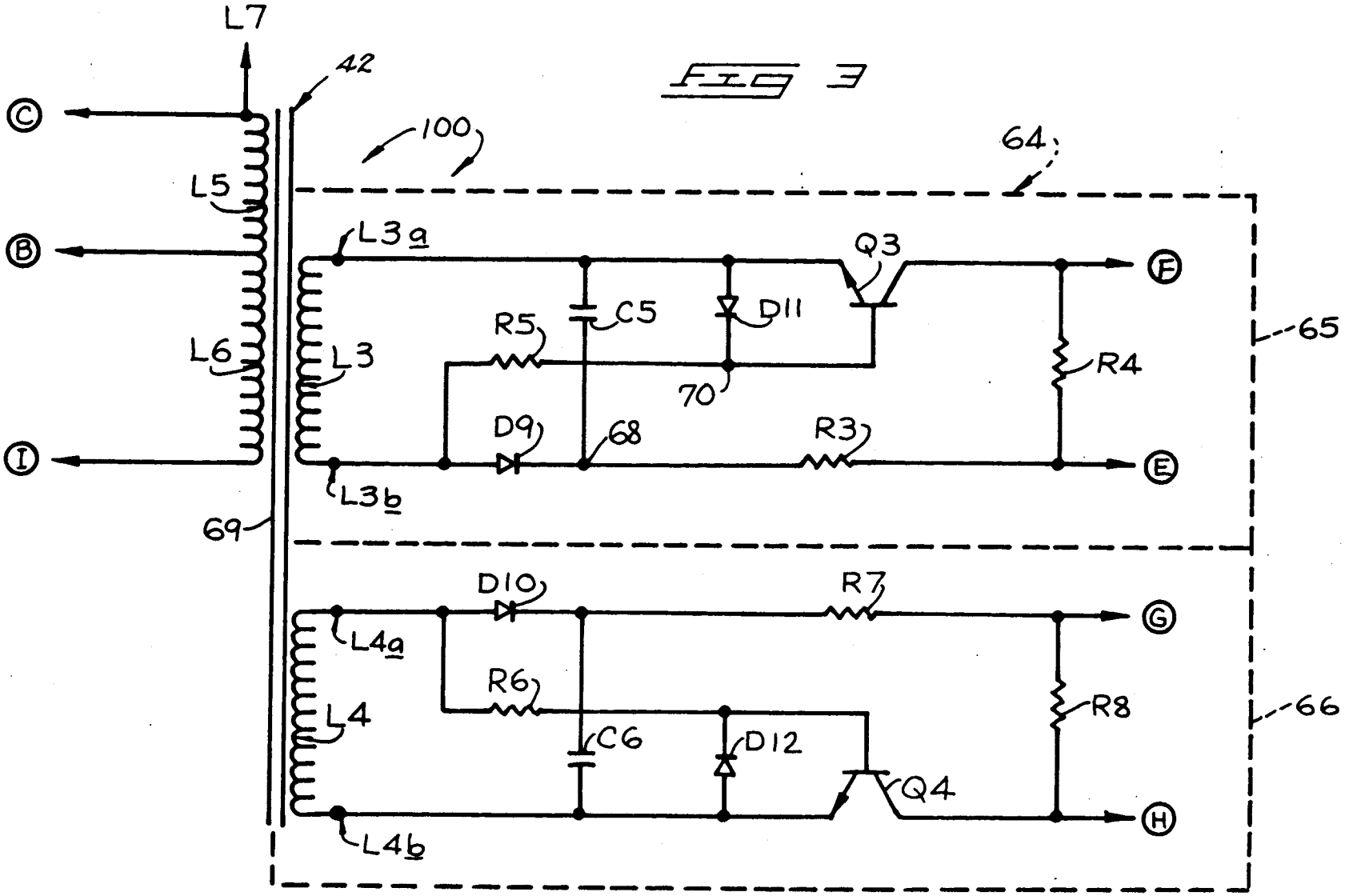
FIG. 3 is a schematic circuit diagram of a further portion of the preferred embodiment shown in FIG. 2.
Figure 4:
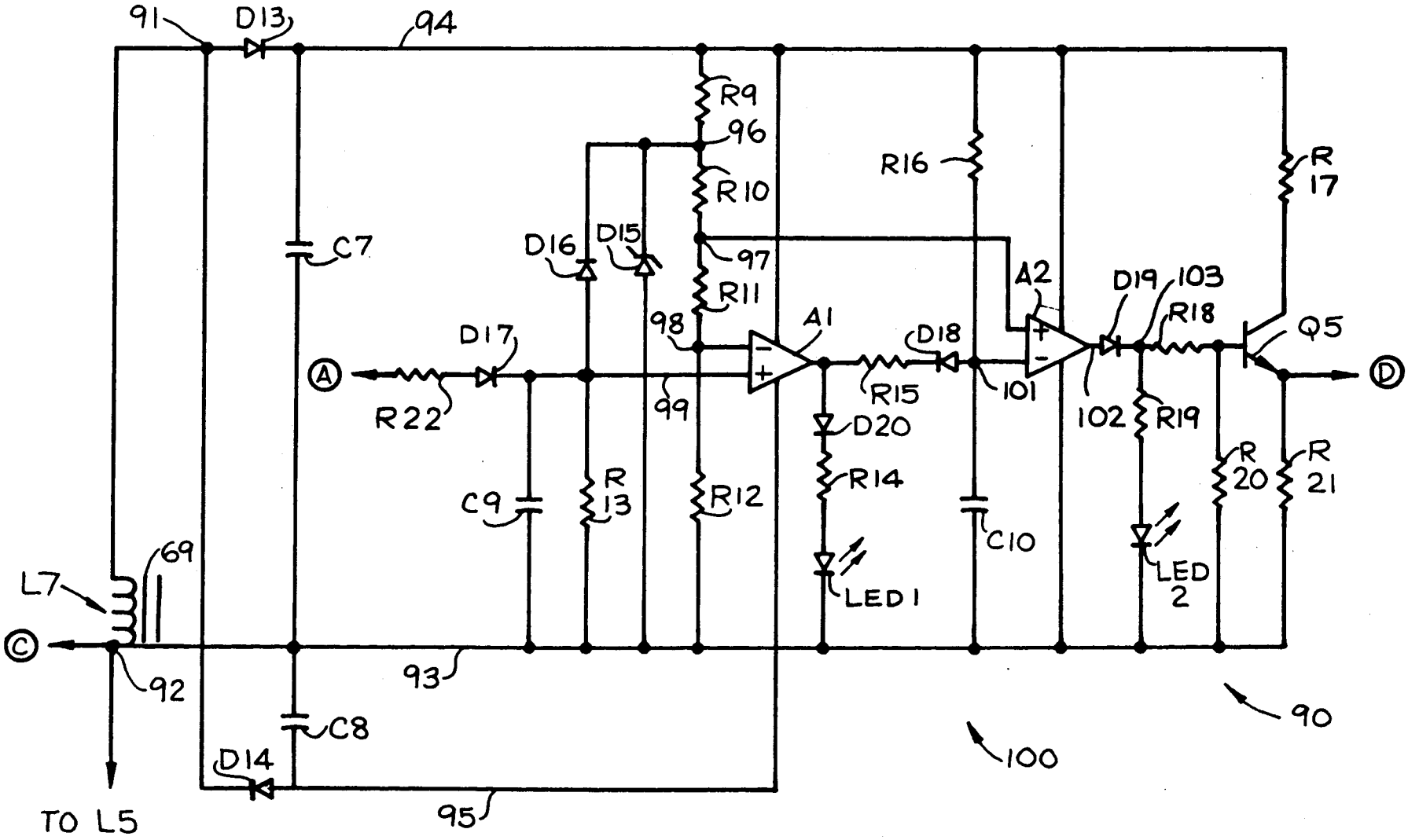
FIG. 4 is a schematic circuit diagram of a further portion of the preferred embodiment shown in FIGS. 2 and 3.

Letter A designates a connection of the line voltage to control portions of the circuit shown in FIG. 4. A fusible surge resistor FR1 is advantageously provided between line voltage and remaining components of circuit 100. A thermal circuit breaker, fuse or cutout 40 can advantageously be included between terminal 35 and terminal B of transformer 42 of FIG. 3.

The alternating current (a-c) output from fusible resistor FR1 is supplied to two blocking diodes D1 and D2. Blocking diode D1 is oriented with anode toward line voltage in order to pass positive current to one side of capacitor C1. Diode D2 is oppositely oriented to pass negative current to one side of capacitor C2. The configuration of diodes D1 and D2 thus divides the alternating current from supply 34 into a positive component going to capacitor C1 and a negative component going to capacitor C2. Capacitors C1 and C2 can be any suitable electrical energy storage means. It has been found preferable not to use electrolytic capacitors. The opposite sides of capacitors C1 and C2 are connected to neutral terminal 35 which is also connected to terminal 50 of lamp 32.

The positively charged side of capacitor C1 is connected to a first electrical switching means such as switching transistors Q1 connected in parallel. Switching transistors Q1 are placed in a closed or conductive mode by applying a positive emitter to base bias voltage. Base voltage for switching transistors Q1 is provided by connecting to a positive switching control circuit 65 at conductor E of FIG. 3.

Switching transistors Q1 are controlled by switching control circuit 65 so as to only be biased into a closed mode during negative portions of the alternating current power supplied by current supply 34. This assures that there is no direct application of line current to lamp 32 through switching transistors Q1. This arrangement allows current flow to lamp 32 to be limited to the available charge on capacitor C1 during any particular negative portion of the alternating current cycle.

Resistors R1 are provided between the emitters of transistors Q1 and conductor 52 to provide an appropriate potential drop between the emitters of Q1 and conductor 52. Diodes D3 and D4 are provided in series between the bases of transistors Q1 and conductor 52 in order to protect against excessive emitter to base biasing voltage and allow flow of current from conductor E to conductor F as generated by switching control circuit 65.

The negatively charged side of negative capacitor C2 is connected to lamp 32 through a second electrical switching means such as switching transistors Q2 connected in parallel. Switching transistors Q2 are placed in a closed or conductive mode by applying a positive emitter to base bias voltage. Base voltage for switching transistors Q2 is provided by connecting to conductor G of FIG. 3.

Switching transistors Q2 are only biased into a closed mode during positive portions of the alternating current power supply so that there is no direct application of line current to switching transistors Q2. This arrangement allows current flow to lamp 32 to be limited to the available negative charge on capacitor C2 during any particular positive portion of the alternating current cycle because of the blocking action of diode D2 to positive current flow. Additional starting voltage is, however, provided by starting circuit 31 as will be explained below.

Resistors R2 are provided between the emitters of transistors Q2 and conductor 60 in order to provide an appropriate potential drop therebetween. Negative charge from capacitor C2 passes through blocking diodes D5 and D6 which are used in the starting subcircuit explained below. Diodes D7 and D8 are provided in series between the base of transistors Q2 and conductor 60 to prevent excessive biasing voltage and to allow current flow in switching control circuit 66 of FIG. 3.

An induction coil or choke L1 is advantageously provided between conductor 52 and lamp 32 to help regulate current flow through the lamp and filter voltage spikes in the power provided from switching transistors Q1 and Q2, since switching of transistors Q1 and Q2 causes voltage spikes to occur.

FIG. 3 shows a preferred switching control circuit 64 for providing control signals which control the asynchronous operation of switching means Q1 and Q2. Switching control circuit 64 can be any one of a variety of appropriate circuits for detecting the phase of the alternating current power supply and providing appropriate biasing potentials to switching means Q1 and Q2 such as at terminals E, F, G and H, respectively.

Switching control circuit 64 is advantageously divided into a first or positive switching control subcircuit 65 and a second or negative switching control subcircuit 66. Positive switching control subcircuit 65 provides voltage across terminals E and F which biases switching transistors Q1 into a conductive mode during negative portions of the alternating current. When switching means Q1 are in the conductive mode, positively charged capacitor C1 discharges therethrough and the discharging current is conducted through resistors R1, conductor 52 and choke L1 to power lamp 32.

Positive switching control circuit 65 also effectively reverse biases positive switching means Q1 during positive portions of the alternating current from 34, thereby placing switching means Q1 into a nonconductive mode when line voltage is positive and capacitor C1 is being positively charged. The nonconductive mode of Q1 prevents excessive current from flowing to lamp 32 which would otherwise occur by direct connection of line to lamp 32.

Negative switching control 66 functions similar to positive switching control 65 but in a complementary asynchronous manner. Switching control 66 provides voltage across terminals G and H which biases switching transistors Q2 into a conductive mode during positive portions of the alternating current. When switching means Q2 are in the conductive mode, negatively charged capacitor C2 discharges through diodes D5 and D6, resistors R2, switching transistors Q2, and choke L1 to power lamp 32.

Negative switching control 66 also effectively reverse biases negative switching means Q2 during negative portions of the alternating current supply by source 34, thereby placing switching means Q2 into a nonconductive mode when line voltage is negative and capacitor C2 is being negatively charged. The nonconductive mode of Q2 prevents excessive current from flowing to lamp 32 which would otherwise occur by direct connection of line to lamp 32.

FIG. 3 shows one specific form of circuit which can be used as positive switching control 65. Such circuit includes an inductive coil L3 which senses the phase of the incoming line voltage through transformer core 69. Transformer core 69 is shared with coil L5 which is connected across the incoming line voltage. The induced voltage in coil L3 swings positive and negative depending on line voltage from current source 34.

The first side L3*a* of coil L3 is connected to the first plate of capacitor C5, the anode of blocking diode D11, and to the emitter of transistor Q3. The opposite or second side L3*a* of coil L3 is connected to a resistor R5 and the anode of blocking diode D9. Resistor R5 is also connected to the anode of diode D11 and the base of transistor Q3. The cathode of diode D9 is connected to the second plate of capacitor C5 and to resistor R3. The opposite side of resistor R3 is connected to terminal or conductor E which is further connected to the bases of switching transistors Q1. The collector of transistor Q3 is connected to F and conductor 52 of FIG. 2. A resistor R4 is connected between the collector of Q3 and conductor E.

During positive portions of the a-c line voltage, the voltage induced across coil L3 creates a positive voltage at terminal L3*a* and a negative voltage at terminal L3*b*. The positive voltage at L3*a* is supplied to the emitter of transistor Q3 and the first plate of capacitor C5. Positive current flows through diode D11, resistor R5 and to negative terminal L3*b* to reverse bias transistor Q3 into a nonconductive mode. Resistor R4 causes the potential across conductors E and F to be equal when transistor Q3 is off, thus effectively biasing switching transistors Q1 into a nonconductive mode so that positive capacitor C1 is charged and direct line current is not applied to lamp 32.

When the alternating current goes into a negative portion of the a-c cycle then L3*b* is relatively positive with respect to L3*a*. The greater voltage thereat flows through resistor R5 to forwardly bias transistor Q3 into a conductive mode. Positive current from the L3*b* side of coil L3 also flows through diode D9, resistor R3 and forwardly biases switching transistors Q1 into the conductive mode thereby discharging capacitor C1 therethrough to lamp 32. Current supplied through resistor R3 is passed through diodes D3 and D4 and back through transistor Q3 to the L3*a* side of coil L3.

FIG. 3 also shows one specific form of circuit which can be used as negative switching control 66. Such circuit is conceptually similar to switching control 65. Switching control 66 includes an inductive coil L4 also on core 69 and having a first side L4*a* and second side L4*b*.

The first side of coil L4 is connected to resistor R6 and the anode of blocking diode D10. The second side L4*b* is connected to one side of capacitor C6, the anode of blocking diode D12 and the emitter of transistor Q4. The opposite side of capacitor C6 is connected to the cathode of diode D10 and to one side of resistor R7. The opposite side of resistor R7 is connected to conductor G and the bases of switching transistors Q2. Resistor R6 is also connected to the cathode of blocking diode D12 and to the base of transistor Q4. The collector of transistor Q4 is connected to conductor H and to conductor 60 of FIG. 2. A resistor R8 is connected between conductors G and H.

During positive portions of the a-c line voltage, the voltage induced across coil L4 creates a positive voltage at L4*a* and a negative voltage at L4*b*. The relatively positive voltage at L4*a* passes through resistor R6 and forwardly biases transistor Q4 into a conductive mode. Positive current also flows from side L4*a* through diode D10, resistor R7 to forwardly bias switching transistors Q2, allowing discharge of capacitor C2 through lamp 32. Current through resistor R7 passes through diodes D7 and D8 and back through transistor Q4 to side L4*b* of coil L4.

During negative portions of line a-c the first side L4*a* is negative relative to side L4*b*. Negative current flows from L4*a* and increases potential through resistor R6 and diode D12 to reverse bias transistor Q4 into a nonconductive mode. Resistor R8 causes terminals G and H to achieve an approximately equal voltage which effectively biases switching means Q2 into a nonconductive mode thus preventing the negative line voltage from being directly connected to lamp 32, and also allowing capacitor C2 to be negatively charged.

From the above discussion it is apparent that switching control circuit 64 controls switching means Q1 and Q2 so that capacitors C1 and C2 are alternately charged and discharged through Q1 and Q2 so that current flow to lamp 32 is limited by the capacitance of capacitors C1 and C2. This prevents excessive current flow through lamp 32 after startup when the resistance across the lamp has been reduced by the greater concentration of ions within lamp 32. At startup the resistance across lamp 32 is relatively higher thus requiring a relatively higher voltage to achieve ionization of the particular gas used in lamp 32. However, this voltage increase is not needed when optimal efficiency is desired during normal operation. Accordingly, it is desirable to include a suitable starting circuit to temporarily boost the voltage applied to lamp 32.

FIG. 2 shows a starting circuit 31 useful as part of circuit 100 to power 120 volt metal halide lamps. Starting circuit 31 includes a triac or other suitable bidirectional switching device T1. Triac T1 has its main terminal one connected to the unrectified incoming line current coming from fusible surge resistor FR1. The gate of triac T1 is connected to a connector D which communicates a triac gating signal from the general control circuit 90 shown in FIG. 4 and hereinafter described. The main terminal two of triac T1 is connected to a first side of a capacitor C3. The opposite second side of capacitor C3 is connected to node 80 between the anode of blocking diode D5 and the cathode of blocking diode D6. The cathode of diode D5 is connected at node 81 to the anode of diode D2, a first side of negative capacitor C2, and a first side of capacitor C4. The opposite second side of capacitor C4 is connected to the anode of diode D6, and to conductor 60 which is connected through resistors R2 to negative switching means Q2.

Starting circuit 31 operates in ballast and starting circuit 100 in the following manner. Soon after initiating current to circuit 100 the generalized control circuit 90 of FIG. 4 provides a gating control signal at conductor D which activates triac T1 and allows current to flow therethrough. A positive portion of the line a-c flows through triac T1 and positively charges the first side of capacitor C3. The following negative portion of the alternating current causes the first side of capacitor C2 to be negatively charged and forces the previous voltage differential across capacitor C3, thereby lowering the potential at node 80 below peak negative line voltage. Blocking diode D6 allows the negative voltage at node 80 to be conducted to one side of capacitor C4. Capacitor C4 holds the increased negative voltage until the next positive cycle. The following positive portion of the alternating current causes negative switching transistors Q2 to close thus discharging the increased negative charge on capacitor C4 through to lamp 32. The simultaneous positive charging of the first side of capacitor C3 further induces additional negative charge from the second side of capacitor C2. Repeated cycling of starting circuit 31 may be needed to achieve a voltage value sufficient to start lamp 32, such as approximately three times line voltage or 510 volts peak. The negative charge on capacitor C2 also discharges through diodes D5 and D6 and transistors Q2 to lamp 32. Starting circuit 31 boosts the negative voltage supplied through switching transistors Q2 until the gating control signal from D is terminated.

The starting control and diagnostic circuit 90 shown in FIG. 4 will now be described. Starting control and diagnostic circuit 90 is used to generate an appropriate gating control signal at D in order to operate starting circuit 31 during an appropriate startup period, such as, for instance, 30 seconds to several minutes. During this startup period, the particular discharge lamp type being used achieves a sufficiently stable operation to continue without the boosted voltage provided by starting circuit 31 or an equivalent thereof. Starting control and diagnostic circuit 90 also provides diagnostic information on run and startup indicators explained below.

Starting control circuit 90 advantageously includes an induction coil L7 which shares core 69 with coil L5 thus providing circuit 90 with a supply of power at appropriate voltage and current values. Coil L7 as used with ballast 11 advantageously provides 6–8 volts and current of approximately ½ ampere. The first side of coil L7 is connected to node 91 and the second side to node 92. Node 92 is connected to conductor or terminal C which is connected to the output of surge resistor FR1.

The first side of coil L7 is connected to the anode of blocking diode D13 and to the cathode of blocking diode D14. Diodes D13 and D14 effectively divide the output of coil L7 into positive and negative components, respectively. Capacitor C7 is connected with a first side to the cathode of diode D13 and the second side to conductor 93 which is directly connected to node 92 and conductor C. Capacitor C8 is connected with a first side to the anode of diode D14 and a second side connected to conductor 93. Capacitors C7 and C8 smooth the respective positive and negative half wave currents passed by diodes D13 and D14. The resulting approximately positive and negative direct currents supplied by conductors 94 and 95 are used to power remaining components as described below.

Starting control and diagnostic circuit 90 includes a series of resistors R9–R12 connected between the positive power supplied by conductor 94 and the control ground potential existing on conductor 93. Each intermediate node 96–98 is accordingly at a decreasing voltage. Zener diode D15 is connected between node 96 and conductor 93 in order to accurately fix a reference voltage for nodes 96–98.

Operational amplifier A1 is used to compare the voltage on conductor 99 to the voltage at node 98. If the voltage on conductor 99 exceeds the voltage at node 98 then there is a substantial positive current output from Al. If the voltage on conductor 99 is less than the voltage at node 98 then there is substantial negative current output from Al.

The signal on conductor 99 originates at conductor A which is the incoming line voltage before surge resistor FR1. Conductor A is connected to resistor R22 to provide surge protection. The output from resistor R22 is connected to the anode of blocking diode D17. The cathode of diode D17 is connected to conductor 99. Capacitor C9 is connected between conductor 99 and conductor 93 to smooth the positive portion of line voltage which passes through diode D17. A relatively high resistance resistor R13 is also connected between conductors 99 and 93 to allow capacitor C9 to slowly discharge therethrough. During brief power interruptions, such as less than 1 second in duration, capacitor C9 keeps the signal in conductor 99 sufficiently high to maintain continued operation. Blocking diode D16 assures that excessive positive voltages are not developed on conductor 99 by passing such through zener diode D15 to conductor 93.

The output from comparative operational amplifier A1 is connected to the anode of blocking diode D20 and to one side of resistor R15. The other side of resistor R15 is connected to the cathode of blocking diode D18. The anode of diode D18 is connected to node 101. The cathode of blocking diode D20 is connected in series with resistor R14 and light emitting diode LED 1 to connector 93. A positive output from A1 thus passes through D20, R14 and lights LED 1 to indicate that power is being used by lamp 32 as will be explained more fully below.

Starting control and diagnostic circuit 90 also includes a second comparative operational amplifier A2. One input to A2 is connected to an appropriate reference voltage developed at node 97. The other input to A2 is connected to node 101 which is typically provided with a positive voltage from conductor 94 through a high resistance value resistor R16. Node 101 is also connected to one side of a capacitor C10. The other side of capacitor C10 is connected to conductor 93.

Amplifier A2 controllably provides an output signal along conductor 102 which is connected to the anode of blocking diode D19 allowing positive output to pass therethrough to node 103. Node 103 is connected in series to resistor R19, light emitting diode LED 2, and conductor 93. Node 103 is also connected to one side of resistor R18, the other side of which is connected to the base of a switching device such as transistor Q5. A resistor R20 is connected between the base of Q5 and conductor 93.

The collector of transistor Q5 is connected to conductor 94 through resistor R17. The emitter of transistor Q5 is connected to conductor D which carries the starting circuit control signal to starting circuit 31. The emitter of transistor Q5 is also connected to conductor 93 through resistor R21.

The operation of starting control and diagnostic circuit 90 will now be fully described. During the initial phases of startup, the amount of current flowing through resistor FR1 are small because lamp 32 has not fired, thus keeping the voltage drop thereacross small. The voltage supplied at C is thus very close to the voltage at A resulting in inputs to amplifier A1 which are approximately equal, or with node 98 somewhat lower. This produces no output from A1 and LED 1 is not initially illuminated, thus indicating that lamp 32 has not started.

Also upon initial startup, positive current flows through conductor 94, and resistor R16 to begin charging capacitor C10. The amount of charge developed on C10 does not increase at a substantial rate until the output from amplifier A1 becomes positive as a result of lamp ignition.

With firing of lamp 32 and the increased current flow therethrough, a substantial voltage drop occurs across surge resistor FR1 thus increasing the relative voltage at A as compared to C. The increased voltage at A increases the voltage in conductor 99 and causes the output of A1 to go positive thus lighting LED 1 which acts as an indicator light that lamp 32 is functioning. The positive output from A1 creates a potential at the cathode of blocking diode D18 which prevents leakage therethrough, and directs substantially all current passing through resistor R16 to charge capacitor C10.

Amplifier A2 receives a relatively fixed voltage input from node 97. Initially, the secondary input from node 101 is at a relatively lower potential since capacitor C10 is not yet charged due to the delay required to fire the lamp and the small current passed through resistor R16. Thus, during this initial startup period A2 produces a positive output signal to conductor 102. The positive, output signal passes through diode D19, resistor R19 and lights LED 2 which acts as a indicator light for the startup period. The output from A2 also biases transistor Q5 into a conductive mode and a startup control signal is sent to triac T1 via conductor D, thus creating the desired startup voltage for lamp 32 as explained above.

After an appropriate period of time, capacitor C10 becomes sufficiently charged so that the voltage at node 101 exceeds the voltage at node 97. This causes the output from amplifier A2 to go negative thus terminating the operation of LED 2 and zero biasing transistor Q5 thus stopping the startup control signal to triac T1. The voltage drop across surge resistor FR1 continues with substantial current flow through lamp 32 continuing the illumination of LED 1 to indicate lamp operation even though the startup period indicator LED 2 is no longer illuminated. The operational sequence described above for circuit 90 is repeated each time startup of lamp 32 is required.

The preferred circuit 100 according to this invention as described herein and illustrated in FIGS. 2–4 is advantageously constructed for use as a ballast with nominal 120 volt, 400 watt metal halide discharge lamps currently availbel in the U.S. The values of components listed below in TABLE I are believed most advantageous for such application, although there will be many alternative values and circuit modifications and equivalents which will be obvious to those skilled in the art.

TABLE I

| | |
|---|---|
| RESISTORS | |
| FR1 | 0.2 ohm |
| R1, R2 | 0.22 |
| R3 | 100 ohm |
| R4 | 100 ohm |
| R5 | 200 ohm |
| R6 | 220 ohm |
| R7 | 8.2 ohm |
| R8 | 100 ohm |
| R9 | 1K ohm |
| R10–R12 | 10K ohm |
| R13 | 10M ohm |
| R14 | 10M ohm |
| R15 | 820 ohm |
| R15 | 1K ohm |
| R16 | 30M ohm |
| R17 | 68 ohm |
| R18 | 1K ohm |
| R19 | 820 ohm |
| R20 | 10K ohm |
| R21 | 330 ohm |
| R22 | 10K ohm |
| CAPACITORS | |
| C1 | 330 microfarads |
| C2 | 330 microfarads |
| C3 | 30 microfarads |
| C4 | 10 microfarads |
| C5, C6 | 1000 microfarads |
| C7 | 470 microfarads |
| C8 | 100 microfarads |
| C9 | 0.1 microfarads |
| C10 | 0.47 microfarads |
| INDUCTORS | |
| L1 | 5 millihenries |

Figure 5:
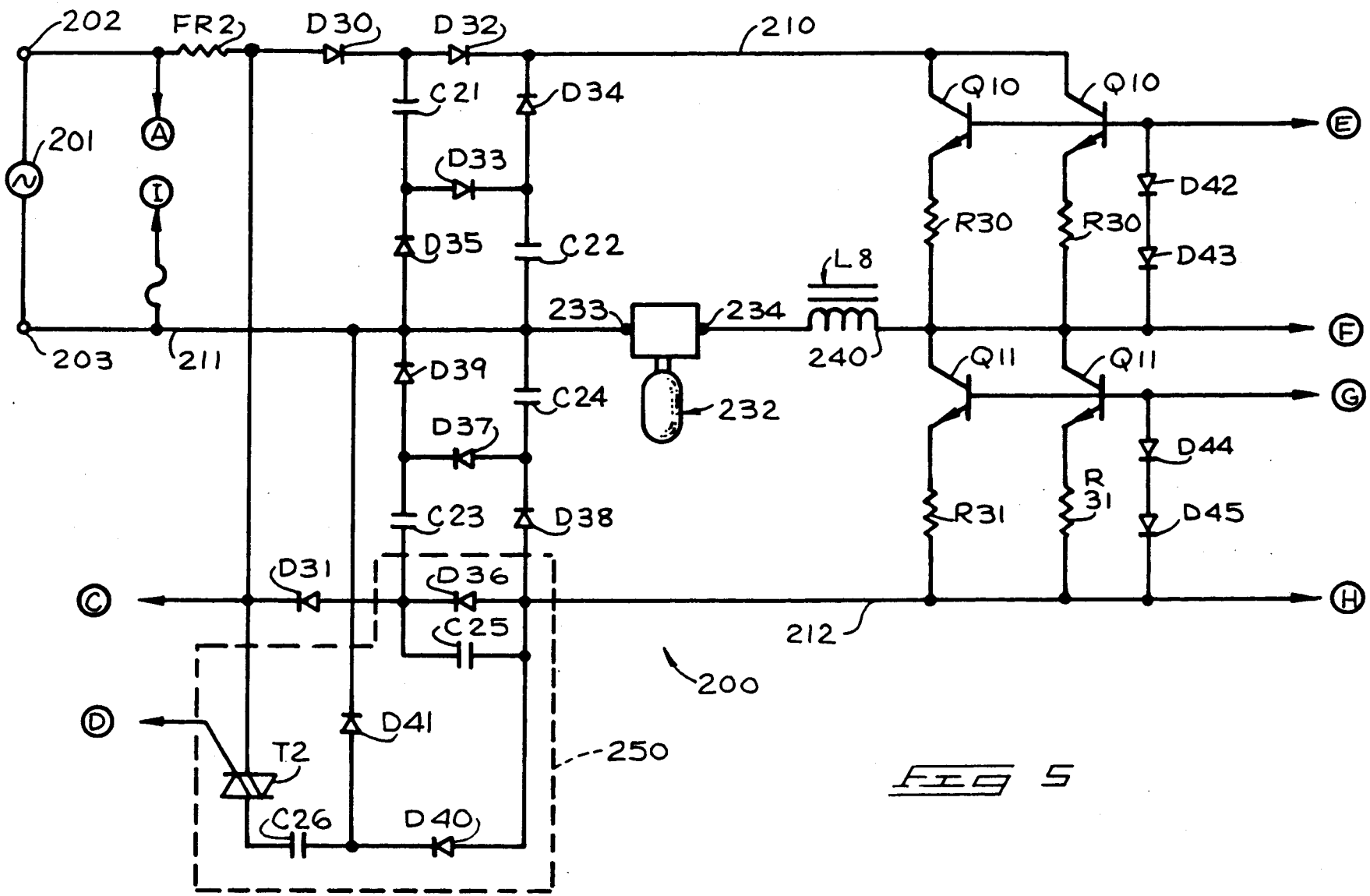
FIG. 5 is a schematic circuit diagram of an alternative embodiment to the portion shown in FIG. 2.

FIG. 5 shows an alternative circuit 200 which can be used in lieu of the circuit shown in FIG. 2 in conjunction with the circuitry shown in FIGS. 3 and 4 to produce a switched capacitive ballast which can be used with nominal 240 volt a-c power for 400 watt metal halide discharge lamps. The conductors or terminals lettered A, C, D, E, F, G, H, and I connect with the circuits of FIGS. 3 and 4 at the similarly designated points in a manner similar to the circuit shown in FIG. 2 and described above.

A source of alternating current 201 is connected across terminals 202 and 203. Typically the neutral or common side of current source 201 is connected to terminal 203 and the hot or voltage varying side is connected to terminal 202. A fusible surge resistor FR2 is placed in series between incoming line voltage and conductor C.

Circuit 200 includes a first or positive rectifying means such as blocking diode D30 which is connected with the anode to surge resistor FR2. Blocking diode D30 passes only the positive portions of the incoming alternating current therethrough. Circuit 200 is also provided with a second or negative rectifier such as blocking diode D31. Diode D31 is oppositely oriented with its cathode connected to incoming current from source 201 so that only negative portions thereof are passed therethrough.

Circuit 200 includes positive charge storage means such as capacitors C21 and C22. Capacitor C21 has a first side connected to the output or cathode of diode D30 to receive positive current therefrom. The cathode of diode D30 and the first side of capacitor C21 are also connected to the anode of blocking diode D32. The cathode of diode D32 is connected to conductor 210. The second side of capacitor C21 is connected to the anode of blocking diode D33 and to the cathode of blocking diode D35. The anode of diode D35 is connected to conductor 211 which connects to terminal 203. The cathode of diode D33 is connected to a first side of capacitor C22 and to the anode of blocking diode D34. The cathode of diode 34 is connected to conductor 210. The second side of capacitor C22 is connected to conductor 211. Conductor 211 is also connected to a second side or electrode of discharge lamp 232 at second terminal 233.

This arrangement of diodes D32–D35 and capacitors C21 and C22 allows capacitors C21 and C22 to be charged in series and discharged in parallel. During charging, incoming positive portions of the supply current from source 201 pass through diode D30 to the first side of capacitor C21. Positive charge is also conveyed through diode D33 to charge the first side of capacitor C22 in series with C21. The voltages across capacitors C21 and C22 are shared according to well known electrical principals.

During discharge of capacitors C21 and C22, the preferably equally shared voltage is concurrently directed onto line 210 in parallel. Capacitor C21 discharges through diode D32 and capacitor C22 discharges through diode D34. Diode D33 isolates the first side of C22 from the second side of C21 during discharge. This arrangement for the positive charge storage means is advantageous where lamp 232 does not require operating voltages which would otherwise be achieved by direct connection of a single capacitor between line 210 and line 211, similar to the circuit of FIG. 2.

Circuit 200 also includes a negative charge storage means such as capacitors C23 and C24. The first side of capacitor C23 is connected to the output or anode of rectifying diode D31. The opposite or second side of capacitor C23 is connected to the anode of blocking diode D39 and to the cathode of blocking diode D37. The cathode of diode D39 is connected to conductor 211. The anode of diode D31 is connected to the cathode of diode D36. The anode of diode D36 is connected to conductor 212 and to the anode of blocking diode D38. The cathode of diode D38 is connected to the anode of diode D37 and to the first side of capacitor C24. The second side of capacitor C24 is connected to conductor 211. This arrangement of capacitors C23 and C24 and diodes D36–D39 also allows capacitors C23 and C24 to be charged in series and discharged in parallel. Description of the similar operation of capacitors C21 and C22 is given above and will not be repeated for C23 and C24.

Positive conductor 210 is connected to a positive switching means such as switching transistors Q10 which are in parallel with collectors of each connected to conductor 210. The bases of switching transistors Q10 are also connected in parallel to conductor E which is connected to positive switching control circuit 65 of FIG. 3 which provides a switching control signal as described above.

The emitters of switching means Q10 are connected through parallel resistors R30 to conductor F. Conductor F is connected to positive switching control circuit 65 as described above with respect to FIG. 3. Conductor F is also connected to an inductive coil or choke 240 which smooths the power supplied therethrough to first terminal or electrode 234 of discharge lamp 232. Blocking diodes D42 and D43 are connected in series between the parallel bases of switching transistors Q10 and conductor F to allow biasing control current to flow therethrough.

Negative conductor 212 is similarly connected to a negative switching means such as switching transistors Q11. The emitters of switching transistors Q11 are connected in parallel through parallel resistors R31 to line 212. The bases of switching transistors Q11 are connected in parallel to conductor G which is connected to the negative switching control circuit 66 as shown in FIG. 3 and described above. Conductor 212 is directly connected to conductor H which is also connected to the negative switching control circuit 66 of FIG. 3. The collectors of switching transistors Q11 are connected in parallel via conductor F to choke 240 and lamp 232.

FIG. 5 further shows a starting circuit 250 which is used to increase the starting voltage applied across discharge lamp 232 during negative portions of the alternating current supplied by current source 201. Starting circuit 250 includes a triac T2 or similar electronic switching means. The main one terminal of triac T2 is connected to conductor C. The main two terminal of triac T2 is connected to a first side of capacitor C26. The gate terminal of triac T2 is connected to conductor D which provides a gating control signal such as described above and illustrated at FIG. 4.

The second side of capacitor C26 is connected to the cathode of blocking diode D40 and to the anode of blocking diode D41. The cathode of diode D41 is connected to conductor 211. The anode of diode D40 is connected to conductor 212. A capacitor C25 is connected in parallel with blocking diode D36 described above.

The operation of starting circuit 250 will be described in conjunction with the operation of remaining components of ballast circuit 200. Operation of circuit 200 is initiated by starting alternating current source 201 or by closing an appropriate switch (not shown). Initial starting of starting and control circuit 90 of FIG. 4 causes a gating control signal to be carried by conductor D to triac T2 thus placing the triac in a conductive mode. A negative portion of the alternating input current cause capacitors C23 and C24 to be charged in series. As the line current swings positive capacitor C26 is charged with its first side positive and second side at common or ground potential because of connection to conductor 211 through blocking diode D41. As the input current swings negative again the voltage differential across capacitor C26 is increased because the first side of the capacitor must respond to the applied line voltage and the previous charge is not quickly dissipated. This effectively adds the voltage swing to the previous capacitor voltage differential. In the nominal 240 volt circuit described in FIG. 5 the voltage across C26 is changed from −340 volts to approximately −680 volts. This increased negative potential at the second side of capacitor C26 causes negative current to flow through blocking diode D40 to charge the second side of capacitor C25 to approximately −680 volts with respect to ground, in series with capacitors C23 and C24. The following positive cycle changes the potential on the first side of capacitor C23 from −340 volts to −170 volts with respect to ground. Capacitors C23 and C25 then discharge in series through transistors Q11 to lamp 232 providing approximately −510 volts. Several cycles of a-c current may be needed to bring the second side of capacitor C25 up to the −510 volts output desired. The specific voltage needed is dictated by the lamp being used. For a 400 watt metal halide lamp of common use in the United States, it is necessary to apply approximately 500 volts in order to arc the lamp for startup. Repeated arcing is necessary in most cases. Accordingly, capacitor C25 is charged to about or somewhat more negative potential than −500 volts at its second side and then is discharged during positive portions when switching transistors Q11 are conductive. This boosted startup voltage on the negative side of circuit 200 allows lamp 232 to be started.

Upon startup the gas or gases contained in a discharge lamp become ionized and the resistance across the lamp decreases and increased current begins to flow therethrough. The general control circuit 90 senses the increased current flow via the substantial voltage drop across surge resistor FR2. This causes the output from operational amplifier A1 to go high and light LED 1, which indicates that the discharge lamp is drawing current. The outputs from amplifier A1 causes the startup period defined by resistor R16 and capacitor C10 to begin. When capacitor C10 is sufficently charged the output of amplifier A2 goes low and the gating control signal from the emitter of transistor Q5 onto conductor D also goes low thus placing triac T2 into a nonconductive mode, thus ending the startup period.

During and after the startup period, the positive capacitors C21 and C22 are charged in series during positive portions of the incoming alternating current. Capacitors C21 and C22 are discharged in parallel during negative portions of the alternating current. Capacitors C21 and C22 are charged in series and discharged in parallel because the voltage needed to properly operate discharge lamp 232 only requires less than ±170 volts after ionization has occurred. Thus the peak line voltage of 340 volts is not needed and is reduced using the series-parallel charging and discharging of capacitors C21 and C22.

Similarly, capacitors C23 and C24 are charged negatively in series during negative portions of the alternating current. Capacitors C23 and C24 are discharged in parallel during positive portions of the alternating current when switching transistors Q11 are biased into a conductive mode.

The alternating asynchronous operation of the positive and negative sides of circuit 200 allows current flow through lamp 232 to be limited to the charge which can be effectively discharged from positive capacitors C21 and C22 during negative portions, and negative capacitors C23 and C24 during positive portions of the power from alternating current supply 201.

The switching control circuits 64 described herein and shown in FIG. 3 are also used to control switching transistors Q10 and Q11 in a manner the same as described for switching transistors Q1 and Q2, above, and will not be repeated here for circuit 200 since the operation is the same. Similarly the general control circuit 90 is also connected to circuit 200 as indicated in the FIGS. in an analogous way to its use with the circuit of FIG.

2. Operation is equivalent to the description given with respect thereto.

Table II shown below gives preferred values of capacitance, inductance and resistance which may be used for the components shown in circuit 200 of FIG. 5.

TABLE II

| | |
|---|---|
| RESISTORS | |
| FR2 | 0.4 ohm |
| R30 and R31 | 0.22 ohm |
| CAPACITORS | |
| C21–C24 | 165 microfarads |
| C25 | 10 microfarads |
| C26 | 30 microfarads |
| INDUCTORS | |
| L8 | 5 millihenries |

Figure 6:
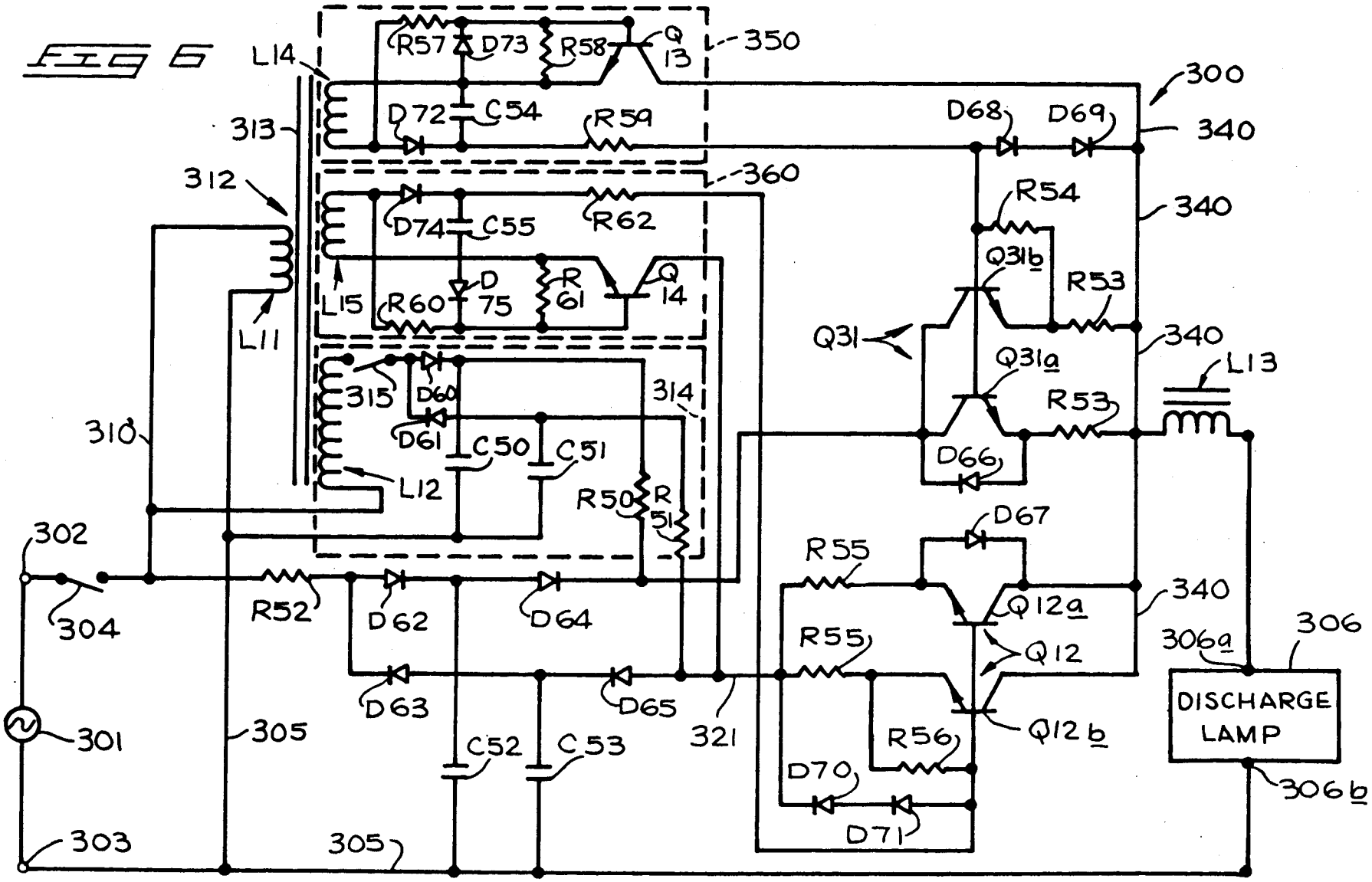
FIG. 6 is a schematic circuit diagram of an alternative ballast and starting circuit according to this invention.

FIG. 6 shows a further embodiment capacitive ballast circuit 300 according to this invention. Circuit 300 includes a source of alternating current 301 connected across terminals 302 and 303. A power on-off switch 304 can advantageously be provided to allow controlled supply of current to remaining portions of circuit 300. Circuit 300 is designed for use with a 120 volt rms single phase power supply with terminal 303 being common and terminal 302 experiencing the alternating voltage. Terminal 303 is connected to a conductor 305 which is connected to a number of components described below including one side 306*b* of an electrical discharge lamp 306. The opposite side 306*a* of lamp 306 is connected to remaining portions of circuit 300 which are used to startup and control current flow through lamp 306.

The output side of switch 304 is connected to conductor 310 which and is connected to first sides of induction coils L11 and L12 which preferably form part of a transformer 312 having a core 313, or equivalents thereto. The second side of coil L11 is connected to common via conductor 305.

Coil L12 is part of a starting circuit 314. Coil L12 has a greater number of coils thereon than L11 to provide an increased voltage thereacross such as in the range of approximately ±500 volts peak, from the ±170 volts peak alternating current supplied by source 301. The second side of coil L12 is advantageously connected to a manual starting switch 315 which can be manually closed to provide increased starting voltage to both positive and negative sides of ballast circuit 300 as further explained below.

Switch 315 is connected to the anode of blocking diode D60 and to the cathode of blocking diode D61. The cathode of diode D60 is connected in parallel to a first side of a capacitor C50 and to a first side of resistor R50. The anode of diode D61 is connected in parallel to a first side of capacitor C51 and to a first side of resistor R51. The second side of resistor R50 is connected to conductor 320 and the second side of resistor R51 is connected to conductor 321. The second sides of capacitors C50 and C51 are connected to conductor 305.

Circuit 300 further includes a means for dividing incoming line current into positive and negative components corresponding to positive and negative currents flowing during positive and negative portions of the alternating current, respectively. Such means for dividing the alternating current includes blocking diodes D62 and D63. The anode of diode D62 and cathode of diode D63 are connected to conductor 310 through a surge resistor R52. The cathode of diode D62 is connected to a first side of positive capacitor C52. The second or opposite side of capacitor C52 is connected to common using conductor 305. Diode D62 allows positive current to flow therethrough to positively charge capacitor C52. The anode of diode D63 is connected to the first side of negative capacitor C53. The second or opposite side of capacitor C53 is connected to common using conductor 305. Diode D63 allows negative current to flow from conductor 510 therethrough to negatively charge capacitor C53.

The cathode of blocking diode D62 and the first side of capacitor C52 are connected to the anode of a further blocking diode D64. The cathode of diode D64 is connected to conductor 320. Diode D64 prevents flow of charge from starting capacitor C50 to positive capacitor C52.

The anode of blocking diode D63 and the first side of capacitor C53 are connected to the cathode of blocking diode D65. The anode of diode D65 is connected to conductor 321. Diode D65 prevents flow of charge from starting capacitor C51 to negative capacitor C53.

The output from the cathode of diode D64 is connected by conductor 320 to an appropriate positive switching device, such as switching transistors Q31 which are connected in parallel. Conductor 320 is connected to the collectors of transistors Q31. The emitters of switching transistors Q31 are connected to the first sides of parallel resistors R53. The opposite sides of resistors R53 are connected to conductor 340. A blocking diode D66 is connected in parallel across the collector and emitter of switching transistor Q31*a* with the cathode of diode D66 connected to the collector. A resistor R54 is connected in parallel between the bases of transistors Q31 and the emitter of transistor Q31*b*. Blocking diodes D68 and D69 are connected in series between the base of transistors Q31 and conductor 340 with the cathodes oriented toward conductor 340. The bases of positive switching transistors Q31 are connected in parallel to a positive switching control subcircuit 350, which will be described more fully below. The emitters of switching transistors Q31 are also connected to subcircuit 350 through resistors R53 and conductor 340.

The output from the anode of blocking diode D65 is connected by conductor 321 to an appropriate negative switching device, such as switching transistors Q12. Transistors Q12 are connected in parallel to conductor 321 via parallel resistors R55 connected to the emitters of transistors Q12. The collectors of transistors Q12 are connected to conductor 340. A blocking diode D67 is connected in parallel across the emitter and collector of switching transistor Q12*a* with the anode connected to the emitter and the cathode connected to the collector. A resistor R56 is connected between the emitter and base of transistor Q12*b*. Blocking diodes D70 and D71 are connected in series from the base of transistors Q12 to conductor 321 with the cathodes oriented toward conductor 321. The bases of switching transistors Q12 are connected to a negative switching control subcircuit 360 which will be described more fully below. The emitter of switching transistors Q12 are also connected to subcircuit 360 through resistors R55.

The current outputs from switching means Q31 and Q12 are conducted by conductor 340 through an inductive choke L13 to discharge lamp 306.

Switching control circuits 350 and 360 are conceptually and structurally similar. Each is designed to properly sense the phase of the incoming current supplied by source 301. During positive portions of the a-c current the positive switching control circuit 350 reverse biases positive switching means Q31 into a nonconductive mode. During negative portions of the incoming current circuit 350 forwardly biases switching means Q31 into a conductive mode. Negative switching control circuit 360 operates asynchronously to circuit 350 controlling negative switching means Q12 into a conductive mode during positive portions and into a nonconductive mode during negative portions. Having briefly outlined the overall function of control circuits 350 and 360, the structures thereof will now be described in detail.

Positive switching control circuit 350 includes an inductive coil L14 which can advantageously be on the secondary side of transformer core 313. Coil L14 develops appropriate control circuit potential and alternating current such as, for example, 6 volts and ½ amp, respectively. The first side of coil L14 is connected to the emitter of an appropriate switching device such as transistor Q13. The collector of transistor Q13 is connected to conductor 340. Transistor Q13 is the primary element in circuit 350 serving to switch coil L14 to positive switching transistors Q31 and provide a forward bias thereon during negative portions of the alternating current.

The second side of coil L14 is connected to the anode of blocking diode D72 and to a first end of resistor R57. The cathode of diode D72 is connected to one side of capacitor C54 and to resistor R59. Resistor R59 is also connected to the bases of positive switching transistors Q31, and to the anode of blocking diode D68. The cathode of diode D68 is connected to the anode of blocking diode D69. The cathode of diode D69 is connected to conductor 340.

Circuit 350 is further constructed by connecting the second end of resistor R57 to the cathode of blocking diode D73, the base of transistor Q13, and one end of resistor R58. The anode of diode D73 is connected to the emitter of transistor Q13 and to the opposite end of resistor R58. The second side of capacitor C54 is also connected to the emitter of transistor Q13.

Negative switching control circuit 360 includes an inductive coil L15 which is also advantageously on the secondary side of transformer core 313. Coil L15 develops potential and current similar to L14. The first side of coil L15 is connected to the anode of blocking diode D74 and the second side of coil L15 is connected to the emitter of transistor Q14. The collector of transistor Q14 is connected to the emitters of negative switching transistors Q12 via conductor 321 and resistors R55. The cathode of diode D74 is connected to a first side of capacitor C55 and to a first end of resistor R62. The opposite end of resistor R62 is connected to the bases of negative switching transistors Q12 and to the two series blocking diodes D70 and D71 oriented with the anodes toward resistor R62. The cathode of blocking diode D70 is connected to conductor 321. The second side of capacitor C55 is connected to the anode of blocking diode D75, the emitter of transistor A14, and the second side of coil L15. The cathode of diode D75 is connected to the base of control transistor Q14. The base of transistor Q14 is also connected to resistors R61 and R60. The opposite end of resister R61 is connected to the emitter of Q14 and the opposite end of resistor R60 is connected to the first side of coil L15.

Circuit 350 operates in the following manner. Coil L14 generates an appropriate alternating voltage thereacross in response to the induced magnetic flux in core 313. Transistor Q13 is reverse biased during positive portions of the line a-c in the following manner. During positive portions the first side of coil L14 (connected to the emitter of Q13) is positive relative to the second side of coil L14. The lower potential of the second side is connected through resistors R57 and diode D73 to the high side of coil L14. The base of transistor Q13 is at the potential established between resistor R57 and diode D73, which must be at a potential less than the emitter voltage because of the voltage drop across each. Transistor Q13 is thus biased into the nonconductive mode. Meanwhile diode D72 prevents current from flowing therethrough because of the relatively low potential at the anode thereof. The bias voltage of transistors Q31 is equalized by the connection thereacross by resistor R54, thus effectively zero biasing them into a nonconductive mode.

During negative portions of the line a-c the second side of coil L14 is relatively high compared to the first side of L14. This causes positive current to flow through resistors R57 and R58 to the low side of coil L14. The potential at the emitter of transistor Q13 is low because of the direct connection to the first side of 214. The base voltage is higher because of the connection between the base and the node existing between resistors R57 and R58. Transistor Q13 is thus forwardly biased into a conductive mode. Current can accordingly flow from the high side of coil L14 through diode D72, resistor R59, diodes D68 and D69 and back through transistor Q13. This flow of current is smoothed by capacitor C54. The resulting potential at the bases of positive switching transistors Q31 is higher than at the emitters because of current flow through resistor R54, thus forwardly biasing transistors Q31 into a conductive mode.

Negative switching control circuit 360 operates substantially the same as circuit 350 except that the first side of coil L15 is connected to the blocking diode D74 and the second side of L15 to the emitter of transistor Q14. This is reverse of the arrangement in circuit 350 thereby causing negative switching control circuit 360 to forward bias switching transistors Q12 into a conductive mode during positive portions of the line a-c, and to zero bias transistors Q12 into a nonconductive mode during negative portions.

The operation of remaining portions of ballast and starting circuit 300 will now be considered in greater detail. During positive portions of line current switching transistors Q31 are biased into a nonconductive mode, and switching transistors Q12 are biased into a conductive mode as just described. During negative portions transistors Q31 are biased conductive and transistors Q12 are biased nonconductive. This asynchronous operation allows capacitor C52 to positively charge and capacitor C53 to discharge its negative charge through transistors Q12 during positive portions. Conversely during negative portions of line a-c capacitor C53 charges negatively and capacitor C52 discharges its positive charge through transistors Q31.

Positive capacitor C52 discharges during negative portions of line a-c during which terminal 303 is at a higher voltage than terminal 302. Nonetheless, positive charge exists on the first side of capacitor C52 because of blocking diode D62. Such is discharged through diode D64, switching transistors Q31, resistors R53, coil L13, discharge lamp 306 back to common terminal 303. Negative capacitor C53 discharges during positive portions during which terminal 302 is at a relatively higher voltage than common terminal 303. Nonetheless, the negative charge exists on the first side of capacitor C53 because of blocking diode D63. Such is discharged through diode D65, resistors R55, transistors Q12, coil L13, discharge lamp 306 back to common terminal 303.

Starting circuit 314 supplements the voltage supplied through transistors Q31 and Q12 to lamp 306. This is accomplished by charging capacitor C50 during positive portions to a relatively high starting voltage and then first discharging capacitor C50 through transistors Q31 during negative portions when transistors Q31 are in the conductive mode. Conversely, circuit 314 also supplements the negative charge and starting voltage by charging capacitor C51 during negative cycle portions to a relatively high starting voltage and then discharging capacitor C51 through transistors Q12 during positive portions when transistors Q12 are in a conductive mode. Starting circuit 314 is manually controlled by switch 315.

Table III presents preferred values of resistance, inductance and capacitance for resistors, inductors and capacitors useful in a preferred form of circuit 300.

TABLE III

| | |
|---|---|
| RESISTORS | |
| R50, R51 | 100 ohm |
| R52 | 0.5 ohm |
| R53, R55 | 0.15 ohm |
| R54, R56 | 100 ohm |
| R57, R60 | 47 ohm |
| R58, R61 | 22 kilohm |
| R59, R62 | 47 ohm |
| CAPACITORS | |
| C50, C51 | 10 microfarads |
| C52, C53 | 330 microfarads |
| C54, C55 | 1000 microfarads |
| INDUCTORS | |
| L13 | 5 millihenries |

Figure 7:
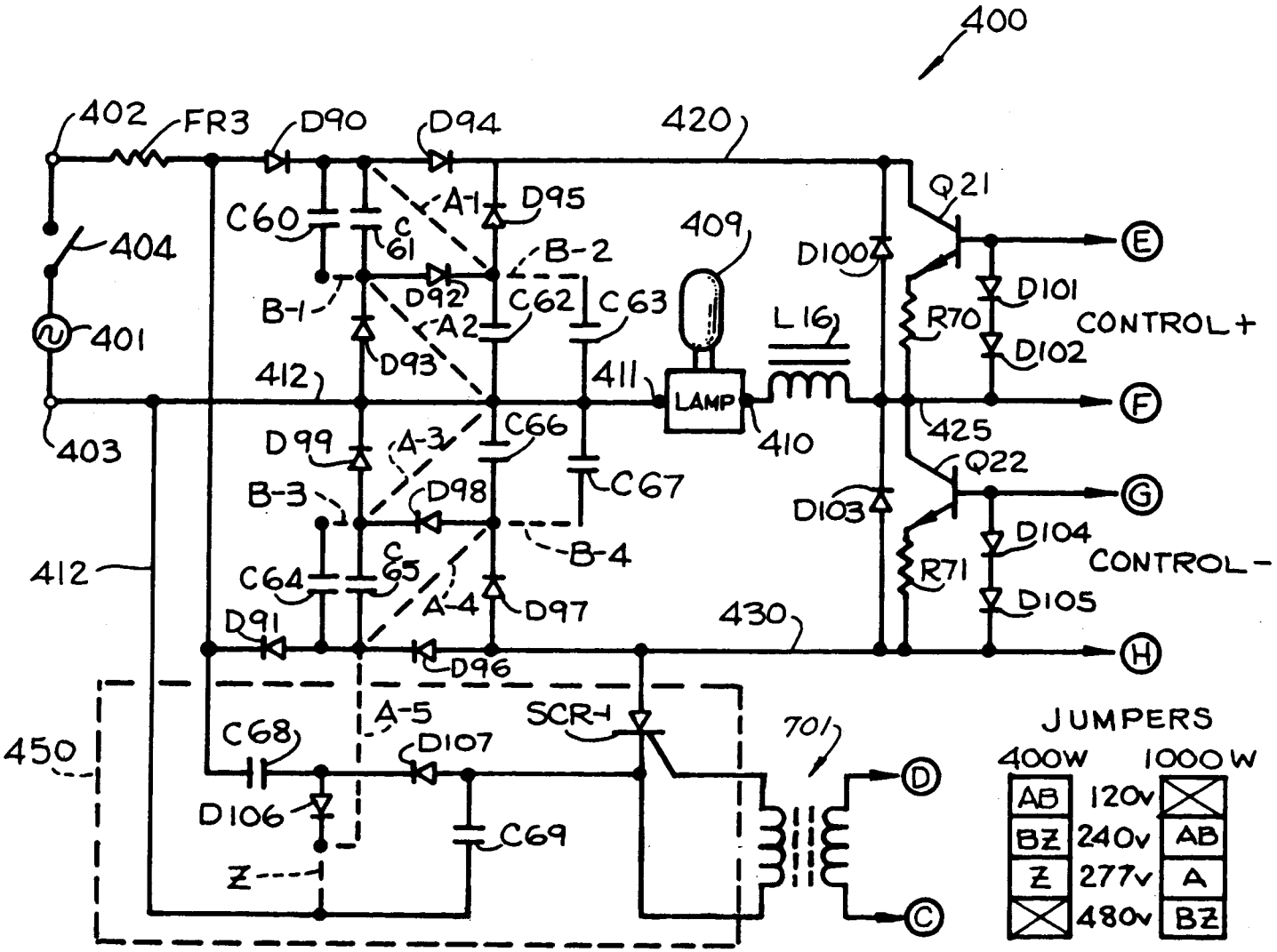
FIG. 7 is a schematic circuit diagram of a further embodiment of the invention.

A portion of a still further embodiment ballast and starting circuit 400 according to this invention is shown in FIG. 7. Current is supplied by current source 401 to terminals 402 and 403. On-off switch 404 is also advantageously provided to control current flow from source 401. Fusible surge resistor FR3 is connected at one end to terminal 402. The opposite end of surge resistor FR3 is connected to the anode of blocking diode D90 and to the cathode of blocking diode D91. Diodes D90 and D91 divide the alternating line current into positive and negative portions, respectively.

The cathode of diode D90 is connected to first sides of capacitors C60 and C61, and to the anode of blocking diode D94. The cathode of diode D90 is also connected by optional conductor A-1 to the cathode of blocking diode D92, to the anode of blocking diode D95, and to the first side of capacitor C62. Optional conductor or jumper A-1 and other jumpers are used as described below to convert circuit 400 for different voltages and wattages of metal halide discharge lamps 409. Optional conductors or jumpers labelled A, B, and Z will be hereinafter described for use with appropriate lamp types as also hereinafter described.

The second side of capacitor C61 is connected to the anode of blocking diode D92 and to the cathode of blocking diode D93. The second side of capacitor C60 is optionally connected by jumper B-1 to the second side of capacitor C61 when lamp 409 is of a type requiring B jumper connections. The second side of capacitor C61 is also optionally connected by jumper A-2 to the second side of capacitor C62 when lamp 409 is of a type requiring A jumpers. The second side of capacitor C62 and the anode of blocking diode D93 are both connected to conductor 412. A further capacitor C63 has a second side which is also connected to conductor 412. The first side of capacitor C63 is optionally connected by jumper B-2 to the first side of capacitor C62 and the anode of blocking diode D95. The cathodes of diodes D94 and D95 are both connected to conductor 420.

Capacitors C60–C63 serve to store positive charge passing through diode D90. Diodes D92–D95 route current for charging and discharging capacitors C60–C63, as will be more fully explained below in connection with operation of circuit 400. Conductor 420 conducts positive change from capacitors C60–C63 to an appropriate positive switching means such as positive switching transistor Q21.

The negative current flowing through diode D91 is supplied to an arrangement of blocking diodes D96–D99 and capacitors C64–C67, conceptually similar to the arrangement just described for the positive current output flowing from diode D90. The anode of diode D91 is connected to the first sides of capacitors C64 and C65, and to the cathode of blocking diode D96. The anode of diode D96 is connected to conductor 430. The second side of capacitor C65 is connected to the anode of blocking diode D99 and to the cathode of blocking diode D98. The second side of capacitor C64 is optionally connected by jumper B-3 to the second side of capacitor C65 to place it in parallel therewith when lamp 409 is of a type requiring B jumpers to be connected. The cathode of diode D99 is connected to conductor 412. The anode of diode D98 is connected to the cathode of diode D97 and to the first side of capacitor C66. The second side of capacitor C66 is connected to conductor 412. Capacitor C67 is connected with a second side to conductor 412. The anode of blocking diode D96 and the anode of diode D97 are connected to conductor 430.

Optional jumper A-3 is connected between the second side of capacitor C65 and conductor 412 when lamp 409 is of a type requiring A jumpers. Optional jumper A-4 is connected from the anode of diode D91 to the first side of capacitor C66 when lamp 409 requires A jumpers. Optional jumper B-3 is connected from the second side of capacitor C64 to the second side of capacitor C65 placing such capacitors in parallel when lamp 409 requires B jumpers to be connected. Optional jumper B-4 is connected between the first sides of capacitors C66 and C67 to place them in parallel also when B jumpers are required.

The assembly of capacitors C64–C67 and diodes D96–D99 allows negative current flowing through diode D91 to be stored in such capacitors, and be discharged therefrom through a negative switching means such as negative switching transistor Q22.

Positive switching transistor Q21 is connected in circuit 400 with its collector connected to conductor 420 and the emitter connected to a first end of resistor R70. The second end of resistor R70 is connected to conductor 425 which supplies current through induction coil or choke L16 to discharge lamp 409. The base of transistor Q21 is connected to the high or positive side of a positive switching control circuit such as 65 shown in FIG. 3 at conductor E. The positive switching control circuit 65 is also connected to conductor 425 by conductor F. The voltage differential developed by circuit 65 across E and F is used to appropriately bias transistor Q21 into a conductive mode during negative portions of incoming a-c, and into a nonconductive mode during positive portions of incoming a-c.

A blocking diode D100 is connected in parallel with switching transistor Q21 with the cathode connected to conductor 420 and the anode connected to conductor 425. Two blocking diodes in series D101 and D102 are connected between the base of Q21 and conductor F.

Negative switching transistor Q22 is connected in circuit 400 in a manner equivalent to that described in connection with positive switching transistor Q21 with modification for the negative instead of positive current being switched thereby. Negative current is supplied to the emitter of transistor Q22 from conductor 430 through resistor R71. The collector of transistor Q22 is connected to conductor 425 in order to supply current to lamp 409. The base of transistor Q22 is connected to a suitable negative switching control circuit such as at G of circuit 66 shown in FIG. 3. Negative switching control circuit 66 is also connected at H to conductor 430. The voltage across G and H provide an appropriate biasing voltage to place transistor Q22 into a conductive mode during positive portions of the a-c from source 401, and into a nonconductive mode during negative portions of a-c.

A blocking diode D103 is connected in parallel with switching transistor Q22 with anode to conductor 430 and cathode to conductor 425. Two blocking diodes 104 and 105 are connected in series with anodes to the base of Q22 and cathodes toward conductor 430.

Ballast and starting circuit 400 further includes a starting circuit 450 used to boost the voltage applied across the electrodes of lamp 409 during startup. Starting circuit 450 is connected to apply boosted voltage only to the negative side of circuit 400. Equivalent circuitry (not shown) can alternatively be provided to the positive side either with or without circuit 450.

Starting circuit 450 includes a silicon controlled rectifier SCR-1 connected with the anode thereof to conductor 430. The cathode of SCR-1 is connected to the anode of blocking diode D107, the first side of capacitor C69, and to terminal C of FIG. 4. The gate and cathode of SCR-1 is connected across one side of pulse transformer 701. The opposite side of pulse transformer 701 is connected across terminals C and D of FIG. 4. The second side of capacitor C69 is connected to conductor 412. The cathode of diode D107 is connected to the anode of blocking diode D106 and to the second side of capacitor C68. The first side of capacitor C68 is connected to the output side of surge resistor FR3. The cathode of diode D106 is optionally connected by either jumper Z or jumper A-5 to conductor 412 or the first side of capacitor C65, respectively.

Ballast and starting circuit 400 is designed for use with two different discharge lamp wattage models, 400 watts and 1000 watts. The 400 watt lamp can be operated by circuit 400 using alternating current sources having rms voltages of 120, 240 and 277 volts. The 1000 watt lamp can be operated by circuit 400 using alternating current sources having rms voltages of 240, 277 and 480 volts. In each case special or optional connections must be made to properly adapt circuit 400 for operation of the chosen lamp at the chosen voltage. FIG. 7 shows a chart indicating the type of jumpers which must be provided in order to adapt circuit 400 for the particular lamp and current source being used.

When a 400 watt lamp is used with 120 volt rms current then it is necessary to connect jumper types A and B. Type A jumpers include jumpers A-1 through A-5 which must all be connected in order to meet the type A jumper requirement. Type B jumpers include jumpers B-1 through B-4 which must all be connected in order to meet the B requirement. When a 400 watt lamp is used with a 240 volt rms current supply, it is necessary to connect type B jumpers and the single type Z jumper. Type A jumpers are not connected in such application. When the 400 watt lamp is used with a 277 volt rms current source then circuit 400 is adapted by only connecting the Z jumper.

Use of 1000 watt metal halide discharge lamps with circuit 400 requires a different selection of jumpers than when using the 400 watt lamp. The 1000 watt lamp and 240 volt rms current source requires connecting both jumpers types A and B. The 1000 watt lamp with a 277 volt rms current source requires using only the type A jumpers. The 1000 watt lamp with a 480 volt rms current source requires connection of both types B and Z jumpers only.

The operation of circuit 400 will now be explained. As with previously described embodiments of this invention, circuit 400 first divides the incoming alternating current from source 401 into a positive component and a negative component using blocking diodes D90 and D91, or some other suitable means for dividing the alternating current. The positive current supplied during positive portions of the alternating current passes through diode D90 and is charged in the appropriate capacitors C60–C63 depending upon the optional jumper connections required for the lamp and current source being employed. When jumpers type A are only being used, such as with a 1000 watt lamp at 277 volts rms, then positive current flow through diode D90 causes charging of capacitors C61 and C62 in parallel. Capacitors C61 and C62 also discharge in parallel. When jumper types A and B are both connected then capacitors C60–C63 all charge and discharge in parallel. When jumper types B and Z are both used then capacitors C60 and C61 charge as a parallel unit in series with capacitors C62–C63 as a parallel unit. Capacitors C60–C63 all discharge in parallel. When only type Z jumpers are used then only capacitors C61 and C62 are effectively charged in series, and discharged in parallel.

The charging and discharging of negative capacitors C64–C67 is equivalent to the charging and discharging just described for the various jumper combinations for positive capacitors C60–C63. In all cases capacitance is produced which is needed to effectively power the associated lamp and the operating potential is maintained at an appropriate level without applying unnecessarily high voltage across the lamp, thus optimizing the operating efficiency of the ballast circuit.

In any of the capacitance options indicated above, the positive capacitors charge positively during positive portions of the alternating current, and discharge during negative portions. Conversely, the negative capacitors charge negatively during negative portion of the a-c cycle, and discharge during positive portions. In order to accomplish this, it is necessary for the positive switching means Q21 to be zero biased into a nonconductive mode during positive portions and forwardly biased into a conductive mode during negative portions of the a-c cycle. Conversely, it is necessary for the negative switching means Q22 to be zero biased into a nonconductive mode during the negative portions and forwardly biased into a conductive mode during the positive portions. This is accomplished using switching control circuits such as 65 and 66 and applying the appropriately timed control voltages across terminals E, F, G and H, as explained above.

Proper asynchronous operation of positive and negative switching transistors Q21 and Q22 allows the positive and negative charge stored in positive capacitors C60–C63 and negative capacitors C64–C67, to be appropriately discharged through inductive choke L16 and lamp 409 back to current source 401.

The initiation of discharge lamp 409 requires a boosted startup voltage to be applied across the spaced electrodes of the lamp. Starting circuit 450 is used to provide a boosted negative voltage through switching transistor Q22 to lamp 409. Starting circuit 450 operates in the following manner. Switch 404 is closed upon startup and current begins to flow into the positive and negative capacitors in an alternate fashion during positive and negative portions of the a-c. During positive portions of current from source 401 terminal 402 is positive with respect to terminal 403 and the first side of capacitors C68 charges positively and the second side thereof charges negatively, thus establishing a potential thereacross. When the source 401 swings negative the potential across capacitor C68 is forced thereacross thus increasing the potential differential thereacross by the additional potential of the negative swing voltage. This increased negative voltage on the second side of capacitor C68 flows through diode D107 and further increases the negative charge on the first side of capacitor C69 with respect to ground. A gate pulse is applied via D to the gate of SCR-1 at or immediately after closing switch 404 thus closing SCR-1 for flow of negative current from capacitor C69 through SCR-1 during positive portions when the negative switching transistor Q22 is closed. The anode of SCR-1 is maintained positive relative to the cathode because of the boosted negative voltage produced by starting circuit 450. The high negative voltage stored on capacitor C69 allows intermittent delivery of a high voltage peak at the start of a positive portion of the alternating current which precedes discharge of capacitors C64–C67 because of the more negative potential existing on C69. This increased negative voltage allows arcing to occur across the electrodes of the discharge lamp 409, thus starting operation thereof.

Jumper A-5 is connected with some configurations, thus allowing small amounts of charge to be drawn from capacitors C65 and C64 (if connected) to the second side of C68. The use of jumper Z similarly allows negative charge to pass through diode D106 to the second side of C68 during positive portions of the alternating current.

Table IV presents preferred values of resistance, inductance, and capacitance for resistors, inductors, and capacitors useful in a preferred form of circuit 400.

TABLE IV

| | |
|---|---|
| RESISTORS | |
| FR3 | .1 ohm |
| R70 | .22 ohm |
| R71 | .22 ohm |
| CAPACITORS | |
| C60, C63, C64, C67 | 15 microfarads |
| C61, C62, C65, C66 | 150 microfarads |
| C68 | 30 microfarads |
| C69 | 10 microfarads |
| INDUCTORS | |
| L16 | 5 millihenries |

Figure 8:
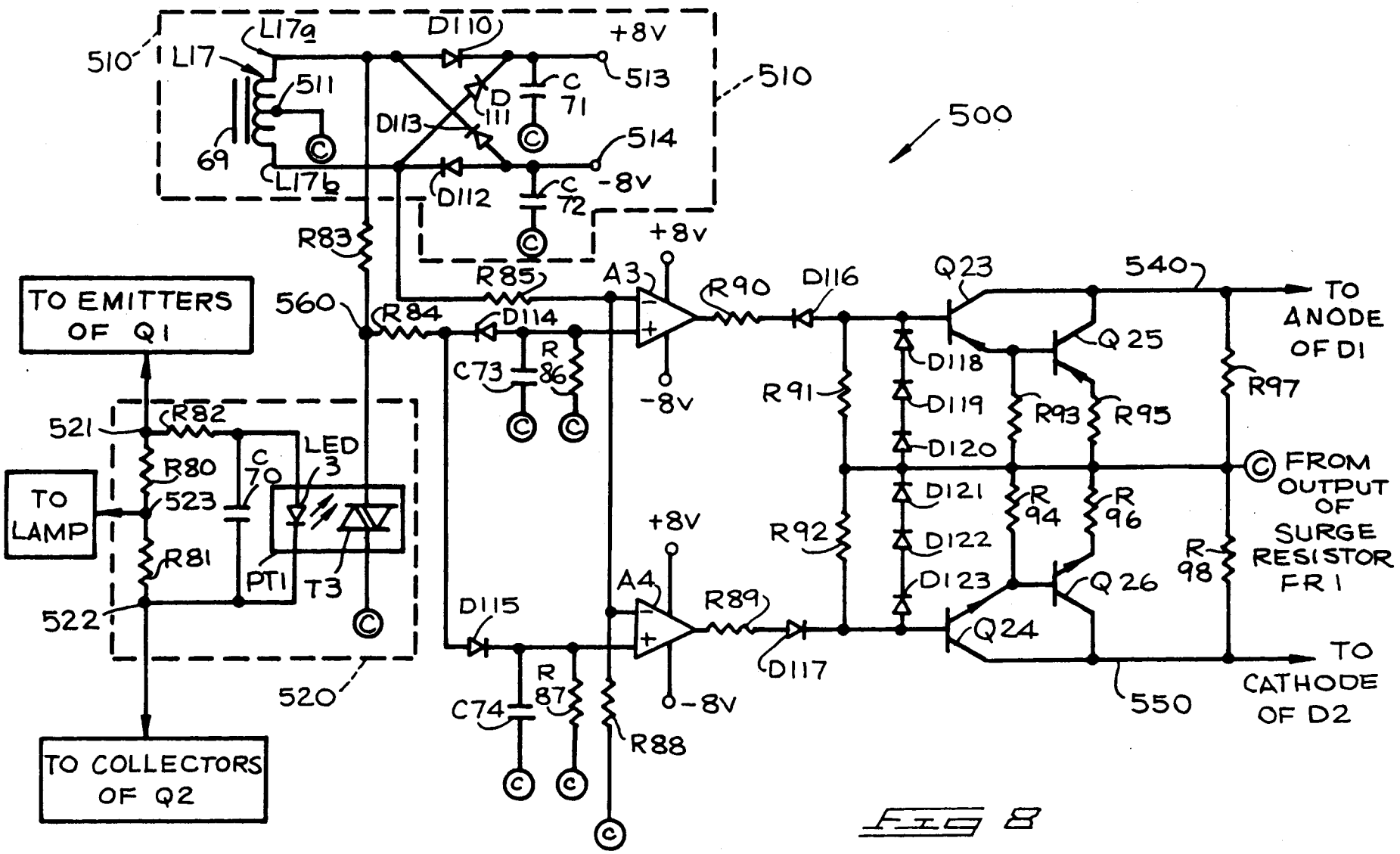
FIG. 8 is a schematic circuit diagram of a current regulating circuit useful with the embodiment shown in FIGS. 2, 3 and 4.

FIG. 8 shows a portion of a further preferred embodiment circuit 500 according to this invention. Circuit 500 is useful for controlling the amount of power supplied to the main positive and negative charge storage capacitors such as capacitors C1 and C2 of ballast and starting circuit 100 shown in FIGS. 2, 3 and 4. Circuit 500 regulates the power to such capacitors in order to prevent excessive current flow during startup to thereby preclude overheating of positive and negative switching means such as Q1 and Q2.

Switching regulator circuit 500 and equivalents thereof can be used in conjunction with a range of ballast circuits according to this invention. Circuit 500 is designed specifically to be used in conjunction with ballast circuits 100 and 200 described herein. The following description of circuit 500 will explain the application of circuit 500 with circuit 100. Similar application to ballast circuit 200 and other ballast circuits according to this invention will be readily apparent therefrom to one of ordinary skill in the art.

Regulator circuit 500 includes a power supply subcircuit 510 which is used to generate positive and negative direct current voltage supplies used by operational amplifiers such as A1 and A2 in circuit 100 of FIG. 4 and A3 and A4 of circuit 500. Power supply subcircuit 510 can be of a variety of constructions well known in the art of direct current power supplies.

A preferred form of circuit 510 advantageously employs a induction coil L17 which can advantageously be part of transformer 101 and share core 69. Alternatively induction coil L17 can be independent from other transformers used in the circuit. The primary side coil L5 of transformer 101 induces magnetic flux in core 69 which induces an alternating current in coil L17. A center tap 511 of coil L17 is preferably connected to the control ground or reference potential which is advantageously the same as the potential existing at the output of surge resistor FR1 of FIG. 2. Such control reference potential is indicated in the drawings by the letter C which is also similarly used in FIGS. 2–5.

One output from coil L17 is at terminal L17*a* which is connected to the anode of blocking diode D110 and to the cathode of blocking diode D113. The opposite terminal L17*b* is connected to the anode of blocking diode D111 and to the cathode of blocking diode D112. Diodes D110 and D111 allow positive current to flow therethrough from either side L17*a* or L17*b* of coil L17. Similarly, diodes D112 and D113 allow negative current to flow therethrough from either side of coil L17. Capacitors C71 and C72 smooth the resulting varying voltage passed through diodes D110–D113 to provide a suitably stable positive and negative direct current power supply at terminals 513 and 514, respectively.

Circuit 500 also includes a detection subcircuit 520 used to detect when current through switching transistors Q1 and Q2 exceeds a desirable level. Subcircuit 520 has a node 521 which is connected to the emitters of parallel positive switching transistors Q1. Connection of node 521 to the emitters of transistors Q2 obviates the need for using resistors R1 of FIG. 2, instead using resistor R80. Similarly, resistors R2 of FIG. 2 can be omitted from connection to the emitters of transistors Q2 because of resistance being provided by resistor R81. Resistors R80 and R81 provide a voltage differential between nodes 521, 522 and node 523 which is connected to lamp 32 either directly or preferably through choke L1.

Subcircuit 520 further includes resistor R82 which is connected at a first end thereof to node 521, and at a second end thereof to a first side of capacitor C70. The second side of capacitor C70 is connected to node 522. An optical isolator switching means such as photo-triac PT1 having a light emitting diode portion LED3 is connected in parallel with capacitor C70. Light emitting diode LED3 beams onto the photosensitive triac T3 causing it to close into a conductive mode when LED3 is provided with a sufficient minimum voltage thereacross to produce illumination.

Detection subcircuit 520 operates in the following manner. Current flows through switching transistors Q1 and Q2 as explained above with regard to ballast circuit 100. Positive current passing from the emitters of positive transistors Q1 is conducted through resistor R80 and to lamp 32. Similarly, negative current flows from the collectors of switching transistors Q2 through resistor R81 to lamp 32. With either positive or negative current flow there is a voltage drop across R80 or R81, respectively. The voltage drop across resistors R80 and R81 is derectly proportional to the current flowing therethrough. During normal operation the current flowing through resistor R82 is not sufficient to create a voltage differential across capacitor C70 and LED3 which is sufficient to illiminate LED3. During periods of high current demand, such as at startup, then a sufficient voltage differential is developed across LED3 thereby causing it to illuminate and close triac T3 into a conductive mode. Triac T3, as part of phototriac PT1, controls the application of the voltage of node 560 to remaining portions of the circuit, which will now be described.

Circuit 500 further includes resistor R83 connected at a first end to the first side L17*a* of coil L17. The second end of resistor R83 is connected to the anode of photo-triac PT1. The cathode of photo-triac PT1 is connected to conductor C. A resistor R84 is also connected to the output of phototriac PT1 at one end. The other end of resistor R84 is connected to the cathode of blocking diode D114, and the anode of blocking diode D115. The cathode of blocking diode D114 is connected to the plus input of a comparative operational amplifier A3. The anode of diode D114 is also connected to the first side of capacitor C73 and the first side of resistor R86. The second sides of capacitor C73 and resistor R86 are connected to conductor C. The minus input of operational amplifier A3 is connected to a second end of resistor R85 and to a first end of resistor R88. The first end of resistor R85 is connected to the second side L17*b* of coil L17. The second end of resistor R88 is connected to conductor C.

The cathode of diode D115 is connected to the plus input of comparative operational amplifier A4. The cathode of diode D115 is further connected to the first side of capacitor C74 and resistor R87. The second sides of capacitor C74 and resistor R87 are connected to conductor C. The minus input of operational amplifier A4 is also connected to the second end of resistor R85 and the first end of resistor R88. Resistor R85 and R88 effectively divide the voltage between second side L17*b* and conductor C for use as a sinusoidal or other varying voltage against which the plus inputs of amplifiers A3 and A4 are compared.

The output from amplifier A3 is connected to one end of resistor R90. The opposite end of resistor R90 is connected to the cathode of blocking diode D116. The anode of blocking diode D116 is connected to the base of a PNP type control transistor Q23. The anode of blocking diode D116 is also connected to a first end of resistor R91 and the cathode of blocking diode D118. The second end of resistor R91 is connected to conductor C. The anode of diode D118 is connected in series with two other blocking diodes D119 and D120, with the anode of diode D120 being connected to conductor C.

The output of operational amplifier A4 is connected to an arrangement of components conceptually similar to that just described with respect to amplifier A3. The output of amplifier A4 is connected to one end of resistor R89. The other end of resistor R89 is connected to the anode of blocking diode D117. The cathode of diode D117 is connected to the base of NPN control transistor Q24. The cathode of diode D117 is also connected to one end of resistor R92 and to the anode of blocking diode D123. The opposite side of resistor R92 is connected to conductor C. The cathode of diode D123 is connected in series with two other blocking diodes D122 and and D121, which are oriented with their anodes toward the base of transistor Q24. The cathode of diode D121 is connected to conductor C.

The emitters of control transistors Q23 and Q24 are connected to the bases of regulator transistors Q25 and Q26, respectively. Resistors R93 and R94 are connected between the emitters of transistors Q23 and Q24, respectively, and conductor C. The collector of transistor Q23 is connected to conductor 540 which is connected to the anode of diode D1 of FIG. 2. The collector of transistor Q25 is also connected to conductor 540. The collectors of transistors Q24 and Q26 are connected to the cathode of diode D2 via conductor 550. The emitters of transistors Q25 and Q26 are connected to conductor C via resistors R95 and R96, respectively. Resistors R97 and R98 are connected between conductor C and conductors 540 and 550, respectively.

The operation of circuit 500 will now be explained more fully. The functions of circuit 500 are primarily to detect when excessive current is being supplied to switching transistors Q1 and Q2 (FIG. 2) and then to control the percentage of time during which each of the positive and negative cycle portions are allowed to charge the main positive and negative capacitors C1 and C2. Transistors Q25 and Q26 are the switching elements which control the primary flow of current from conductor C therethrough, and supply the rectifying diodes D1 and D2. The percentage of time that current is supplied controls the resulting charge on capacitors C1 and C2 thus regulating the current discharged through main switching transistors Q1 and Q2. Regulation of the current flow through transistors Q1 and Q2 allows operation without excessive heat, thus extending the service life and reliability of the ballast circuits.

Detection of the current flow through transistors Q1 and Q2 is performed by detection subcircuit 520 as explained above. Detection circuit 520 not only detects excessive current but further provides a control signal during times of excess current which causes the control potential provided by first side L17*a* of coil 17 to be shunted to control ground, conductor C, through phototriac PT1. This shunting of control potential to the control ground or reference potential, controls the rectified voltage input to the plus terminal of amplifiers A3 and A4. The output from amplifiers A3 and A4 operates in the following manner.

During negative portions of alternating current the control coil L17 produces power which is passed through diode D114 to the plus or noninverting input of amplifier A3. Capacitor C73 smooth the negative signal passing through diode D114 rendering it essentially direct current. Resistor R86 allows some current leakage to control ground (conductor C) so that increases and decreases in the potential at node 560 result in suitably quick response (1 second) by amplifier A3.

Amplifier A3 provides a negative output signal when the inverting input voltage exceeds the noninverting input voltage. During normal operation the inverting (−) input is less negative and thus exceeds the plus input to produce a −8 volt output to diode D116. This biases transistors Q23 and Q25 into a conductive mode allowing full power to reach the positive main capacitor C1.

If power is excessive then triac T3 is closed during a portion of the cycle and the potential at node 560 goes to control ground. The potential at the noninverting input thus increases becoming less negative and approaches control ground as capacitor C73 discharges through resistor R86. The potential on the inverting input of amplifier A3 varies positive and negative. When the alternating potential at the inverting input falls below the reduced negative potential of the noninverting input, then the output from amplifier A3 goes positive thus removing the biasing voltage to transistors Q23 and Q25 thereby placing them in a nonconductive mode. This terminates power to the main positive capacitor C1, thereby reducing the charge placed thereon and the power conducted through switching transistors Q1.

The operation of amplifier A4 and transistors Q24 and Q26 is essentially the same as the description just given with respect to amplifier A3 and transistors Q23 and Q25, except that the output from amplifier A4 is normally positive because the plus terminal is held at a higher positive voltage than the varying voltage at the minus terminal. This positive output biases transistors Q24 and Q26 closed providing full power to negative main capacitor C2. When phototriac PT1 closes it decreases so that the varying voltage at the minus input exceeds the voltage at the plus input during part of the negative cycle. This causes the output of A4 to go negative thereby removing the forward bias on transistors Q24 and Q26. The power supplied to negative main capacitor C2 and switching transistors Q2 is thus reduced. Transistor Q26 controls flow of negative current from conductor C to the cathode of rectifying diode D2.

Regulating circuit 500 thus controls current flow to both positive and negative main capacitors C1 and C2 in order to maintain a predetermined current flow through switching transistors Q1 and Q2.

Table V below presents preferred values of resistance and capacitance for resistors and capacitors useful in a preferred form of circuit 500.

TABLE V

| RESISTORS | |
|---|---|
| R80, R81 | 0.25 ohms |
| R82 | 12 ohms |
| R83 | 2.2K ohms |
| R84 | 4.7M ohms |
| R85 | 22K ohms |
| R86 | 10M ohms |
| R87 | 10M ohms |
| R88 | 10K ohms |
| R89, R90 | 330 ohms |
| R91, R92 | 10K ohms |
| R93, R94 | 1K ohms |
| R95, R96 | 0.035 ohms |

TABLE V-continued

| | |
|---|---|
| R97, R98 | 100K ohms |
| CAPACITORS | |
| C70 | 50 microfarads |
| C71, C72 | 1000 microfarads |
| C73, C74 | 0.1 microfarads |

Figure 9:
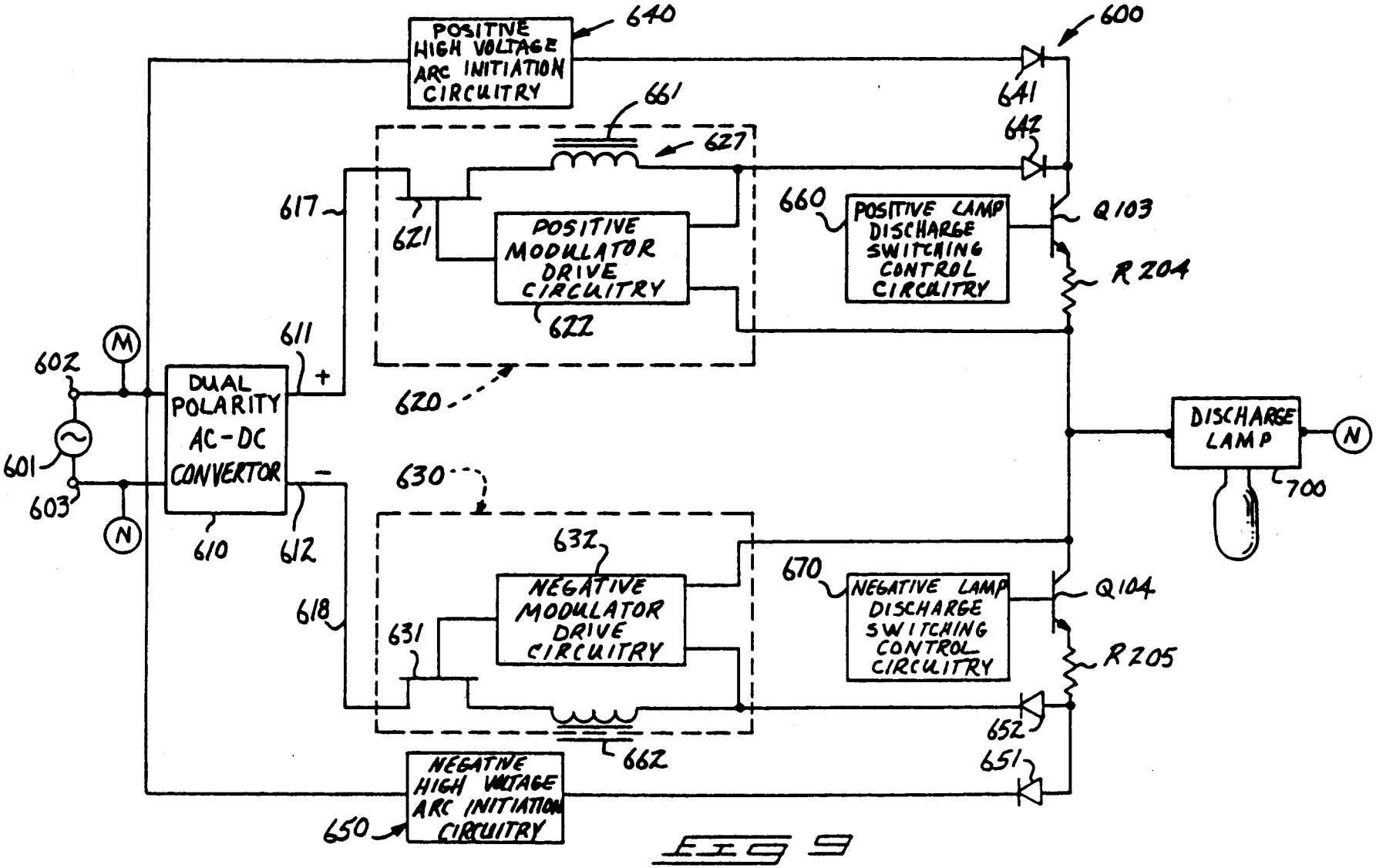
FIG. 9 is a block diagram showing principal functional elements of an alternative form of the invention.

FIG. 9 shows a further alternative embodiment of electronic ballast 600 according to this invention. Ballast 600, as shown, is adapted for use with 400 watt metal halide lamps, although the concepts described are useful for most, if not all, types of discharge lamps. Ballast circuitry 600 receives electrical current from an alternating current (AC) source 601. The preferred current source is a nominal 120 volt rms AC current such as widely used in the United States. First current source connection node 602 represents the voltage-varying side of the alternating current source and second current source connection node or terminal 603 represents the neutral or common side of the alternating current source. The first, voltage-varying current supply conductors are designated with the letter M in the drawings. The second, neutral or common side current supply conductors connected to terminal 603. of the AC source are designated with the lettr N.

Current from electricity source 601 flows to a dual polarity AC-DC converter 610. AC-DC converter 610 can be of a variety of different designs which provide a positive current source terminal 611 and a negative current source terminal 612. In the preferred embodiment positive current source 611 provides approximately +170 volts DC in the no load condition. The negative current source terminal 612 provides approximately −170 volts in the no load condition. The positive and negative current supplied from terminals 611 and 612 are substantially direct current with some variation possible due to discharge of capacitors or other energy storage device used in the AC-DC converter.

The positive output 611 from converter 610 is communicated to a positive modulation subcircuit which can advantageously be in the form of a DC-DC converter 620. The negative current output 612 is similarly connected to a negative modulation subcircuit which can advantageously also be in the form of a DC-DC converter 630.

The positive modulator advantageously includes a current modulating element such as a transistor, specifically, field effect transistor (FET) 621. The positive current modulating transistor 621 is controlled by a positive modulator drive subcircuit 622. An inductor 661 can be utilized as a choke or filtering device which smooths the modulated positive power which is controllably passed by modulation transistor 621. The resulting current flow from inductor 661 is communicated through a diode 642 to the collector of positive lamp discharge switching means Q103. Transistor or other switching means Q103 is controlled using a positive lamp discharge switching control circuit 660. A positive current output terminal such as the emitter of transistor Q103 is connected to a supply side of discharge lamp 700, preferably using a relatively low value resistance indicated by R204.

FIG. 9 also shows a positive high voltage arc initiation circuitry 640. Arc initiation circuitry 640 is connected to receive line AC to provide power thereto. Other sources of power may also be possible, such as output 611. Circuitry 640 generates a relatively high voltage and stores it unitl an appropriate time during the discharge of positive current through discharge lamp 700. The amount of current provided by positive arc initiation circuitry 640 is preferably made sufficient to initiate discharge within lamp 700 through diode 641, transistor Q103 and resistor R204. The energy storage capability of arc initiation circuitry 640 is also preferably made relatively low so that the higher voltage power source is only utilized for a brief portion of a positive lamp discharge period associated with discharge of positive current through lamp 700. This minimizes the energy expended and makes the ballast more efficient.

Negative current from negative output terminal 612 is communicated to a negative current modulator, such as at field effect transistor 631 which acts as a negative modulating element. The negative modulating element is controlled using negative modulator drive subcircuit 632. The current output from modulation transistor 631 is also preferably conducted through an inductive choke 662 to help filter the modulated current and to help regulate current flow therethrough. The negative current output from inductor 662 is conducted through diode 652 and resistor R205 to a negative lamp discharge switching means Q104. Current is controllably conducted through the negative lamp discharge switch Q104 to discharge lamp 700. The negative lamp discharge switching means is controlled using a negative lamp discharge switching control subcircuit 670.

The negative side or channel of circuitry 600 is also provided with a negative high voltage arc initiation subcircuit 650. Negative arc initiation circuitry 650 functions in a manner similar to that described above with respect to the positive arc initiation circuitry 640. The relatively high voltage negative current produced by circuitry 650 is passed through diode 651, resistor R205 and negative lamp discharge switching means Q104 to produce a brief relatively more negative discharge through lamp 700.

Figure 10:
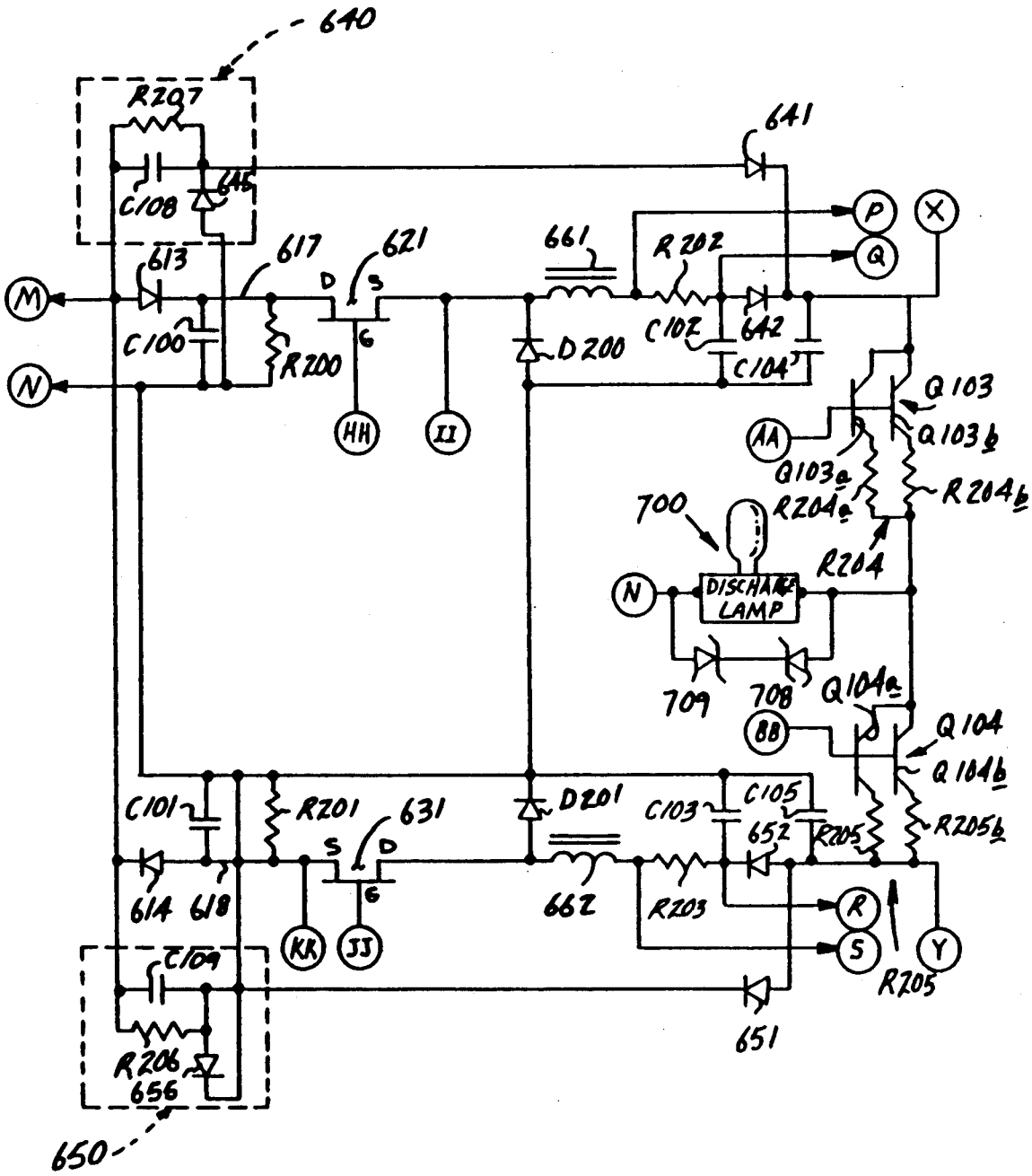
FIG. 10 is a schematic circuit diagram showing a portion of a preferred circuit according to the embodiment of FIG. 9.

FIG. 10 shows a portion of circuitry 600 in greater detail than shown in the abbreviated block/schematic diagram presented in FIG. 9. FIG. 10 shows the voltage-varying line current being supplied at terminal M. Positive and negative current supplied thereto is effectively divided into positive and negative components by diodes 613 and 614, respectively. Positive side diode 613 is connected with the anode towards the alternating current source conductor M. Negative diode 614 is connected with the cathode thereof connected to the incoming line voltage via conductor M. The cathode of positive diode 613 is connected to a positive converter storage capacitor C100. The other side of capacitor C100 is connected to the neutral conductor N. Similarly, the anode of negative diode 614 is connected to one side of a main negative converter capacitor C101. The other side of capacitor C101 is connected to the neutral line N. Capacitors C100 and C101 are connected across their terminals using resistors R200 and R201, respectively, for slowly discharging these capacitors when power is turned off. The voltage produced at the first side of capacitor C100 and on conductor 617 is substantially DC positive current made available to remaining portions of the positive side of the electronic ballast 600. The negative substantially DC current developed on conductor 618 is similarly used to supply negative current to remaining portions of the negative side or channel of circuit 600.

Positive DC conductor 617 is connected to the drain connection of transistor 621. The gate of transistor 621 is connected to the positive modulator drive circuitry 622. The source connection of transistor 621 is also connected to drive circuitry 622. In an analogous manner, negative current conductor 618 is connected to the source connection of negative modulator transistor 631. The gate of transistor 631 is connected to the negative modulator drive circuitry 632. The negative modulator drive circuitry 632 is also connected to the source connection of transistor 631. The drain connection of transistor 631 functions as a current output terminal for the modulator and is connected to remaining portions of the circuitry to supply the primary power for discharge to lamp 700. The source connection of transistor 621 is similarly used as an output for the positive modulator to provide the primary positive current for discharge through lamp 700. The modulated current from transistors 621 and 631 is preferably in the form of pulse width modulated pulses of positive and negative current, respectively. These modulation transistors are preferably turned fully on and fully off in order to minimize power dissipation during modulation of the positive and negative currents.

Figure 11:
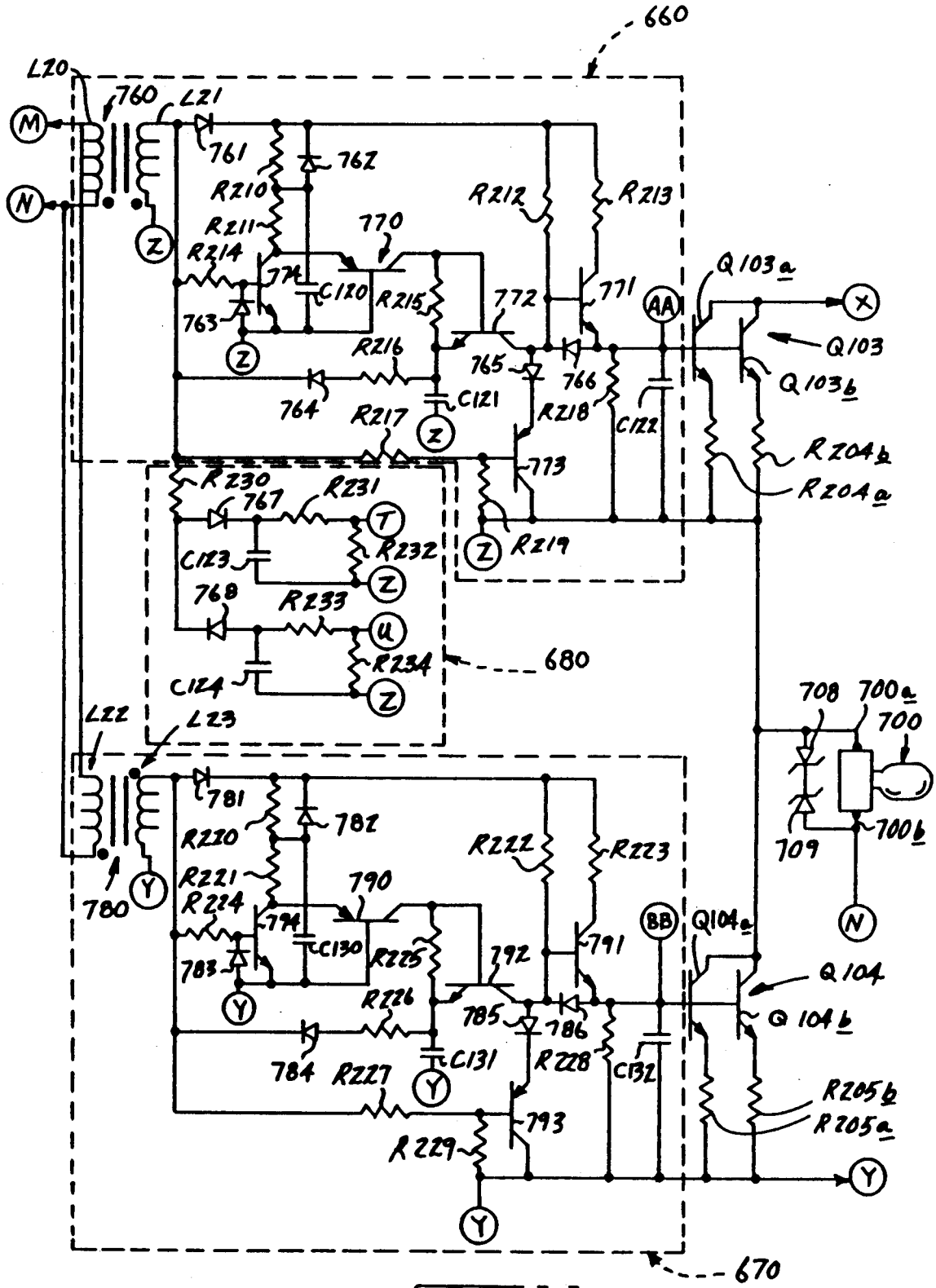
FIG. 11 is a schematic circuit diagram showing a further portion of the preferred embodiment showing FIG. 10.

The positive output of the current modulator is connected to one end of inductor 661 and to the cathode of diode D200. The other end of inductor 661 is connected to resistor R202. The other end of resistor R202 is connected to one side of capacitor C102 and to the anode of diode 642. The other side of capacitor C102 is connected to the anode of diode D200 and to the neutral line N. The cathode of diode 642 is connected to one side of capacitor C104 and to the positive lamp discharge switching transistors Q103, such as at the collectors of parallel bipolar transistors Q103*a* and Q103*b*. The other side of capacitor C104 is connected to the neutral conductor N. The emitters of positive lamp discharge transistors Q103*a* and Q103*b* are connected to resistors R204*a* and R204*b*, respectively. The other ends of resistors R204*a* and R204*b* are connected to the supply side of discharge lamp 700. The bases of positive switching means Q103 are connected via conductor AA to a suitable positive lamp discharge switching control circuit 660, such as shown in FIG. 11 and described hereinafter.

Modulated negative current from negative modulator transistor 631 is connected to one end of inductor 662 which acts as a filtering and energy storage device for taking the pulse modulated current and converting it back into a substantially DC signal at the opposite or output end thereof. The output end of inductor 662 is connected to resistor R203. The other end of resistor R203 is connected to the cathode of diode 652 and to one side of capacitor C103. The other side of capacitor C103 is connected to the neutral line N. The anode of diode 652 is connected to one side of capacitor C105 and to parallel resistors R205*a* and R205*b*. Negative current is conducted through resistors R205*a* and *b* as controlled by the negative lamp discharge switching means which is preferably in the form of parallel bipolar transistors Q104*a* and Q104*b*. Transistors Q104*a* and *b* are connected with the emitters thereof to ends of resistors R205*a* and R205*b*, respectively. The collectors of transistors Q104*a* and Q104*b* are connected together and to the supply side of discharge lamp 700. The bases of transistors Q104*a* and *b* are connected through conductor BB to a negative lamp discharge switching control subcircuit 670 which is shown in greater detail in FIG. 11 and described hereinafter.

The supply and neutral terminals of discharge lamp 700 are preferably connected across using a suitable excess voltage protection device such as a transzorb having zener diodes 708 and 709. Zener diode 708 is connected with the anode thereof to the supply side of discharge lamp 700 and the cathode thereof connected to the cathode of zener diode 709. The anode of zener diode 709 is connected to the neutral side of lamp 700.

FIG. 10 also shows the positive high voltage arc initiation circuitry 640 near the top thereof. Circuitry 640 is connected to the incoming line voltage M using a first side of capacitor C108. The second side of capacitor C108 is connected to the cathode of diode 645. The anode of diode 645 is connected to the neutral conductor N of the alternating current source. A resistor R207 is connected across capacitor C108 to allow slow discharge when power is terminated. The second side of capacitor C108 and the cathode of diode 645 are connected to the anode of diode 641. The cathode of diode 641 is connected to the cathode of diode 642 and to the collectors of the positive lamp discharge transistors Q103.

FIG. 10 also shows the negative high voltage arc initiation circuitry 650. Circuitry 650 includes capacitor C109 which has the first side thereof connected to the incoming voltage-varying line conductor M. The second side of capacitor C109 is connected to the anode of diode 655. The cathode of diode 655 is connected to the neutral line conductor N. Resistor R206 is connected across capacitor C109 to allow slow discharge when power is terminated. The second side of capacitor C109 is connected to the cathode of diode 651. The anode of diode 651 is connected to the anode of diode 652 and to negative lamp discharge switching transistors Q104 via resistors R205*a* and R205*b*.

The basic flow of positive and negative current used to power lamp 700 will now be described. During positive portions of the alternating current cycle of electricity source 601 current flows through diode 613 and is stored in capacitor C100. A number of cycles of positive current causes capacitor C100 to become sufficiently charged so as to supply a somewhat fluctuating but substantially DC positive current along conductor 617. Current is modulated through modulator transistor 621 while applying a voltage to the gate of transistor 621 which is sufficient to forwardly bias the transistor relative to the voltage applied at the source of transistor 621. This modulation control signal preferably turns the modulation transistor on and off at a frequency which is substantially greater than the operating frequency of the incoming line current. Preferably the frequency of the modulator is 10 or more times greater than the frequency of the incoming line current and the frequency of the alternating current supplied by the ballast to the discharge lamp. In the preferred embodiment shown the modulating transistor 621 operates at a frequency of approximately 100 KHz.

The modulated current is supplied in the form of DC pulses of brief duration which are conducted through inductor 661 to provide a modulated substantially DC output therefrom. The primary positive lamp discharge current passed through inductor 661 is also conducted through current sensing resistor R202 in order to provide a voltage differential thereacross which is used in control of the modulation circuitry using conductors P and Q.

Inductor 661, capacitor C102 and diode D200 form a current regulating, filtering and secondary energy storing function within the circuit. When positive lamp discharge switches Q103 are conductive, current flows through inductor 661 resistor R202 in a surge with substantially constant DC values being produced through diode 642. However, when switches Q103 are turned off, inductor 661 tends to continue conducting current as the magnetic field collapses thus drawing positive current through diode D200 from the neutral side of capacitor C102. The current flowing through diode D200 and inductor 661 passes through resistor R202 to the first side of capacitor C102. While lamp discharge transistors Q103 are turned off, the modulation transistor 661 continues to pulse reduced amounts of current therethrough in order to fully charge the energy storing and filtering circuit formed by inductor 661, capacitor C102 and diode D200 to the full DC voltage of capacitor C100, approximate +170 volts. This allows the circuitry to be in a fully charged condition and ready for discharge when the positive lamp discharge transistors Q103 are turned on for the next surge of positive current through discharge lamp 700.

In the preferred embodiment shown the positive discharge transistors Q103 are turned on during positive portions of the line alternating current. The positive lamp discharge period defined by transistors Q103 being conductive is substantially coextensive with the positive portions of the AC cycle in the preferred embodiment. Relatively minor amounts of dead band time are preferably provided at the start of the positive portion of the line AC cycle and at the end of the positive portion of the line AC cycle in order to assure that there is no simultaneous conduction through the positive and negative lamp discharge transistors Q103 and Q104 and maintain their asynchronous operation. During positive lamp discharge periods substantially all current through lamp 700 is controlled by the positive lamp discharge transistors Q103. The substantially in-phase operation of positive lamp discharge transistors Q103 with respect to the line alternating current cycles is not necessary but is advantageous.

The operation of the high voltage generating circuit 640 used for arc initiation will now be described. During a negative portion of line AC positive current is conducted from the neutral conductor N through diode 645 and on to the second side of capacitor C108. When the line AC current swings positive, the positive potential on the first side of capacitor C108 causes an increase in the voltage on the second side of C108 because the voltage across the capacitor tends to be maintained. In no load conditions the voltage is doubled. In loaded conditions the charge generated and stored on the second side of capacitor C108 is discharged through diode 641 for a brief portion of the lamp discharge cycle until the capacitor C108 is discharged to a point where the anode of diode 641 is at approximately the same voltage as the anode of diode 642. At that point conduction of the primary lamp operating current during the positive lamp discharge periods is provided by the modulated current flow passing through diode 642. The positive arc initiation circuitry 640 provides a relatively short duration flow of higher voltage current which is efficient for initiation of lamp discharge without requiring generation of high voltage current for all of the current used to power the discharge lamp.

Negative current flows from conductor M to lamp 700 in a manner substantially the same as described above with respect to the positive side. Specifically, negative current flow through diode 614 during the negative potential portions of the line alternating current provided on conductor M. The negative charge passed by diode 614 is stored on the first side of capacitor C101. The current modulating switch or gate 631 pulses the substantially DC current provided by conductor 618. The pulsed modulated current from gate 631 is conducted to inductor 662. Inductor 662, capacitor C103 and diode D201 provide the same filtering and energy storing function as described above with respect to positive inductor 661, capacitor C102 and diode D200 with opposite polarity. The primary negative operating current passes through inductor 661, resistor R203 and diode 652 when negative lamp discharge switching transistors Q104 are turned on. Transistors Q104 are controlled by suitable biasing voltage via conductor BB using the negative lamp discharge switching control circuitry 670. Lamp discharge switches Q104 controllably discharge negative current through lamp 700. The discharge of negative current through lamp 700 occurs in asnynchronous relationship to the discharge of positive current using lamp discharge switches Q103, that is, the positive and negative transistors Q103 and Q104 are not conductive at the same time. The negative current discharge through lamp 700, as shown, advantageously occurs during the negative potential portions of the incoming line alternating current. The negative lamp discharge periods defined by switches Q104 being turned on is preferably substantially coextensive with the negative potential portions of the line current in the preferred embodiment. During negative lamp discharge periods substantially all current through lamp 700 is controlled by the negative lamp discharge transistors Q104. Dead band space at the start and end of the negative lamp discharge period are also preferably provided to assure that no simultaneous conduction occurs through positive and negative lamp discharge switches Q103 and Q104.

Capacitors C104 and C105 serve to reduce noise at the collectors of transistors Q103 and Q104, respectively, due to the relatively high impedances which exist at on conductors X and Y.

Although operation of the invention has been described above with respect to the positive lamp discharge periods being substantially coincident with the line AC positive potential portions and the negative lamp discharge periods being substantially coincident with the negative potential portions of the line current, such is not necessarily required. It is alternatively possible that the lamp operate at frequencies different from the line using switching transistor control circuitry which is suitably adapted. Other variations in frequency and relationship of the discharge lamp operating phase with respect to the phase of the incoming line current are also possible so long as the asynchronous operation is maintained between the positive and negative lamp discharge switching means Q103 and Q104, respectively.

The above descriptions give a general explanation of the flow of primary and arc initiating boosting current through the positive and negative current flow channels of the circuit 600. Discussion will now turn to the structural interrelationship of the driving circuits 660 and 670 used to control the positive and negative lamp discharge switches Q103 and Q104.

FIG. 11 also shows the positive and negative lamp discharge switching means Q103 and Q104, respectively, for ease of description and consideration. Positive power is supplied to the collectors of switching means Q103 via conductor X and negative current is supplied to the emitters of negative switching means Q104 via conductor Y through resistors R205*a* and *b*. The bases of positive lamp discharge switching transistors Q103 are connected to the positive lamp discharge switching control or driving circuitry 660. The bases of negative lamp discharge switching transistors Q104 are connected to the negative lamp discharge switching control circuitry 670. FIG. 11 further shows a power supply subcircuit 680 which is used to generate appropriate voltages on conductors marked T and U. The conductor marked Z is connected directly to the supply terminal 700*a* of lamp 700. The lamp neutral terminal is 700*b*.

Circuitry 660 includes a suitable transformer 760 which includes a primary coil L20 and a secondary coil L21. The first side of primary coil L20 is connected to the neutral conductor N and the second side of the coil L20 is connected to hot lead M. The secondary coil L21 steps the voltage down to approximately ±8 volts when the primary coil is exposed to ±170 volts. The first side of secondary coil 21 is connected to conductor Z which is connected to the supply side 700*a* of discharge lamp 700. The second end of coil L21 is connected to the anode of diode 761 and other components. The cathode of diode 761 is connected to the cathode of diode 762 and to first ends of resistors R210, R212 and R213. The opposite end of resistor R210 is connected to the first side of capacitor C120 and to an end of resistor R211. The anode of diode 762 is also connected to the first side of capacitor C120. The other side of capacitor C120 is connected to conductor Z. The other end of resistor R211 is connected to the collector of transistor 774. The base of transistor 774 is connected to resistor R214 with the opposite end of resistor R214 connected to the second end of coil L21. The base of transistor 774 is also connected to the cathode of diode 763 and the anode thereof is connected to conductor Z. The emitter of transistor 774 is also connected to conductor Z. The collector of transistor 774 is also connected to the emitter of PNP transistor 770. The collector of transistor 770 is connected to one end of resistor R215 and to the base of transistor 772. The opposite end of resistor 215 is connected to the emitter of transistor 772 and also to one end of resistor R216 and to one side of capacitor C121. The opposite side of capacitor C121 is connected to conductor Z. The opposite end of resistor R216 is connected to the anode of diode 764 which has the cathode thereof connected to the second end of coil L21. The second end of coil L21 is also connected to resistor R217. The opposite end of resistor R217 is connected to the base of transistor 773 and to one end of resistor R219. The opposite end of resistor R219 is connected to conductor Z. The collector of transistor 773 is connected to conductor Z. The emitter of transistor 773 is connected to the cathode of diode 765. The anode of diode 765 is connected to the collector of transistor 772, the base of transistor 771, and to the cathode of diode 766. The base of transistor 771 is also connected to the second end of resistor R212. The collector of transistor 771 is connected to the second end of resistor R213 and the emitter of transistor 771 is connected to the anode of diode 766. The emitter of transistor 771 is also connected to a first side of resistor R218. The second end of resistor R218 is connected to conductor Z. The emitter of transistor 771 is further connected to a first side of capacitor C122 and to the bases of positive lamp discharge switching transistors Q103*a* and *b*. The base node for such transistors has been designated conductor AA which refers to the signal which drives the bases of these positive switching transistors. This designation is used merely for convenience in relating FIGS. 10 and 11.

The positive lamp discharge switching control circuitry 660 operates in the following manner. During positive portions of the incoming line current, a positive voltage is generated on the second side of coil L21. This positive voltage is referenced with respect to the first side of coil L21 which is connected to the voltage which is experienced on the supply side of the discharge lamp being powered. Thus the signal generated in coil L21 is superimposed on the alternating voltage existing on the supply side of the lamp. The relatively more positive voltage generated on the second side of L21 during positive portions of line current applies a relatively higher voltage to the base of transistor 774 than to the emitter thereof which is connected to Z which is effectively a control ground. This turns transistor 774 on causing conduction through diode 761, resistor R210 and R211 to the collector of transistor 774 and on to conductor Z. The voltage generated at the node between resistors R210 and R211 is used to charge the first side of capacitor C120. Capacitor C120 is used to apply a minimum voltage of relatively DC current through diode 762 to the first sides of resistor R212 and R213. The conductive state of transistor 774 during the positive portion of the line cycle causes the emitter of transistor 770 to be pulled low thus turning transistor 770 off. This in turn causes the base and emitter of transistor 772 to reach a relatively equal voltage turning transistor 772 off.

The base of transistor 773 is forward biased during positive portions of line current thus drawing current through resistor R212 which forward biases the base-emitter junction of transistor 771. This causes transistor 771 to turn on thus conducting current through resistor R213 to the bases of the positive lamp discharge switching transistors Q103*a* and *b*. The base voltage at conductor AA increases and decreases during the positive cycle in a substantially sinusoidal manner. The current through switching means Q103 is also substantially sinusoidal during the positive lamp discharge period. The positive lamp discharge period is approximately from 5° until 175° of the 180° positive line half cycle.

During the negative cycle of line current transistor 774 is turned off. This causes a relatively higher voltage to be applied from capacitor C120 through resistor R211 to the emitter of PNP transistor 770 thus turning it on. When transistor 770 turns on, a relatively higher voltage is applied to the base of transistor 772 as compared to the emitter thereof thus turning transistor 772 on. Diode 764 and capacitor C121 effectively form a peak detector which is negative in voltage at approximately −4 volts relative to Z. When transistor 772 turns on, this negative voltage is conducted through transistor 772 from emitter to collector and through diode 766 to affirmatively bias the base of the main lamp discharge switching transistors Q103 into a reverse biased condition across the base-emitter junction. This reverse biased condition assures that the transistors are turned off and that positive current cannot be connected to the supply side of lamp 700 during negative lamp discharge periods.

The negative lamp discharge switching control circuitry 670 is constructed and operates in an analogous fashion to the positive circuitry 660 just described. Circuitry 670 includes a transformer 780 which has a primary coil L22 and a secondary coil L23. The first side of coil L22 is connected to neutral conductor N and the second side is connected to the voltage varying conductor M. The first side of coil L23 is connected to the cathode of diode 781 and other components. The second side of coil L23 is connected to conductor Y which is effectively used as the control ground for the negative lamp discharge switching control circuitry 670. The first side of coil L23 is also connected to one side of resistor R224, the other end of which is connected to the base of transistor 794. The base of transistor 794 is also connected to the cathode of diode 783 which has an anode connected to conductor Y. The emitter of transistor 794 is connected to conductor Y. The cathode of diode 781 is connected to one end of resistor R220. The other end of resistor R220 is connected to one end of resistor R221. The other end of resistor R221 is connected to the collector of transistor 794. A first side of capacitor C130 is connected to the node between resistors R220 and R221 and also connected to the anode of diode 782. The cathode of diode 782 is connected to the cathode of diode 781 and to first ends of resistors R220, R222 and R223. The second side of capacitor C130 is connected to conductor Y. The collector of transistor 794 is also connected to the emitter of PNP transistor 790. The base of transistor 790 is connected to conductor Y and the collector thereof is connected to the base of transistor 792. Resistor R225 extends between the emitter of transistor 792 and the collector of transistor 790. The emitter of transsistor 792 is also connected to the first side of capacitor C131, the other side of which is connected to conductor Y. The first side of capacitor C131 is connected to one end of resistor R226 and the other end of that resistor is connected to the anode of diode 784. The cathode of diode 784 is connected to the first side of coil L23. The collector of transistor 792 is connected to the base of transistor 791 and to the anode of diode 785 and cathode of diode 786. The cathode of diode 785 is connected to the emitter of PNP transistor 793. The base of transistor 793 is connected via resistor R227 to the first side of coil L23. Resistor R229 is connected between the base of transistor 793 and conductor Y. The collector transistor 793 is connected to conductor Y. The collector of transistor 791 is connected to a second side of resistor R223. The emitter of transistor 791 is connected to the bases of negative lamp discharge transistors Q104, the anode of diode 786, and one side of resistor R228. The other side of resistor R228 is connected to conductor Y. A capacitor C132 is connected between the bases of the negative lamp discharge switching transistors Q104a and b and conductor Y. Conductor BB represents the negative lamp discharge switching control circuitry output signal to the negative lamp discharge switching means Q104.

In operation the negative lamp discharge switching control circuitry 670 generates a relatively more positive voltage at the first end of coil L23 during the negative cycle portions of the incoming line current. The circuit otherwise operates in the manner described above with respect to positive circuit 660 except that it is of opposite polarity and out of phase in operation because of the opposite relationship between primary and secondary coils L22 and L23 of transformer 780. This results in the base conductor BB being forward biased in a substantially sinusoidal fashion during the negative portion of the incoming line alternating current cycle. It also results in a reverse bias on the base-emitter junction of transistors Q104*a* and *b* during the positive cycle portions of the incoming line current.

Control circuits 660 and 670 provide for asynchronous operation of the positive and negative lamp discharge switching means Q103 and Q104. In the preferred embodiment as shown the positive lamp discharge switching transistors Q103 are conductive during the positive portion of the AC line cycle. The negative lamp discharge switching transistors Q104 are biased into a conductive mode during the negative portion of the incoming line AC current. Although this in-phase relationship is preferred in the embodiment as shown and described, it is alternatively possible to operate the lamp discharge transistors partially out of phase or directly out of phase with the incoming line alternating current cycles. However, the positive and negative lamp discharge switching means Q103 and Q104 must be operated asynchronously or otherwise be adapted to prevent application of the positive and negative currents to lamp 700 at the same time.

FIG. 11 also shows small power supply subcircuit 680 which includes a resistor R230 which is connected to the second end of coil L21. The other end of resistor R230 is connected to the anode of diode 767 and to the cathode of diode 768. The cathode of diode 767 is connected to one side of capacitor C123 and to one end of resistor R231. The other side of capacitor C123 is connected to conductor Z. The other end of resistor R231 is connected to conductor T and to one end of resistor R232. The other end of resistor R232 is connected to conductor Z. Conductor T is communicated to the modulation circuitry shown in FIG. 12A.

In operation diode 767 allows positive current to flow therethrough and charge capacitor C123. This provides a substantially DC voltage riding on the alternating voltage defined by conductor Z. Conductor T provides a substantially constant +4 volt level over the alternating voltage existing on conductor Z which is connected to the supply side of lamp 700. The +4 volts of conductor T with respect to conductor Z defines the target voltage differential used in the control of the positive pulse width modulator described below.

Circuit 680 also includes a negative power supply using diode 768 which has the cathode thereof connected to resistor R230 and the anode thereof connected to one side of capacitor C124. The other side of capacitor C124 is connected to conductor Z. The anode of diode 768 is also connected to one end of resistor R233. The other end of resistor R233 is connected to conductor U and to one end of resistor R234. The other end of resistor R234 is connected to conductor Z. This portion of the power supply circuitry 680 generates a voltage of approximately −4 volts at conductor U with respect to the alternating voltage existing on conductor Z. The voltage on conductor U is utilized in the negative modulator driving circuitry 632 described below with respect to FIG. 13A. The circuitry generating the voltage at conductor U functions in substantially the same manner as that described above with respect to the generator of the voltage on conductor T except that diode 768 is oppositely oriented in order to pass the negative portion of the alternating current generated in coil L21 thereby leading to the −4 volt supply voltage at conductor U versus the +4 volts supply voltage on conductor T.

Figure 12A:
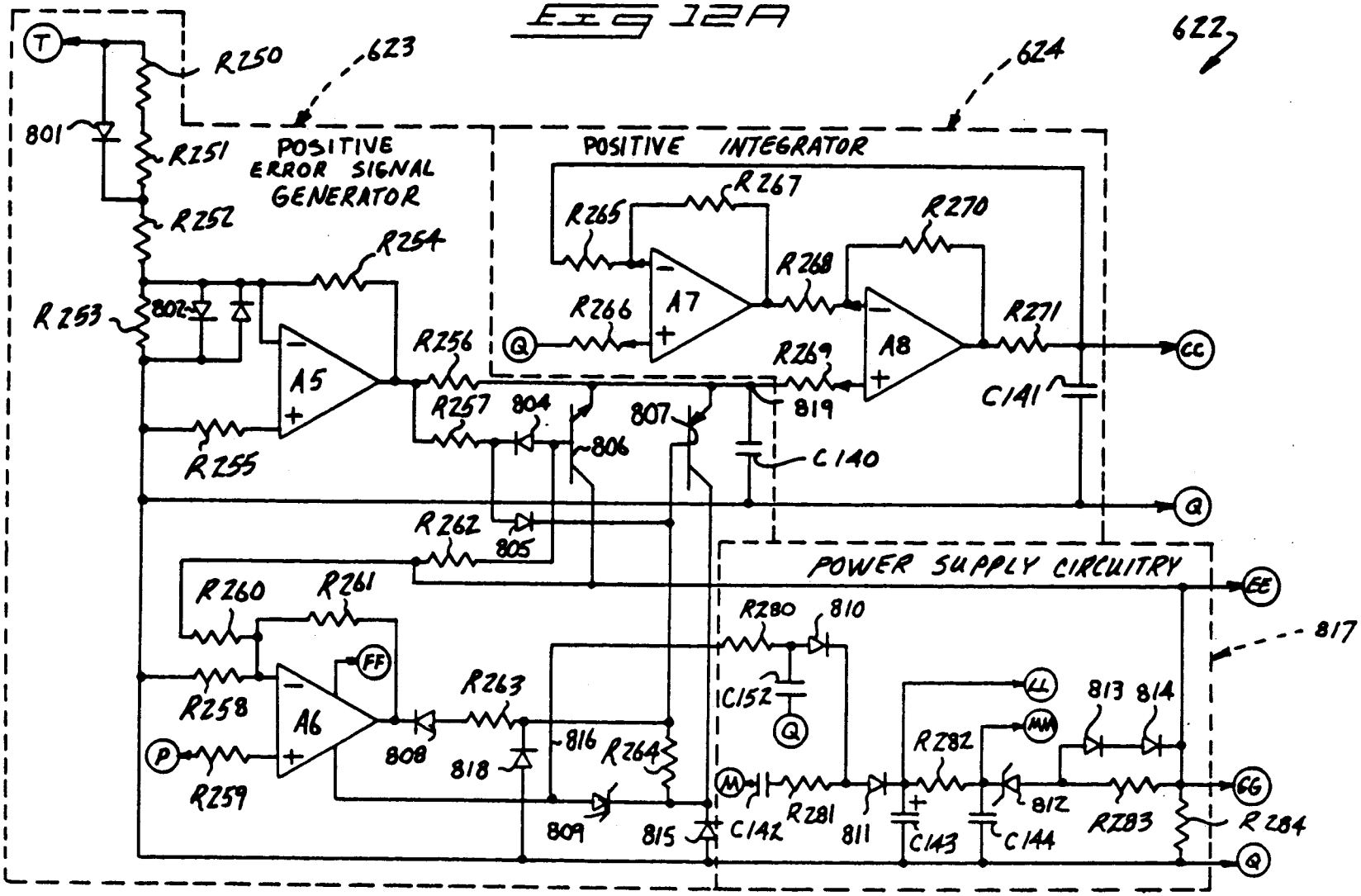
FIGS. 12A and 12B are schematic circuit diagrams showing further portions of the alternative embodiment partially shown in FIGS. 10 and 11. The portions shown in FIGS. 12A and 12B represent the modulator drive circuitry for the positive side of the electronic ballast.
Figure 12B:
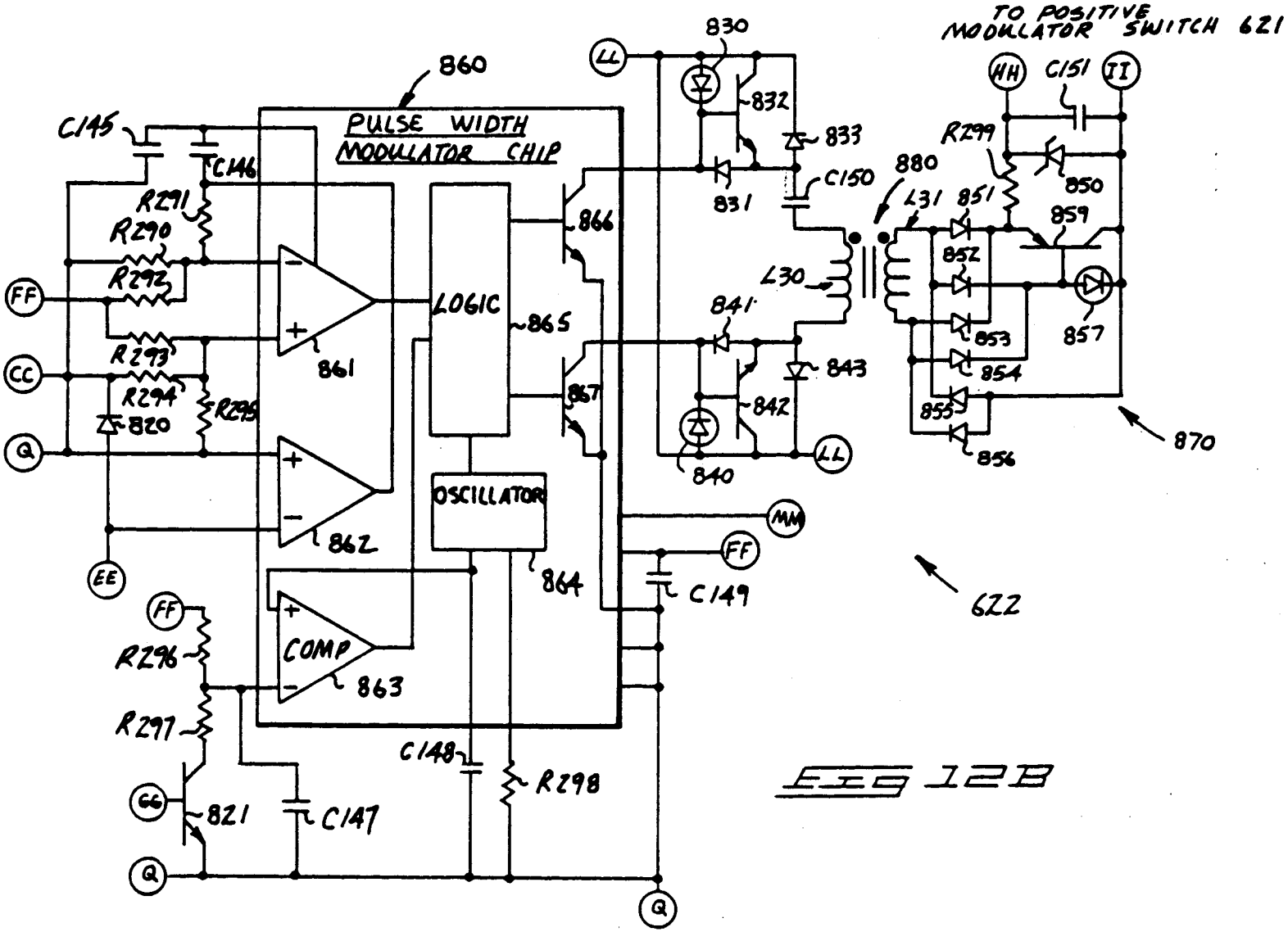

FIGS. 12A and 12B show the drive circuitry for controlling operation of the positive modulator transistor 621. The inputs to this system include the signal T which is the target +4 differential voltage generated by circuitry 680 with respect to the lamp supply terminal. Inputs also include signal P which is generated at the node between inductor 661 and current sense resistor R202. Final input is signal Q which is generated on the other side of resistor R202. Resistor R202 is shown in FIG. 10 and the voltage drop thereacross is indicative of the amount of current which is being passed through inductor 661. The outputs from the system are the HH signal and II signal which are connected to the gate and source terminals of transistor 621 to control its pulse modulation operation. In general the circuitry of FIGS. 12A and 12B are referenced to Q which is the voltage at the lower voltage end of current sense resistor R205.

FIG. 12A shows the +4 volt power supply conductor T with respect to conductor Z being connected to the circuit at one end of resistor R250 and to an anode of diode 801. The second end of resistor 250 is connected to resistor R251. The cathode of diode 801 is connected to the other side of resistor R251 which is also connected to a third resistor R252. The second end of resistor R252 is connected to resistor R253. The second end of resistor R252 is also connected to the anode of diode 802 and cathode of diode 803 as well as to the inverting input (−) of operational amplifier A5 and one end of feedback resistor R254. The second end of resistor R254 is connected to the output of operational amplifier A5. The second end of resistor R253 is connected to conductor Q which is functioning substantially as a referenced ground and to the cathode of diode 802 and the anode of diode 803. The inverting or plus (+) input of operational amplifier A5 is connected to one end of resistor R255 with the opposite end of resistor R255 being connected to conductor Q.

The resistors R250, R251, R252 and R253 are connected between the T conductor and Q conductor to form suitable voltage drops therebetween. Diode 801 is connected to provide protection against excessive swing in the operational amplifier A5. Diodes 802 and 803 similarly limit the swing of the minus input of that operational amplifier.

The error signal generator 623 also includes operational amplifier A6 which is connected to function as a current sensing comparator. The inverting input of operational amplifier A6 is connected to the Q conductor via input resistor R258. The noninverting input is connected to conductor P via input resistor R259. Thus the inputs to this operational amplifier are connected across the current sensing resistor R202 shown in FIG. 10. The inverting input of operational amplifier A6 is also connected to one end of resistor R260 and one end of feedback resistor R261. The other end of resistor R260 is connected to conductor EE which supplies an approximately +0.7 volt reference with respect to conductor Q. The opposite end of feedback resistor R261 is connected to the output of amplifier A6. Amplifier A6 is also connected to conductor FF which is a +5 volt supply with respect to conductor Q, and is generated in pulse width modulator chip 860 shown in FIG. 12B. Operational amplifier A6 is also connected at another power connection to an approximately −4.3 volt power supply generated in conductor 816 by a 3.6 volt zener diode 809 connected in series with diode 815 to conductor Q.

The output of current sensing comparator A6 is connected to the cathode of diode 808 and the anode thereof is connected to a first end of resistor R263. The opposite end of resistor R263 is connected to the cathode of diode 818, the base of transistor 807, and a first end of resistor R264. The anode of diode 818 is connected to conductor Q. The other end of resistor R264 is connected to the cathode of zener diode 809 and the cathode of diode 815. The anode of diode 815 is connected to conductor Q. The collector of transistor 807 is connected to the cathode of diode 815.

The output of amplifier A5 is connected to ends of resistors R256 and R257. The other end of resistor R257 is connected to the cathode of diode 804 and to the anode of diode 805. The cathode of diode 804 is connected to the base of NPN transistor 806. The base of NPN transistor 806 is also connected to resistor R262. The opposite end of resistor R262 is connected to the +0.7 volt power supply line EE from power supply circuitry 817. The collector of transistor 806 is also tied to the +0.7 volt supply EE. The emitter of transistor 806 is connected to the second end of resistor R256. Resistor R256 and the emitters of transistors 806 and 807 are connected to the noninverting input of operational amplifier A8 via resistor R269. A capacitor C140 is connected between the emitter of transistors 806 and 807 and conductor Q to suppress high frequency noise. The signal generated at the node marked 819 connected to the second end of resistor R256 and the emitters of the transistors 806 and 807 defines the output from the inner signal generator 623. This output is received by the integrator circuitry 624.

The error signal generator 623 operates by sensing the voltage drop across resistor R202 of FIG. 10 using this as an indicator of the amount of current flowing from inductor 661. Under normal operating conditions during positive lamp discharge periods the comparator A6 has minimal effect on the error signal from amplifier A5 at node 819. However during startup and negative lamp discharge periods the output from comparator A6 operates to limit the swing on error signal node 819 thus reducing the amount of current pulsed through the modulator. Operational amplifier A5 in general produces an error signal output which fluctuates plus or minus to 0 volts relative to conductor Q. The output of A5 is dependent upon the voltage drop across diode 642, the positive lamp discharge switching means Q103, and resistors 204, all shown in FIG. 10. Transistors 806 and 807 operate in an inverting mode of operation to limit the range of the error signal at node 819 to ±0.7 volts relative to conductor Q. The error signal is then communicated to integrator circuitry 624.

Integrator circuitry 624 includes operational amplifiers A7 and A8. As explained above, the output from error signal generator 623 is received at the noninverting input of operational amplifier A8. The inverting input to amplifier A8 is connected to the output from operational amplifier A7 via resistor R268. The inverting input of operational amplifier A8 is also connected to the output thereof via feedback resistor R270. The inputs to amplifier A7 include signal Q at the noninverting input via resistor R266. The inverting input to operational amplifier A7 is connected to the output thereof via a feedback loop and resistor R267. The inverting input of amplifier A7 is also connected via resistor R265 to the output of amplifier A8. The output of operational amplifier A8 is connected to resistor R271 at the first end thereof. The second end of resistor R271 forms the integrator output and is connected to one side of high frequency filter capacitor C141. The other side of capacitor C141 is connected to conductor Q.

FIG. 12A also shows a power supply section 817. Power from the alternating current line is received through conductor M which is connected to one side of coupling capacitor C142. The other side of capacitor C142 is connected to resistor R281. The other end of resistor 281 is connected to the anode of diode 811 and the cathode of diode 810. The anode of diode 810 is connected to capacitor C152 which has its other side connected to conductor Q. The anode of diode 810 is also connected to the anode of zener diode 809 via resistor R280. The alternating current passed across capacitor C142 is selectively divided with negative charge collecting on capacitor C152 and positive charge collecting on capacitor C143. Diode 815 and zener diode 809 limit the charge on capacitor C152 to produce the −4.3 volt signal referenced to conductor Q.

The positive charge stored on capacitor C143 is connected to conductor LL which provides an approximately +17 volt signal with respect to conductor Q. Resistor R282 is connected between conductor LL and the cathode of zener diode 812. Capacitor C144 is connected from the cathode of zener diode 812 across to conductor Q. Zener diode 812 allows an approximately +12.1 volt signal to be generated on conductor MM. Capacitor C144 serves to stabilize the voltage generated at that node and on conductor MM. The anode of zener diode 812 is connected to the first end of resistor R283. The second end of resistor R283 is connected to the first end of resistor R284 which has its second end connected to conductor Q. The anode of zener diode 812 is connected to the anode of diode 813. The cathode of diode 813 is connected to the anode of diode 814 which has its cathode connected to conductor EE in order to generate the EE signal which is approximately +0.7 volt with respect to conductor Q. The conductor marked GG communicates a biasing signal to the base of transistor 821 shown in FIG. 12B. This turns transistor 821 on which draws current from the approximately +5 volt supply FF through resistors R296 and R297 and transistor 821 to conductor Q. The node between resistors R296 and R297 is connected to a comparator 863 which forms a subcircuit within the pulse width modulator chip 860. The capacitor C147 is connected between the same input node and conductor Q. Function of transistor 821 is to provide a soft startup procedure for the pulse width modulator chip so that initial transient voltage fluctuations occurring during initiation of power to circuitry 600 does not cause damage within the chip.

FIG. 12B also shows that the integrator output signal on conductor CC is communicated to the pulse width modulator chip 860 via resistor R294 to a first error amplifier 861 existing within the pulse width modulator chip. The noninverting input of error amplifier 861 is connected not only to resistor R294 but to one end of resistor R293. The opposite end of resistor R293 is connected to the approximately +5 volt power supply conductor FF. Conductor FF is also connected to resistor R292 at the first end thereof. The second end of resistor R292 is connected to the inverting input of internal error amplifier 861. Resistor R290 is connected between conductor Q and the inverting input of amplifier 861. The inverting input of amplifier 861 is also connected to a first end of resistor R291. The second end of resistor R291 is connected to the output of second error amplifier 862 and to a first side of capacitor C146. The other side of capacitor C146 is connected to capacitor C145 which is also connected to a power pin driving the first error amplifier 861. The opposite side capacitor C145 is connected to conductor Q.

Pulse width modulator chip 860 functions in the typical manner by receiving the output signal CC from integrator 624 and processing it through error amplifier 861 which is communicated to a digital logic section 865 within the chip. An oscillator 864 within chip 860 provides a triangle wave function which is advantageously set to 100 KHz as determined by the values of capacitor C148 and resistor R298 which are connected between chip 860 and control ground Q.

The pulse width modulator chip internal logic 865 drives internal push-pull transistors 866 and 867. Transistors 866 and 867 are connected with the emitters thereof connected to conductor Q. The bases of transistors 866 and 867 are connected to logic unit 865, and the collectors thereof are connected to pins which conduct output signals from chip 860. The collector output from transistor 866 is connected to the base of transistor 832, the cathode of a constant current diode 830, and the cathode of diode 831. The anode of constant current diode 830 is connected to the approximately +17 volt supply provided on conductor LL with respect to conductor Q. Conductor LL is also connected to the collector of transistor 832 supply driving current thereto which is controllably conducted from the emitter. Diode 831 is connected with the cathode to the collector of transistor 866 and the anode to the emitter of transistor 832. Diode 833 is connected with its anode to the emitter and its cathode to the base of transistor 832. The emitter of transistor 832 is also connected to one side of a coupling capacitor C150. The other side of coupling capacitor C150 is connected to the first end of primary coil L30 of a transformer 880. The opposite or second end of coil L30 is connected to the emitter of transistor 842. The base of transistor 842 is connected to the collector of the second push pull transistor 867. The constant current diode 840 is connected with the cathode thereof to the base of transistor 842 and the anode thereof connected to conductor LL. Diode 841 is connected with the cathode thereof to the collector of transistor 867 and the anode thereof connected to the emitter of transistor 842. Diode 843 is connected with the anode thereof connected to the emitter of transistor 842 and the cathode connected to conductor LL.

The pulse width modulator chip operates with the push pull transistors 866 and 867 switching at the desired modulation frequency such as 100 KHz. This causes pulses of current to flow through primary coil L30 which induce pulses of current in the secondary coil L31 of transformer 880.

Secondary coil L31 is connected with the first end thereof connected to the anodes of diodes 851 and 852 and the cathode of diode 855. The second end of coil L31 is connected to the anodes of diodes 853 and 854 and to the cathode of diode 856. The anodes of diodes 855 and 856 are connected to conductor II which as shown on FIG. 10 is connected to the source of the positive modulation transistor 621. The cathodes of diode 851 is connected to the emitter of PNP transistor 859 and to resistor R299. The opposite end of resistor R299 is connected to the gate of modulation transistor 621. The collector of transistor 859 is connected to the source of transistor 621. The base of transistor 859 is connected to the cathodes of diodes 852 and 854. The base is also connected to the anode constant current diode 857 which has its cathode connected to the source of transistor 621. Capacitor C151 is connected between the gate and source of transistor 621.

The output from integrator circuit 624 is conducted by conductor CC which is communicated to the pulse width modulator and its associated interface componentry as shown in FIG. 12B. Conductor FF carries a relatively fixed 5 volt voltage supply relative to conductor Q. This voltage supply passes through resistor R292 and R290 to conductor Q to generate a relatively fixed +2.5 volts to the minus input of the operational amplifier 861 within pulse width modulator 860. In a similar fashion the +5 volt voltage supply connected to conductor FF conducts current through resistor R293 and resistor R295 to conductor Q. This also tends to generate the same +2.5 volt signal at the plus input of operational amplifier 861 with respect to the voltage on conductor Q. The integrated signal on conductor CC passes through resistor R294 to vary the input at the plus terminal of operational amplifier 861. This causes the output of amplifier 861 to vary and control the logic section 865 of the pulse width modulator. The logic section 865 controls the operation of push pull transistors 866 and 867 so that only one of the transistors is conductive at any particular time. Operational amplifier 862 is biased into an inoperative condition and performs no useful function in this circuit. Comparator 863 turns the logic section 865 on after an appropriate initial start up period is defined by the soft start circuitry described hereinabove.

When logic circuitry 865 turns first push pull transistor 866 on, it effectively connects the conductor Q to the base of transistor 832. This causes transistor 832 to turn off. At the same time transistor 867 is turned off which allows the regulated current flow through constant current diode 840 to be applied to the base of transistor 842 which turns transistor 842 on to conduct current from the +17 volt conductor LL through transistor 842 to the first coil L30 of transformer 880. The current path passes through coil L30, capacitor C150 and diode 831 and down through transistor 866 to conductor Q. The conduction of current through transistors 842 and 866 produces a relatively negative voltage at the dot or first end of the secondary coil L31. Accordingly, the second end of coil L31 is relatively more positive which generates current flow through diodes 853 and 854. Current flow through diodes 853 and 854 causes the base and emitter of transistor 859 to be at approximately the same voltage thus turning transistor 859 off. This allows positive current through diode 853 to pass through resistor R299 to the gate of transistor switch 621 thereby turning it on. The constant current diode 857 maintains the source of transistor 621 at a diode drop lower voltage than the gate thus assuring conduction through transistor 621 when a pulse is received.

In the opposite situation when second push pull transistor 867 is conductive, this causes transistor 842 to be turned off. When transistor 867 is turned on, then transistor 866 is turned off according to the logic of 865. When transistor 866 turns off, it causes the base of transistor 832 to rise in voltage towards conductor LL at +17 volts thus turning transistor 832 on to conduct positive current from conductor LL which is capacitively coupled across the capacitor C150 to generate a relatively more positive voltage at the first or dotted end of primary coil L30 which in turn induces a relatively positive voltage at the first or dotted end of secondary coil L31.

The gate of transistor 621 is forwardly biased with respect to the source when current is conducted either through push pull transistors 866 or 867. When the push pull transistors switch, there is a drop in current through coil L30. The charge stored on capacitor C151 thus discharges through resistor R299 and raises the emitter of transistor 859 higher in voltage than the base which is discharged through the constant current diode 857. This causes transistor 859 to turn on which causes the gate and source to be connected together thus turning the modulator transistor 621 off.

Power is modulated by transistor 621 by controlling the duty cycle during which transistors 866 and 867 are both off, thus increasing or decreasing the current with decreasing or increasing off time, respectively, per cycle of the push-pull transistors 866 and 867.

Figure 13A:
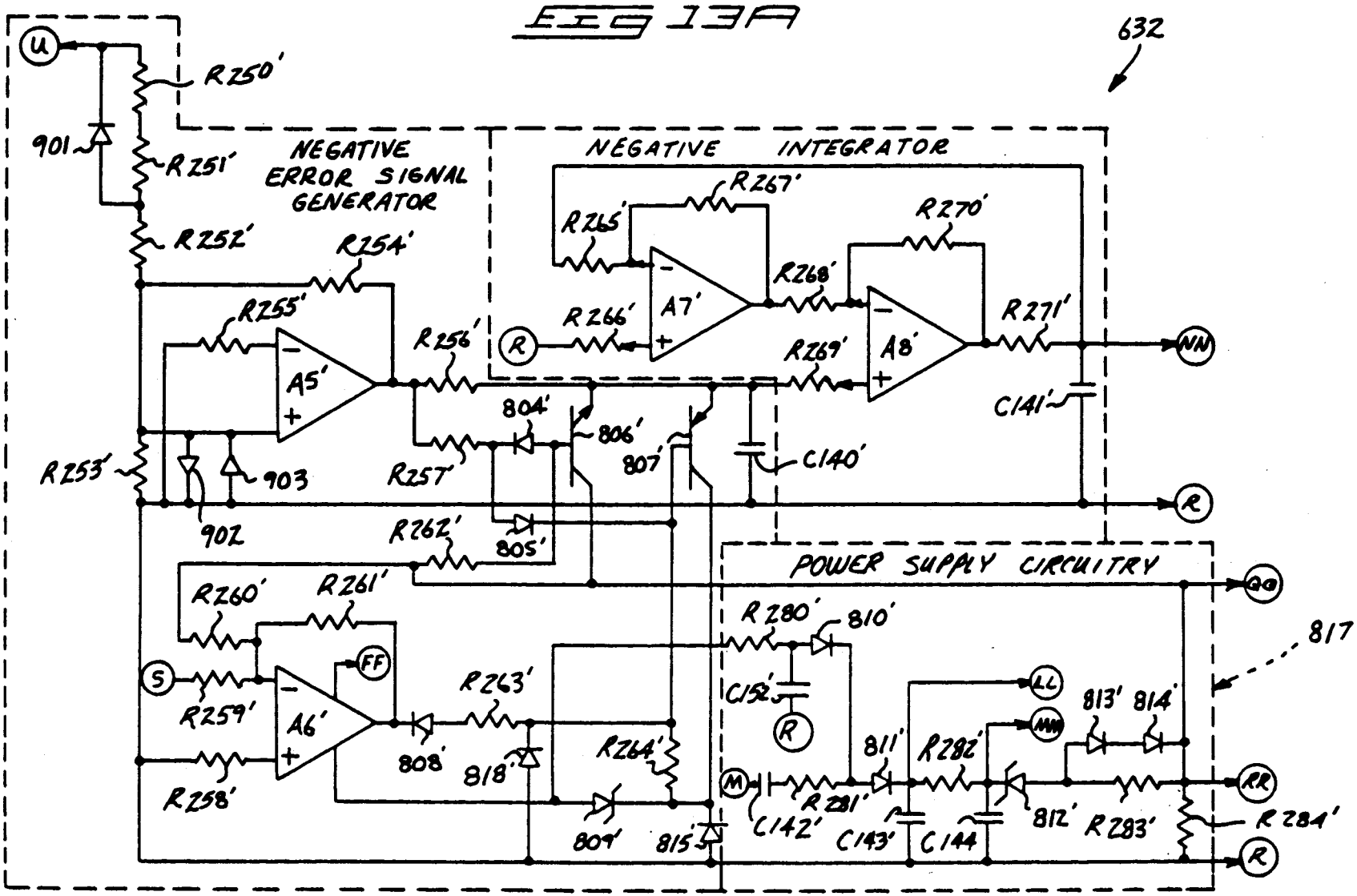
FIGS. 13A and 13B are schematic circuit diagrams showing further portions of the preferred embodiment shown in FIGS. 10, 11, 12A and 12B. The portions shown in FIGS. 13A and 13B represent the modulator drive circuitry for the negative side of the electronic ballast.
Figure 13B:
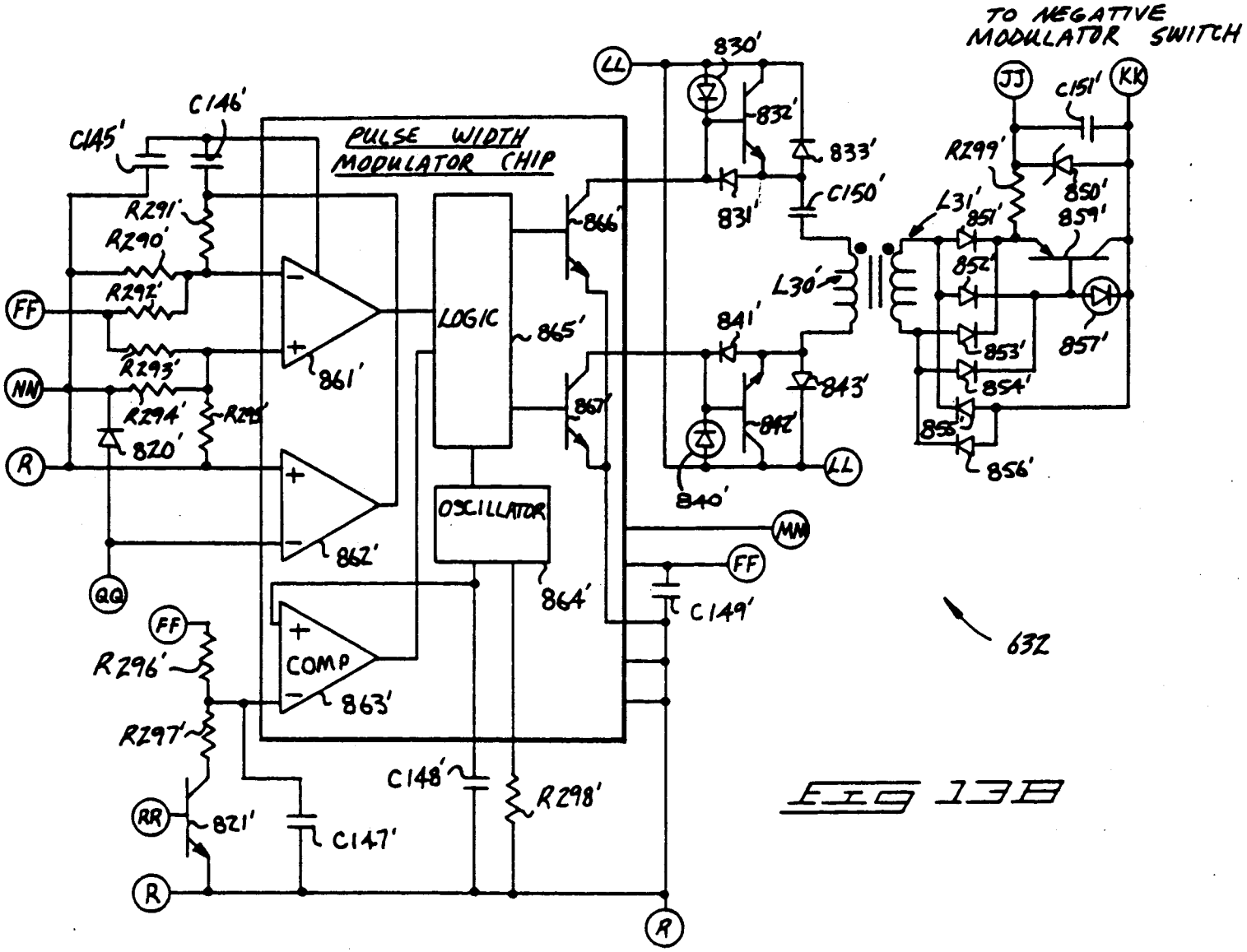
Figure 14:
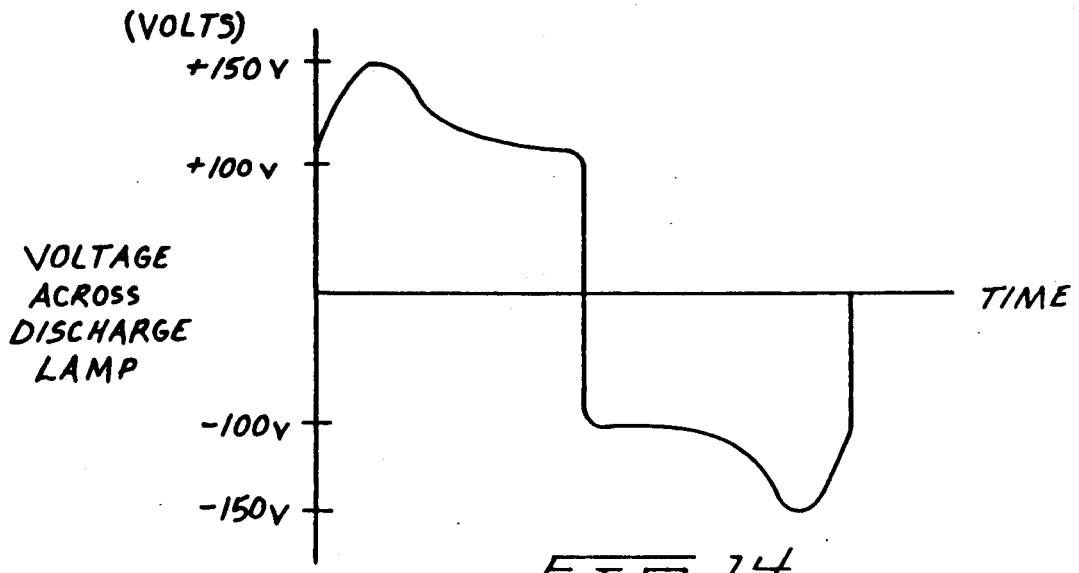
FIG. 14 is a graph showing voltage across a discharge lamp operated using the circuitry of FIGS. 9–13B.
Figure 15:
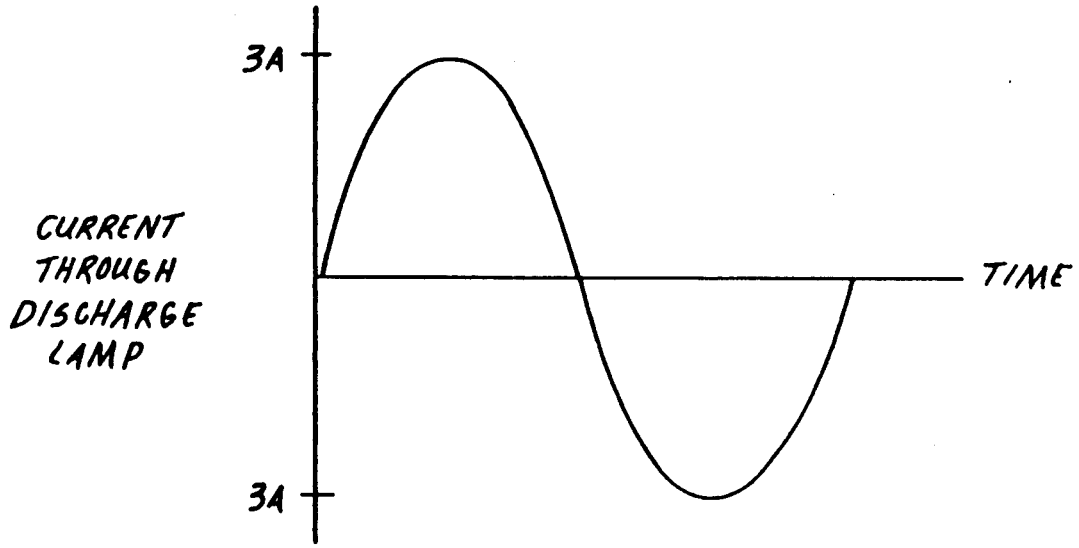
FIG. 15 is a graph showing current conducted through a discharge lamp operated using the circuitry of FIGS. 9–13B.
Figure 16:
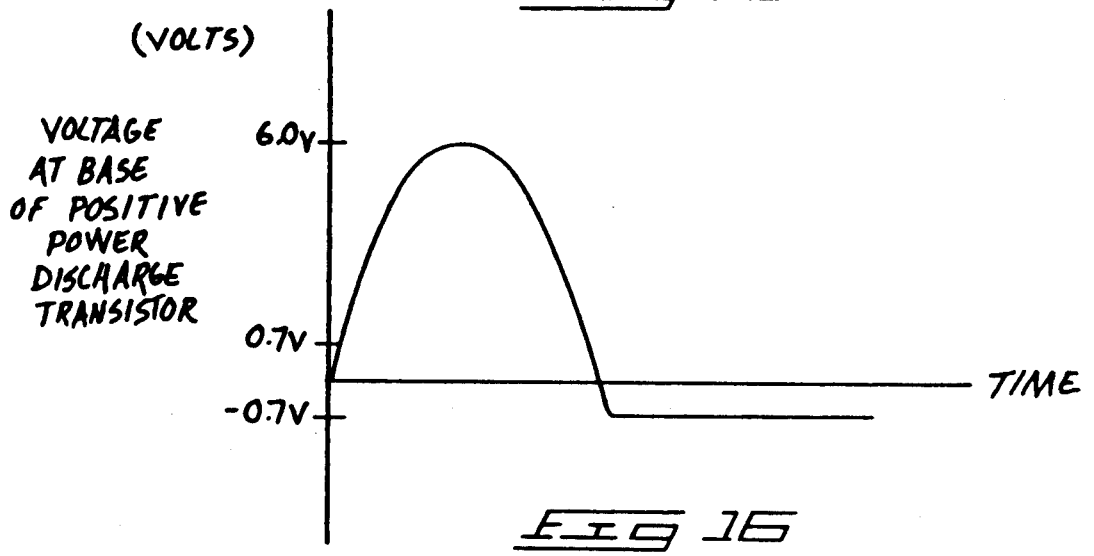
FIG. 16 is a graph showing voltage between the supply side of a discharge lamp and the base of the positive power discharge transistors shown in the circuitry of FIGS. 9–13B.

The negative modulator drive circuitry 632 is shown in FIGS. 13A and 13B. In general the circuitry construction is the same as that shown in FIGS. 12A and B and as described above, except with respect to certain polarity changes which will be described below and the fact that the inputs and outputs from the circuit are connected into the general electronic ballast circuit 600 with respect to the negative channel rather than to the positive channel. The inputs to the negative error signal generator is via conductor U which generates a −4 volt supply relative to the lamp supply terminal 700*a*. Diode 901 is used in lieu of diode 801 with diode 901 connected with the cathode thereof connected to conductor U and the anode thereof connected between resistors R251' and R252'. Resistor R252' has its opposite end connected to the plus input of operational amplifier A5'. Resistor R253' is connected from the plus input of operational amplifier A5' to the conductor R. Diodes 902 and 903 are connected in parallel between the plus input of operational amplifier A5' and conductor R in opposite orientation. Feedback resistor R254' is connected from the output of amplifier A5' to the plus input.

Conductors R and S are connected at opposite ends of the negative current sense resistor R203 shown in FIG. 10. Conductor S is connected to the minus input of operational amplifier A6' using input resistor R259'. The plus input of operational amplifier A6' is connected to conductor R via input resistor R258'.

Remaining portions of negative modulator drive circuit 632 are the same as described above with respect to positive modulator drive circuitry 622 with the added prime to indicate usage in the negative channel. The outputs from the pulse width modulator chip 860' and its coupling circuitry result in signals on conductors JJ and KK which are connected to the gate and source of negative modulating transistor 631, respectively.

The operation of negative modulating drive circuitry is substantially the same as described above with respect to the positive modulating drive circuitry 622 with proper consideration given to the opposite polarity.

Table VI below presents preferred values of resistance, inductance and capacitance for resistors, inductors and capacitors useful in a preferred form of circuit 600.

TABLE VI

| | |
|---|---|
| **RESISTORS** | |
| R200, R201 | 150K ohms |
| R202, R203 | 0.1 ohms |

TABLE VI-continued

| | |
|---|---|
| R204A, B | 0.47 ohms |
| R205A, B | 0.47 ohms |
| R206, R207 | 470K ohms |
| R210 | 82 ohms |
| R211 | 2.2K ohms |
| R212 | 680 ohms |
| R213 | 20 ohms |
| R214 | 3.3K ohms |
| R215 | 10K ohms |
| R216 | 220 ohms |
| R217 | 3.3K ohms |
| R218 | 270 ohms |
| R219 | 220 ohms |
| R220 | 82 ohms |
| R221 | 2.2K ohms |
| R222 | 680 ohms |
| R223 | 20 ohms |
| R224 | 3.3K ohms |
| R225 | 10K ohms |
| R226 | 220 ohms |
| R227 | 3.3K ohms |
| R228 | 270 ohms |
| R229 | 220 ohms |
| R250, R250' | 1.5M ohms |
| R251, R251' | 1.5M ohms |
| R252, R252' | 150K ohms |
| R253, R253' | 47K ohms |
| R254, R254' | 560K ohms |
| R255, R255' | 47K ohms |
| R256, R256' | 12K ohms |
| R257, R257' | 13K ohms |
| R258, R258' | 10K ohms |
| R259, R259' | 10K ohms |
| R260, R260' | 330K ohms |
| R261, R261' | 3.6M ohms |
| R262, R262' | 3.3K ohms |
| R263, R263' | 2.2K ohms |
| R264, R264' | 3.3K ohms |
| R265, R265' | 470K ohms |
| R266, R266' | 240K ohms |
| R267, R267' | 470K ohms |
| R268, R268' | 470K ohms |
| R269, R269' | 240K ohms |
| R270, R270' | 470K ohms |
| R271, R271' | 18K ohms |
| R280, R280' | 68 ohms |
| R281, R281' | 33 ohms |
| R282, R282' | 330 ohms |
| R283, R283' | 1.6K ohms |
| R284, R284' | 1.6K ohms |
| R290, R290' | 100K ohms |
| R291, R291' | 47K ohms |
| R292, R292' | 100K ohms |
| R293, R293' | 100K ohms |
| R294, R294' | 47K ohms |
| R295, R295' | 100K ohms |
| R296, R296' | 33K ohms |
| R297, R297' | 10K ohms |
| R298, R298' | 33K ohms |
| R299, R299' | 33 ohms |
| **CAPACITORS** | |
| C100, C101 | 560 microfarads |
| C102, C103 | 3 microfarads |
| C104, C105 | 0.02 microfarads |
| C108, C109 | 5 microfarads |
| C120, C130 | 220 microfarads |
| C121, C131 | 100 microfarads |
| C122, C132 | 0.47 microfarads |
| C123 | 47 microfarads |
| C124 | 47 microfarads |
| C140, C140' | 0.02 microfarads |
| C141, C141' | 0.1 microfarads |
| C142, C142' | 1 microfarads |
| C143, C143' | 330 microfarads |
| C144, C144' | 47 microfarads |
| C145, C145' | 0.1 microfarads |
| C146, C146' | 0.01 microfarads |
| C147, C147' | 0.47 microfarads |
| C148, C148' | 220 picofarads |
| C149, C149' | 0.47 microfarads |
| C150, C150' | 0.1 microfarads |
| C151, C151' | 0.002 microfarads |

TABLE VI-continued

| INDUCTORS | |
|---|---|
| 661, 662 | 700 microhenries |

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims, appropriately interpreted in accordance with the doctrine of equivalents.

What is claimed is:

1. A ballast circuit for controlling electrical current flow through an electrical discharge lamp from an electricity source providing alternating electrical current having positive potential portions and negative potential portions, comprising:

positive electrical charge storage means connected to receive current from said electricity source during said positive potential portions;

negative electrical charge storage means connected to receive current from said electricity source during said negative potential portions;

at least one positive current modulator for controllably modulating current discharged from the positive electrical charge storage means for powering the discharge lamp;

at least one negative current modulator for controllably modulating current discharged from the negative electrical charge storage means for powering the discharge lamp;

wherein at least one of said current modulators comprises a current flow rate control means connected to controllably conduct current from a charge storage means to power said discharge lamp; and modulation control means for controlling said current flow rate control means; said current flow rate control means being a current gate controlled by the modulation control means to conduct pulses of electrical current from the charge storage means;

at least one positive current switching means connected to receive positive current from said positive electrical charge storage means and control positive current flow through said discharge lamp to define positive lamp discharge periods;

at least one negative current switching means connected to receive negative current from said negative electrical charge storage means and control negative current flow through said discharge lamp to define negative lamp discharge periods;

switching control means for controlling said positive and negative switching means so that positive lamp discharge periods do not occur simultaneously with negative lamp discharge periods;

wherein said pulses are provided at a modulation frequency which is at least 10 times more frequent than a lamp frequency at which the discharge lamp operates.

2. A ballast circuit for controlling electrical current flow through an electrical discharge lamp from an electricity source providing alternating electrical current having positive potential portions and negative potential portions, comprising:

positive electrical charge storage means connected to receive current from said electricity source during said positive potential portions;

negative electrical charge storage means connected to receive current from said electricity source during said negative potential portions;

at least one positive current modulator for controllably modulating current discharged from the positive electrical charge storage means for powering the discharge lamp;

at least one negative current modulator for controllably modulating current discharged from the negative electrical charge storage means for powering the discharge lamp;

wherein at least one of said current modulators comprises a current flow rate control means connected to controllably conduct current from a charge storage means to power said discharge lamp; and modulation control means for controlling said current flow rate control means; said current flow rate control means being a current gate controlled by the modulation control means to conduct pulses of electrical current from the charge storage means;

at least one positive current switching means connected to receive positive current from said positive electrical charge storage means and control positive current flow through said discharge lamp to define positive lamp discharge periods;

at least one negative current switching means connected to receive negative current from said negative electrical charge storage means and control negative current flow through said discharge lamp to define negative lamp discharge periods;

switching control means for controlling said positive and negative switching means so that positive lamp discharge periods do not occur simultaneously with negative lamp discharge periods;

wherein said pulses are provided at a modulation frequency which is more frequent than a lamp frequency at which the discharge lamp operates.

3. A ballast circuit for controlling electrical current flow through an electrical discharge lamp from an electricity source providing alternating electrical current having positive potential portions and negative potential portions, comprising:

positive electrical charge storage means connected to receive current from said electricity source during said positive potential portions;

negative electrical charge storage means connected to receive current from said electricity source during said negative potential portions;

at least one positive current modulator for controllably modulating current discharged from the positive electrical charge storage means for powering the discharge lamp;

at least one negative current modulator for controllably modulating current discharged from the negative electrical charge storage means for powering the discharge lamp;

at least one positive current switching means connected to receive positive current from said positive electrical charge storage means and control positive current flow through said discharge lamp to define positive lamp discharge periods;

at least one negative current switching means connected to receive negative current from said negative electrical charge storage means and control negative current flow through said discharge lamp to define negative lamp discharge periods;

switching control means for controlling said positive and negative switching means so that positive lamp discharge periods do not occur simultaneously with negative lamp discharge periods;

at least one current regulator means connected between a current modulator and the discharge lamp.

4. A ballast circuit for controlling electrical current flow through an electrical discharge lamp from an electricity source providing alternating electrical current having positive potential portions and negative potential portions, comprising;

positive electrical charge storage means connected to receive current from said electricity source during said positive potential portions;

negative electrical charge storage means connected to receive current from said electricity source during said negative potential portions;

at least one positive current modulator for controllably modulating current discharged from the positive electrical charge storage means for powering the discharge lamp;

at least one negative current modulator for controllably modulating current discharged from the negative electrical charge storage means for powering the discharge lamp;

at least one positive current switching means connected to receive positive current from said positive electrical charge storage means and control positive current flow through said discharge lamp to define positive lamp discharge periods;

at least one negative current switching means connected to receive negative current from said negative electrical charge storage means and control negative current flow through said discharge lamp to define negative lamp discharge periods;

switching control means for controlling said positive and negative switching means so that positive lamp discharge periods do not occur simultaneously with negative lamp discharge periods;

at least one current regulator means connected between a current modulator and the discharge lamp, and at least one peak voltage generator connected to supply a charge at a voltage which is sufficient to initiate luminescence of the discharge lamp.

5. A ballast circuit for controlling electrical current flow through an electrical discharge lamp from an electricity source providing alternating electrical current having positive potential portions and negative potential portions, comprising:

positive electrical charge storage means connected to receive positive current from said electricity source during said positive potential portions;

negative electrical charge storage means connected to receive negative current from said electricity source during said negative potential portions;

at least one positive current modulator for controllably modulating positive current discharged from the positive electrical charge storage means for powering the discharge lamp;

at least one negative current modulator for controllably modulating current discharged from the negative electrical charge storage means for powering the discharge lamp;

at least one positive current switching means connected to receive positive current modulated by said positive current modulator and control positive current flow through said discharge lamp to define positive lamp discharge periods;

at least one negative current switching means connected to receive negative current modulated by said negative current modulator and control negative current flow through said discharge lamp to define negative lamp discharge periods;

at least one positive current regulation means connected between said positive current modulator and the positive current switching means;

at least one negative current regulation means connected between said negative current modulator and the negative current switching means;

switching control means for controlling said positive and negative current switching means so that positive lamp discharge periods do not occur simultaneously with negative lamp discharge periods.

6. A ballast circuit according to claim 5 wherein at least one of the current modulators operates at a modulation frequency greater than a lamp operating frequency.

7. A ballast circuit according to claim 5 wherein at least one of the current modulators operates at a modulation frequency which is at least 10 times more frequent than a lamp operating frequency.

8. A ballast circuit according to claim 5 wherein at least one of the current modulators is a pulse width modulator.

9. A ballast circuit according to claim 5 wherein the positive and negative current modulators are pulse width modulators.

10. A ballast circuit according to claim 5 wherein the positive and negative current modulators operate to modulate positive and negative current as functions related to approximate voltage drops across the positive and negative current switching means, respectively.

11. A ballast circuit according to claim 5 and further comprising at least one peak voltage generator for providing a peak voltage for initiating substantial electrical discharge within the discharge lamp during startup conditions.

12. A ballast circuit according to claim 5 and further comprising positive and negative peak voltage generators for providing positive and negative charges at positive and negative peak voltages for initiating substantial electrical discharge within the discharge lamp during the positive and negative lamp discharge periods, respectively, during startup conditions.

13. A ballast circuit according to claim 5 wherein at least one of said current modulators comprises:

a current flow rate control means connected to controllably conduct current from a charge storage means to power said discharge lamp;

modulation control means for controlling said current flow rate control means.

14. A ballast circuit according to claim 13 wherein the current flow rate control means is a current gate controlled by the modulation control means to conduct pulses of electrical current from the charge storage means.

15. A ballast circuit according to claim 14 wherein at least one of the current modulators operates at a modulation frequency greater than a lamp operating frequency at which the positive and negative current switching means switch.

16. A ballast circuit according to claim 14 wherein at least one of the current modulators operates at a modulation frequency which is at least 10 times more frequent than a lamp operating frequency at which the positive and negative current switching means switch.

17. A ballast circuit for controlling electrical current flow through an electrical discharge lamp from an electricity source providing alternating electrical current having positive potential portions and negative potential portions, comprising:

positive electrical charge storage means connected to receive positive current stored in said electricity source during said positive potential portions;

negative electrical charge storage means connected to receive negative current stored in said electricity source during said negative potential portions;

at least one positive current modulator for controllably modulating positive current discharged through the discharge lamp;

at least one negative current modulator for controllably modulating negative current discharged through the discharge lamp;

at least one positive current switching means connected to receive positive current from the positive energy storage means and to control positive current flow through said discharge lamp to define positive lamp discharge periods;

at least one negative current switching means connected to receive negative current from the negative energy storage means and to control negative current flow through said discharge lamp to define negative lamp discharge periods;

at least one positive current regulation means connected between said positive current modulator and the positive current switching means;

at least one negative current regualtion means connected between said negative current modulator and the negative current switching means;

switching control means for controlling said positive and negative current switching means so that positive lamp discharge periods do not occur simultaneously with negative lamp discharge periods.

18. A ballast circuit according to claim 17 wherein at least one of the current modulators operates at a modulation frequency greater than a lamp operating frequency.

19. A ballast circuit according to claim 17 wherein at least one of the current modulators operates at a modulation frequency which is at least 10 times more frequent than a lamp operating frequency.

20. A ballast circuit according to claim 17 wherein at least one of the current modulators is a pulse width modulator.

21. A ballast circuit according to claim 17 wherein the positive and negative current modulators are pulse width modulators.

22. A ballast circuit according to claim 17 wherein the positive and negative current modulators operate to modulate positive and negative current as functions related to approximate voltage drops across the positive and negative current switching means, respectively.

23. A ballast circuit according to claim 17 and further comprising at least one peak voltage generator for providing a peak voltage for initiating substantial electrical discharge within the discharge lamp during startup conditions.

24. A ballast circuit according to claim 17 and further comprising positive and negative peak voltage generators for providing positive and negative charges at positive and negative peak voltages for initiating substantial electrical discharge within the discharge lamp during the positive and negative lamp discharge periods, respectively, during startup conditions.

25. A ballast circuit according to claim 17 wherein at least one of said current modulators comprises:

a current flow rate control means connected to controllably conduct current from a charge storage means to power said discharge lamp;

modulation control means for controlling said current flow rate control means.

26. A ballast circuit according to claim 25 wherein the current flow rate control means is a current gate controlled by the modulation control means to conduct pulses of electrical current from the charge storage means.

27. A ballast circuit according to claim 26 wherein at least one of the current modulators operates at a modulation frequency greater than a lamp operating frequency at which the positive and negative current switching means switch.

28. A ballast circuit according to claim 26 wherein at least one of the current modulators operates at a modulation frequency which is at least 10 times more frequent than a lamp operating frequency at which the positive and negative current switching means switch.

29. A ballast circuit for controlling electrical current flow through an electrical discharge lamp from an electricity source providing alternating electrical current having positive potential portions and negative potential portions, comprising:

positive electrical charge storage means connected to receive positive current from said electricity source during said positive potential portions;

negative electrical charge storage means connected to receive negative current from said electricity source during said negative potential portions;

at least one positive current modulator for controllably modulating positive current discharged through the discharge lamp;

at least one negative current modulator for controllably modulating negative current discharged through the discharge lamp;

at least one positive current switching means connected to receive positive current stored in the positive energy storage means and to control positive current flow through said discharge lamp to define positive lamp discharge periods;

at least one negative current switching means connected to receive negative current stored in the negative energy storage means and to control negative current flow through said discharge lamp to define negative lamp discharge periods;

at least one positive current regulation means connected between said positive current modulator and the discharge lamp;

at least one negative current regulation means connected between said negative current modulator and the discharge lamp;

switching control means for controlling said positive and negative current switching means so that positive lamp discharge periods do not occur simultaneously with negative lamp discharge periods.

30. A ballast circuit according to claim 29 wherein at least one of the current modulators operates at a modulation frequency greater than a lamp operating frequency.

31. A ballast circuit according to claim 29 wherein at least one of the current modulators operates at a modulation frequency which is at least 10 times more frequent than a lamp operating frequency.

32. A ballast circuit according to claim 29 wherein at least one of the current modulators is a pulse width modulator.

33. A ballast circuit according to claim 29 wherein the positive and negative current modulators are pulse width modulators.

34. A ballast circuit according to claim 29 wherein the positive and negative current modulators operate to modulate positive and negative current as functions related to approximate voltage drops across the positive and negative current switching means, respectively.

35. A ballast circuit according to claim 29 and further comprising at least one peak voltage generator for providing a peak voltage for initiating substantial electrical discharge within the discharge lamp during startup conditions.

36. A ballast circuit according to claim 29 and further comprising positive and negative peak voltage generators for providing positive and negative charges at positive and negative peak voltages for initiating substantial electrical discharge within the discharge lamp during the positive and negative lamp discharge periods, respectively, during startup conditions.

37. A ballast circuit according to claim 29 wherein at least one of said current modulators comprises:

a current flow rate control means connected to controllably conduct current from a charge storage means to power said discharge lamp;

modulation control means for controlling said current flow rate control means.

38. A ballast circuit according to claim 37 wherein the current flow rate control means is a current gate controlled by the modulation control means to conduct pulses of electrical current from the charge storage means.

39. A ballast circuit according to claim 38 wherein at least one of the current modulators operates at a modulation frequency greater than a lamp operating frequency at which the positive and negative current switching means switch.

40. A ballast circuit according to claim 38 wherein at least one of the current modulators operates at a modulation frequency which is at least 10 times more frequent than a lamp operating frequency at which the positive and negative current switching means switch.

41. A ballast circuit for controlling electrical current flow through an electrical discharge lamp from an electricity source providing alternating electrical current having positive potential portions and negative potential portions, comprising:

positive electrical charge storage means connected to receive positive current from said electricity source during said positive potential portions;

negative electrical charge storage means connected to receive negative current from said electricity source during said negative potential portions;

at least one positive current modulator for controllably modulating positive current discharged from the positive electrical charge storage means for powering the discharge lamp;

at least one negative current modulator for controllably modulating current discharged from the negative electrical charge storage means for powering the discharge lamp;

at least one positive current switching means connected to receive positive current modulated by said positive current modulator and control positive current flow through said discharge lamp to define positive lamp discharge periods;

at least one negative current switching means connected to receive negative current modulated by said negative current modulator and control negative current flow through said discharge lamp to define negative lamp discharge periods;

switching control means for controlling said positive and negative current switching means so that positive lamp discharge periods do not occur simultaneously with negative lamp discharge periods;

at least one current regulator means connected between a current modulator and the discharge lamp.

42. A ballast circuit for controlling electrical current flow through an electrical discharge lamp from an electricity source providing alternating electrical current having positive potential portions and negative potential portions, comprising:

positive electrical charge storage means connected to receive positive current from said electricity source during said positive potential portions;

negative electrical charge storage means connected to receive negative current from said electricity source during said negative potential portions;

at least one positive current modulator for controllably modulating positive current discharged from the positive electrical charge storage means for powering the discharge lamp;

at least one negative current modulator for controllably modulating current discharged from the negative electrical charge storage means for powering the discharge lamp;

at least one positive current switching means connected to receive positive current modulated by said positive current modulator and control positive current flow through said discharge lamp to define positive lamp discharge periods;

at least one negative current switching means connected to receive negative current modulated by said negative current modulator and control negative current flow through said discharge lamp to define negative lamp discharge periods;

switching control means for controlling said positive and negative current switching means so that positive lamp discharge periods do not occur simultaneously with negative lamp discharge periods;

at least one positive current regulator means connected between said positive current modulator and the discharge lamp, and at least one negative current regulator means connected between said negative current modulator and the discharge lamp.

43. A ballast circuit for controlling electrical current flow through an electrical discharge lamp from an electricity source providing alternating electrical current having positive potential portions and negative potential portions, comprising:

positive electrical charge storage means connected to receive positive current from said electricity source during said positive potential portions;

negative electrical charge storage means connected to receive negative current from said electricity source during said negative potential portions;

at least one positive current modulator for controllably modulating positive current discharged from the positive electrical charge storage means for powering the discharge lamp;

at least one negative current modulator for controllably modulating current discharged from the negative electrical charge storage means for powering the discharge lamp;

at least one positive current switching means connected to receive positive current modulated by said positive current modulator and control positive current flow through said discharge lamp to define positive lamp discharge periods;

least one negative current switching means connected to receive negative current modulated by said negative current modulator and control negative current flow through said discharge lamp to define negative lamp discharge periods;

switching control means for controlling said positive and negative current switching means so that positive lamp discharge periods do not occur simultaneously with negative lamp discharge periods;

at least one current regulator means connected between a current modulator and a current switching means.

44. A ballast circuit for controlling electrical current flow through an electrical discharge lamp from an electricity source providing alternating electrical current having positive potential portions and negative potential portions, comprising:

positive electrical charge storage means connected to receive positive current from said electricity source during said positive potential portions;

negative electrical charge storage means connected to receive negative current from said electricity source during said negative potential portions;

at least one positive current modulator for controllably modulating positive current discharged from the positive electrical charge storage means for powering the discharge lamp;

at least one negative current modulator for controllably modulating current discharged from the negative electrical charge storage means for powering the discharge lamp;

at least one positive current switching means connected to receive positive current modulated by said positive current modulator and control positive current flow through said discharge lamp to define positive lamp discharge periods;

at least one negative current switching means connected to receive negative current modulated by said negative current modulator and control negative current flow through said discharge lamp to define negative lamp discharge periods;

switching control means for controlling said positive and negative current switching means so that positive lamp discharge periods do not occur simultaneously with negative lamp discharge periods;

at least one positive current regulator means connected between said positive current modulator and the positive current switching means, and at least one negative current regulator means connected between said negative current modulator and the negative current switching means.

45. A ballast circuit for controlling electrical current flow through an electrical discharge lamp from an electricity source providing alternating electrical current having positive potential portions and negative potential portions, comprising:

positive electrical charge storage means connected to receive positive current from said electricity source during said positive potential portions;

negative electrical charge storage means connected to receive negative current from said electricity source during said negative potential portions;

at least one positive current modulator for controllably modulating positive current discharged from the positive electrical charge storage means for powering the discharge lamp;

at least one negative current modulator for controllably modulating current discharged from the negative electrical charge storage means for powering the discharge lamp;

at least one positive current switching means connected to receive positive current modulated by said positive current modulator and control positive current flow through said discharge lamp to define positive lamp discharge periods;

at least one negative current switching means connected to receive negative current modulated by said negative current modulator and control negative current flow through said discharge lamp to define negative lamp discharge periods;

switching control means for controlling said positive and negative current switching means so that positive lamp discharge periods do not occur simultaneously with negative lamp discharge periods;

wherein at least one of the current modulators operates at a modulation frequency greater than a lamp operating frequency.

46. A ballast circuit for controlling electrical current flow through an electrical discharge lamp from an electricity source providing alternating electrical current having positive potential portions and negative potential portions, comprising:

positive electrical charge storage means connected to receive positive current from said electricity source during said positive potential portions;

negative electrical charge storage means connected to receive negative current from said electricity source during said negative potential portions;

at least one positive current modulator for controllably modulating positive current discharged from the positive electrical charge storage means for powering the discharge lamp;

at least one negative current modulator for controllably modulating current discharged from the negative electrical charge storage means for powering the discharge lamp;

at least one positive current switching means connected to receive positive current modulated by said positive current modulator and control positive current flow through said discharge lamp to define positive lamp discharge periods;

at least one negative current switching means connected to receive negative current modulated by said negative current modulator and control negative current flow through said discharge lamp to define negative lamp discharge periods;

switching control means for controlling said positive and negative current switching means so that positive lamp discharge periods do not occur simultaneously with negative lamp discharge periods;

wherein at least one of the current modulators operates at a modulation frequency which is at least 10 times more frequent than a lamp operating frequency.

47. A ballast circuit for controlling electrical current flow through an electrical discharge lamp from an electricity source providing alternating electrical current having positive potential portions and negative potential portions, comprising:

positive electrical charge storage means connected to receive positive current from said electricity source during said positive potential portions;

negative electrical charge storage means connected to receive negative current from said electricity source during said negative potential portions;

at least one positive current modulator for controllably modulating positive current discharged from the positive electrical charge storage means for powering the discharge lamp;

at least one negative current modulator for controllably modulating current discharged from the negative electrical charge storage means for powering the discharge lamp;

at least one positive current switching means connected to receive positive current modulated by said positive current modulator and control positive current flow through said discharge lamp to define positive lamp discharge periods;

at least one negative current switching means connected to receive negative current modulated by said negative current modulator and control negative current flow through said discharge lamp to define negative lamp discharge periods;

switching control means for controlling said positive and negative current switching means so that positive lamp discharge periods do not occur simultaneously with negative lamp discharge periods;

at least one current regulator means connected between a current modulator and the discharge lamp, and at least one peak voltage generator connected to supply a charge at a voltage which is sufficient to initiate luminescence of the discharge lamp.

48. A ballast circuit for controlling electrical current flow through an electrical discharge lamp from an electricity source providing alternating electrical current having positive potential portions and negative potential portions, comprising:

positive electrical charge storage means connected to receive positive current from said electricity source during said positive potential portions;

negative electrical charge storage means connected to receive negative current from said electricity source during said negative potential portions;

at least one positive current modulator for controllably modulating positive current discharged from the positive electrical charge storage means for powering the discharge lamp;

at least one negative current modulator for controllably modulating current discharged from the negative electrical charge storage means for powering the discharge lamp;

at least one positive current switching means connected to receive positive current modulated by said positive current modulator and control positive current flow through said discharge lamp to define positive lamp discharge periods;

at least one negative current switching means connected to receive negative current modulated by said negative current modulator and control negative current flow through said discharge lamp to define negative lamp discharge periods;

switching control means for controlling said positive and negative current switching means so that positive lamp discharge periods do not occur simultaneously with negative lamp discharge periods;

wherein the positive and negative current modulators operate to modulate positive and negative current as functions related to approximate voltage drops across the positive and negative current switching means, respectively.

49. A ballast circuit for controlling electrical current flow through an electrical discharge lamp from an electricity source providing alternating electrical current having positive potential portions and negative potential portions, comprising:

positive electrical charge storage means connected to receive positive current from said electricity source during said positive potential portions;

negative electrical charge storage means connected to receive negative current from said electricity source during said negative potential portions;

at least one positive current modulator for controllably modulating positive current discharged from the positive electrical charge storage means for powering the discharge lamp;

at least one negative current modulator for controllably modulating current discharged from the negative electrical charge storage means for powering the discharge lamp;

at least one positive current switching means connected to receive positive current modulated by said positive current modulator and control positive current flow through said discharge lamp to define positive lamp discharge periods;

at least one negative current switching means connected to receive negative current modulated by said negative current modulator and control negative current flow through said discharge lamp to define negative lamp discharge periods;

switching control means for controlling said positive and negative current switching means so that positive lamp discharge periods do not occur simultaneously with negative lamp discharge periods;

wherein at least one of said current modulators comprises:

a current flow rate control means connected to controllably conduct current from a charge storage means to power said discharge lamp;

modulation control means for controlling said current flow rate control means;

wherein the current flow rate control means is a current gate controlled by the modulation control means to conduct pulses of electrical current from the charge storage means;

wherein at least one of the current modulators operates at a modulation frequency greater than a lamp operating frequency at which the positive and negative current switching means switch.

50. A ballast circuit for controlling electrical current flow through an electrical discharge lamp from an electricity source providing alternating electrical current having positive potential portions and negative potential portions, comprising:

positive electrical charge storage means connected to receive positive current from said electricity source during said positive potential portions;

negative electrical charge storage means connected to receive negative current from said electricity source during said negative potential portions;

at least one positive current modulator for controllably modulating positive current discharged from the positive electrical charge storage means for powering the discharge lamp;

at least one negative current modulator for controllably modulating current discharged from the negative electrical charge storage means for powering the discharge lamp;

at least one positive current switching means connected to receive positive current modulated by said positive current modulator and control positive current flow through said discharge lamp to define positive lamp discharge periods;

at least one negative current switching means connected to receive negative current modulated by said negative current modulator and control negative current flow through said discharge lamp to define negative lamp discharge periods;

switching control means for controlling said positive and negative current switching means so that positive lamp discharge periods do not occur simultaneously with negative lamp discharge periods;

wherein at least one of said current modulators comprises:

a current flow rate control means connected to controllably conduct current from a charge storage means to power said discharge lamp;

modulation control means for controlling said current flow rate control means;

wherein the current flow rate control means is a current gate controlled by the modulation control means to conduct pulses of electrical current from the charge storage means;

wherein at least one of the current modulators operates at a modulation frequency which is at least 10 times more frequent than a lamp operating frequency at which the positive and negative current switching means switch.

51. A ballast circuit for controlling electrical current flow through an electrical discharge lamp from an electricity source providing alternating electrical current having positive potential portions and negative potential portions, comprising:

positive electrical energy storage means connected to receive positive current from said electricity source during said positive potential portions;

negative electrical energy storage means connected to receive negative current from said electricity source during said negative potential portions;

at least one positive current modulator for controllably modulating positive current discharged from the positive electrical energy storage means for powering the discharge lamp;

at least one negative current modulator for controllably modulating current discharged from the negative electrical energy storage means for powering the discharge lamp;

at least one positive current switching means connected to receive positive current stored in the positive energy storage means and to control positive current flow through said discharge lamp to define positive lamp discharge periods;

at least one negative current switching means connected to receive negative current stored in the negative energy storage means and to control negative current flow through said discharge lamp to define negative lamp discharge periods;

at least one positive current regulation means connected between said positive current modulator and the positive current switching means;

at least one negative current regulation means connected between said negative current modulator and the negative current switching means;

switching control means for controlling said positive and negative switching means so that positive lamp discharge periods do not occur simultaneously with negative lamp discharge periods.

52. A ballast circuit according to claim 51 wherein at least one of the current modulators operates at a modulation frequency greater than a lamp operating frequency.

53. A ballast circuit according to claim 51 wherein at least one of the current modulators operates at a modulation frequency which is at least 10 times more frequent than a lamp operating frequency.

54. A ballast circuit according to claim 51 wherein at least one of the current modulators is a pulse width modulator.

55. A ballast circuit according to claim 51 wherein the positive and negative current modulators are pulse width modulators.

56. A ballast circuit according to claim 51 wherein the positive and negative current modulators operate to modulate positive and negative current as functions related to approximate voltage drops across the positive and negative current switching means, respectively.

57. A ballast circuit according to claim 51 and further comprising at least one peak voltage generator for providing a peak voltage for initiating substantial electrical discharge within the discharge lamp during startup conditions.

58. A ballast circuit according to claim 51 and further comprising positive and negative peak voltage generators for providing positive and negative charges at positive and negative peak voltages for initiating substantial electrical discharge within the discharge lamp during the positive and negative lamp discharge periods, respectively, during startup conditions.

59. A ballast circuit according to claim 51 wherein at least one of said current modulators comprises:

a current flow rate control means connected to controllably conduct current from an energy storage means to power said discharge lamp;

modulation control means for controlling said current flow rate control means.

60. A ballast circuit according to claim 59 wherein the current flow rate control means is a current gate controlled by the modulation control means to conduct pulses of electrical current from the energy storage means.

61. A ballast circuit according to claim 60 wherein at least one of the current modulators operates at a modulation frequency greater than a lamp operating frequency at which the positive and negative current switching means switch.

62. A ballast circuit according to claim 60 wherein at least one of the current modulators operates at a modulation frequency which is at least 10 times more frequent than a lamp operating frequency at which the positive and negative current switching means switch.

63. A ballast circuit for controlling electrical current flow through an electrical discharge lamp from an electricity source providing alternating electrical current having positive potential portions and negative potential portions, comprising:

positive electrical energy storage means connected to receive positive current from said electricity source during said positive potential portions;

negative electrical energy storage means connected to receive negative current from said electricity source during said negative potential portions;

at least one positive current modulator for controllably modulating positive current discharged through the discharge lamp;

at least one negative current modulator for controllably modulating negative current discharged through the discharge lamp;

at least one positive current switching means connected to receive positive current stored in the positive energy storage means and to control positive current flow through said discharge lamp to define positive lamp discharge periods;

at least one negative current switching means connected to receive negative current stored in the negative energy storage means and to control negative current flow through said discharge lamp to define negative lamp discharge periods;

at least one positive current regulation means connected between said positive current modulator and the positive current switching means;

at least one negative current regulation means connected between said negative current modulator and the negative current switching means;

switching control means for controlling said positive and negative switching means so that positive lamp discharge periods do not occur simultaneously with negative lamp discharge periods.

64. A ballast circuit according to claim 63 wherein at least one of the current modulators operates at a modulation frequency greater than a lamp operating frequency.

65. A ballast circuit according to claim 63 wherein at least one of the current modulators operates at a modulation frequency which is at least 10 times more frequent than a lamp operating frequency.

66. A ballast circuit according to claim 63 wherein at least one of the current modulators is a pulse width modulator.

67. A ballast circuit according to claim 63 wherein the positive and negative current modulators are pulse width modulators.

68. A ballast circuit according to claim 63 wherein the positive and negative current modulators operate to modulate positive and negative current as functions related to approximate voltage drops across the positive and negative current switching means, respectively.

69. A ballast circuit according to claim 63 and further comprising at least one peak voltage generator for providing a peak voltage for initiating substantial electrical discharge within the discharge lamp during startup conditions.

70. A ballast circuit according to claim 63 and further comprising positive and negative peak voltage generators for providing positive and negative charges at positive and negative peak voltages for initiating substantial electrical discharge within the discharge lamp during the positive and negative lamp discharge periods, respectively, during starup conditions.

71. A ballast circuit according to claim 63 wherein at least one of said current modulators comprises:

A current flow rate control means connected to controllably conduct current from an energy storage means to power said discharge lamp;

modulation control means for controlling said current flow rate control means.

72. A ballast circuit according to claim 71 wherein the current flow rate control means is a current gate controlled by the modulation control means to conduct pulses of electrical current from the energy storage means.

73. A ballast circuit according to claim 72 wherein at least one of the current modulators operates at a modulation frequency greater than a lamp operating frequency at which the positive and negative current switching means switch.

74. A ballast circuit according to claim 72 wherein at least one of the current modulators operates at a modulation frequency which is at least 10 times more frequent than a lamp operating frequency at which the positive and negative current switching means switch.

75. A ballast circuit for controlling electrical current flow through an electrical discharge lamp from an electricity source providing alternating electrical current having positive potential portions and negative potential portions, comprising:

positive electrical energy storage means connected to receive positive current from said electricity source during said positive potential portions;

negative electrical energy storage means connected to receive negative current from said electricity source during said negative potential portions;

at least one positive current modulator for controllably modulating positive current discharged through the discharge lamp;

at least one negative current modulator for controllably modulating negative current discharged through the discharge lamp;

at least one positive current switching means connected to receive positive current stored in the positive energy storage means and to control positive current flow through said discharge lamp to define positive lamp discharge periods;

at least one negative current switching means connected to receive negative current stored in the negative energy storage means and to control negative current flow through said discharge lamp to define negative lamp discharge periods;

at least one positive current regulation means connected between said positive current modulator and the discharge lamp;

at least one negative current regulation means connected between said negative current modulator and the discharge lamp;

switching control means for controlling said positive and negative switching means so that positive lamp discharge periods do not occur simultaneously with negative lamp discharge periods.

76. A ballast circuit according to claim 75 wherein at least one of the current modulators operates at a modulation frequency greater than a lamp operating frequency.

77. A ballast circuit according to claim 75 wherein at least one of the current modulators operates at a modulation frequency which is at least 10 times more frequent than a lamp operating frequency.

78. A ballast circuit according to claim 75 wherein at least one of the current modulators is a pulse width modulator.

79. A ballast circuit according to claim 75 wherein the positive and negative current modulators are pulse width modulators.

80. A ballast circuit according to claim 75 wherein the positive and negative current modulators operate to modulate positive and negative current as functions related to approximate voltage drops across the positive and negative current switching means, respectively.

81. A ballast circuit according to claim 75 and further comprising at least one peak voltage generator for providing a peak voltage for initiating substantial electrical discharge within the discharge lamp during startup conditions.

82. A ballast circuit according to claim 75 and further comprising positive and negative peak voltage generators for providing positive and negative charges at positive and negative peak voltages for initiating substantial electrical discharge within the discharge lamp during the positive and negative lamp discharge periods, respectively, during startup conditions.

83. A ballast circuit according to claim 75 wherein at least one of said current modulators comprises:

a current flow rate control means connected to controllably conduct current from a charge storage means to power said discharge lamp;

modulation control means for controlling said current flow rate control means.

84. A ballast circuit according to claim 83 wherein the current flow rate control means is a current gate controlled by the modulation control means to conduct pulses of electrical current from the charge storage means.

85. A ballast circuit according to claim 84 wherein at least one of the current modulators operates at a modulation frequency greater than a lamp operating frequency at which the positive and negative current switching means switch.

86. A ballast circuit according to claim 84 wherein at least one of the current modulators operates at a modulation frequency which is at least 10 times more frequent than a lamp operating frequency at which the positive and negative current switching means switch.

87. A ballast circuit for controlling electrical current flow through an electrical discharge lamp from an electricity source providing alternating electrical current having positive potential portions and negative potential portions, comprising:

positive electrical energy storage means connected to receive positive current from said electricity source during said positive potential portions;

negative electrical energy storage means connected to receive negative current from said electricity source during said negative potential portions;

at least one positive current modulator for controllably modulating positive current discharged through the discharge lamp;

at least one negative current modulator for controllably modulating negative current discharged through the discharge lamp;

at least one positive current switching means connected to receive positive current stored in the positive energy storage means and to control positive current flow through said discharge lamp to define positive lamp discharge periods;

at least one negative current switching means connected to receive negative current stored in the negative energy storage means and to control negative current flow through said discharge lamp to define negative lamp discharge periods;

switching control means for controlling said positive and negative switching means so that positive lamp discharge periods do not occur simultaneously with negative lamp discharge periods;

wherein at least one of the current modulators operates at a modulation frequency greater than a lamp operating frequency.

88. A ballast circuit for controlling electrical current flow through an electrical discharge lamp from an electricity source providing alternating electrical current having positive potential portions and negative potential portions, comprising:

positive electrical energy storage means connected to receive positive current from said electricity source during said positive potential portions;

negative electrical energy storage means connected to receive negative current from said electricity source during said negative potential portions;

at least one positive current modulator for controllably modulating positive current discharged through the discharge lamp;

at least one negative current modulator for controllably modulating negative current discharged through the discharge lamp;

at least one positive current switching means connected to receive positive current stored in the positive energy storage means and to control positive current flow through said discharge lamp to define positive lamp discharge periods;

at least one negative current switching means connected to receive negative current stored in the negative energy storage means and to control negative current flow through said discharge lamp to define negative lamp discharge periods;

switching control means for controlling said positive and negative switching means so that positive lamp discharge periods do not occur simultaneously with negative lamp discharge periods;

wherein at least one of the current modulators operates at a modulation frequency which is at least 10 times more frequent than a lamp operating frequency.

89. A ballast circuit for controlling electrical current flow through an electrical discharge lamp from an electricty source providing alternating electrical current having positive potential portions and negative potential portions, comprising:

positive electrical energy storage means connected to receive positive current from said electricity source during said positive potential portions;

negative electrical energy storage means connected to receive negative current from said electricity source during said negative potential portions;

at least one positive current modulator for controllably modulating positive current discharged through the discharge lamp;

at least one negative current modulator for controllably modulating negative current discharged through the discharge lamp;

at least one positive current switching means connected to receive positive current stored in the positive energy storage means and to control positive current flow through said discharge lamp to define positive lamp discharge periods;

at least one negative current switching means connected to receive negative current stored in the negative energy storage means and to control negative current flow through said discharge lamp to define negative lamp discharge periods;

switching control means for controlling said positive and negative switching means so that positive lamp discharge periods do not occur simultaneously with negative lamp discharge periods;

wherein the positive and negative current modulators operate to modulate positive and negative current as functions related to approximate voltage drops across the positive and negative current switching means, respectively.

90. A ballast circuit for controlling electrical current flow through an electrical discharge lamp from an electricity source providing alternating electrical current having positive potential portions and negative potential portions, comprising:

positive electrical energy storage means connected to receive positive current from said electricity source during said positive potential portions;

negative electrical energy storage means connected to receive negative current from said electricity source during said negative potential portions;

at least one positive current modulator for controllably modulating positive current discharged through the discharge lamp;

at least one negative current modulator for controllably modulating negative current discharged through the discharge lamp;

at least one positive current switching means connected to receive positive current stored in the positive energy storage means and to control positive current flow through said discharge lamp to define positive lamp discharge periods;

at least one negative current switching means connected to receive negative current stored in the negative energy storage means and to control negative current flow through said discharge lamp to define negative lamp discharge periods;

switching control means for controlling said positive and negative switching means so that positive lamp discharge periods do not occur simultaneously with negative lamp discharge periods;

wherein at least one of said current modulators comprises:

a current flow rate control means connected to controllably conduct current from a charge storage means to power said discharge lamp;

modulation control means for controlling said current flow rate control means;

wherein the current flow rate control means is a current gate controlled by the modulation control means to conduct pulses of electrical current from the charge storage means;

wherein at least one of the current modulators operates at a modulation frequency greater than a lamp operating frequency at which the positive and negative current switching means switch.

91. A ballast circuit for controlling electrical current flow through an electrical discharge lamp from an electricity source providing alternating electrical current having positive potential portions and negative potential portions, comprising:

positive electrical energy storage means connected to receive positive current from said electricity source during said positive potential portions;

negative electrical energy storage means connected to receive negative current from said electricity source during said negative potential portions;

at least one positive current modulator for controllably modulating positive current discharged through the discharge lamp;

at least one negative current modulator for controllably modulating negative current discharged through the discharge lamp;

at least one positive current switching means connected to receive positive current stored in the positive energy storage means and to control positive current flow through said discharge lamp to define positive lamp discharge periods;

at least one negative current switching means connected to receive negative current stored in the negative energy storage means and to control negative current flow through said discharge lamp to define negative lamp discharge periods;

switching control means for controlling said positive and negative switching means so that positive lamp discharge periods do not occur simultaneously with negative lamp discharge periods;

wherein at least one of said current modulators comprises:

a current flow rate control means connected to controllably conduct current from a charge storage means to power said discharge lamp;

modulation control means for controlling said current flow rate control means;

wherein the current flow rate control means is a current gate controlled by the modulation control means to conduct pulses of electrical current from the charge storage means;

wherein at least one of the current modulators operates at a modulation frequency which is at least 10 times more frequent than a lamp operating frequency at which the positive and negative current switching means switch.

92. A method for controlling current flow through an electrical discharge lamp powered by an electricity source providing alternating electrical current having positive potential portions and negative potential portions, comprising:

charging at least one positive charge storage means during said positive potential portions;

charging at least one negative charge storage means during said negative potential portions;

modulating the flow of positive current from the positive charge storage means;

modulating the flow of negative current from the negative charge storage means;

controllably conducting modulated positive current to the discharge lamp to define positive lamp discharge periods;

controllably conducting modulated negative current to the discharge lamp to define negative lamp discharge periods;

controlling the lamp discharge periods so that the negative lamp discharge periods do not occur simultaneously with the positive lamp discharge periods;

wherein at least one of said modulating steps is accomplished at a modulation frequency which is more frequent than a lamp operating frequency at which the discharge lamp operates.

93. A method for controlling current flow through an electrical discharge lamp powered by an electricity source providing alternating electrical current having positive potential portions and negative potential portions, comprising:

charging at least one positive charge storage means during said positive potential portions;

charging at least one negative charge storage means during said negative potential portions;

modulating the flow of positive current from the positive charge storage means;

modulating the flow of negative current from the negative charge storage means;

controllably conducting modulated positive current to the discharge lamp to define positive lamp discharge periods;

controllably conducting modulated negative current to the discharge lamp to define negative lamp discharge periods;

controlling the lamp discharge periods so that the negative lamp discharge periods do not occur simultaneously with the positive lamp discharge periods;

wherein at least one of said modulating steps is accomplished at a modulation frequency which is at least 10 times more frequent than a lamp operating frequency at which the discharge lamp operates.

94. A method for controlling current flow through an electrical discharge lamp powered by an electricity source providing alternating electrical current having positive potential portions and negative potential portions, comprising:

charging at least one positive charge storage means during said positive potential portions;

charging at least one negative charge storage means during said negative potential portions;

modulating the flow of positive current from the positive charge storage means;

modulating the flow of negative current from the negative charge storage means;

controllably conducting modulated positive current to the discharge lamp to define positive lamp discharge periods;

controllably conducting modulated negative current to the discharge lamp to define negative lamp discharge periods;

controlling the lamp discharge periods so that the negative lamp discharge periods do not occur simultaneously with the positive lamp discharge periods;

regulating at least one of the positive or negative currents after said modulating steps.

95. A method according to claim 94 wherein at least one of said modulating steps is accomplished at a modulation frequency which is more frequent than a lamp operating frequency at which the discharge lamp operates.

96. A method according to claim 94 wherein at least one of said modulating steps is accomplished at a modulation frequency which is at least 10 times more frequent than a lamp operating frequency at which the discharge lamp operates.

97. A method for controlling current flow through an electrical discharge lamp powered by an electricity source providing alternating electrical current having positive potential portions and negative potential portions, comprising:

storing positive electrical energy in at least one first positive electrical energy storage means during said positive potential portions;

storing negative electrical energy in at least one first negative electrical energy storage means during said negative potential portions;

modulating a main operating flow of positive current from the positive charge storage means;

modulating a main operating flow of negative current from the negative charge storage means;

storing modulated positive electrical energy in at least one second positive electrical energy storage means;

storing modulated negative electrical energy in at least one second negative electrical energy storage means;

controllably conducting modulated positive current from the at least one second positive electrical energy storage means to the discharge lamp to define positive lamp discharge periods;

controllably conducting modulated negative current from the at least one second negative electrical energy storage means to the discharge lamp to define negative lamp discharge periods;

controlling the lamp discharge periods so that the negative lamp discharge periods do not occur simultaneously with the positive lamp discharge periods;

wherein at least one of said modulating steps is accomplished at a modulation frequency which is more frequent than a lamp operating frequency at which the discharge lamp operates.

98. A method for controlling current flow through an electrical discharge lamp powered by an electricity source providing alternating electrical current having positive potential portions and negative potential portions, comprising:

storing positive electrical energy in at least one first positive electrical energy storage means during said positive potential portions;

storing negative electrical energy in at least one first negative electrical energy storage means during said negative potential portions;

modulating a main operating flow of positive current from the positive charge storage means;

modulating a main operating flow of negative current from the negative charge storage means;

storing modulated positive electrical energy in at least one second positive electrical energy storage means;

storing modulated negative electrical energy in at least one second negative electrical energy storage means;

controllably conducting modulated positive current from the at least one second positive electrical energy storage means to the discharge lamp to define positive lamp discharge periods;

controllably conducting modulated negative current from the at least one second negative electrical energy storage means to the discharge lamp to define negative lamp discharge periods;

controlling the lamp discharge periods so that the negative lamp discharge periods do not occur simultaneously with the positive lamp discharge periods;

wherein at least one of said modulating steps is accomplished at a modulation frequency which is at least 10 times more frequent than a lamp operating frequency at which the discharge lamp operates.

99. A method for controlling current flow through an electrical discharge lamp powered by an electricity source providing alternating electrical current having positive potential portions and negative potential portions, comprising:

storing positive electrical energy in at least one positive electrical energy storage means during said positive potential portions;

storing negative electrical energy in at least one negative electrical energy storage means during said negative potential portions;

modulating a main operating flow of positive current from the positive charge storage means;

modulating a main operating flow of negative current from the negative charge storage means;

controllably conducting modulated positive current to the discharge lamp to define positive lamp discharge periods;

controllably conducting modulated negative current to the discharge lamp to define negative lamp discharge periods;

controlling the lamp discharge periods so that the negative lamp discharge periods do not occur simultaneously with the positive lamp discharge periods;

wherein at least one of said modulating steps is accomplished at a modulation frequency which is more frequent than a lamp operating frequency at which the discharge lamp operates.

100. A method for controlling current flow through an electrical discharge lamp powered by an electricity source providing alternating electrical current having positive potential portions and negative potential portions, comprising:

storing positive electrical energy in at least one positive electrical energy storage means during said positive potential portions;

storing negative electrical energy in at least one negative electrical energy storage means during said negative potential portions;

modulating a main operating flow of positive current from the positive charge storage means;

modulating a main operating flow of negative current from the negative charge storage means;

controllably conducting modulated positive current to the discharge lamp to define positive lamp discharge periods;

controllably conducting modulated negative current to the discharge lamp to define negative lamp discharge periods;

controlling the lamp discharge periods so that the negative lamp discharge periods do not occur simultaneously with the positive lamp discharge periods;

wherein at least one of said modulating steps is accomplished at a modulation frequency which is at least 10 times more frequent than a lamp operating frequency at which the discharge lamp operates.

101. A method for controlling current flow through an electrical discharge lamp powered by an electricity source providing alternating electrical current having positive potential portions and negative potential portions, comprising:

storing positive electrical energy in at least one positive electrical energy storage means during said positive potential portions;

storing negative electrical energy in at least one negative electrical energy storage means during said negative potential portions;

modulating a main operating flow of positive current from the positive charge storage means;

modulating a main operating flow of negative current from the negative charge storage means;

controllably conducting modulated positive current to the discharge lamp to define positive lamp discharge periods;

controllably conducting modulated negative current to the discharge lamp to define negative lamp discharge periods;

controlling the lamp discharge periods so that the negative lamp discharge periods do not occur simultaneously with the positive lamp discharge periods;

regulating at least one of the positive or negative currents after said modulating steps.

102. A method according to claim 101 wherein at least one of said modulating steps is accomplished at a modulation frequency which is more frequent than a lamp operating frequency at which the discharge lamp operates.

103. A method according to claim 101 wherein at least one of said modulating steps is accomplished at a modulation frequency which is at least 10 times more frequent than a lamp operating frequency at which the discharge lamp operates.

* * * * *